US007473503B2

(12) United States Patent
Yamada et al.

(10) Patent No.: US 7,473,503 B2
(45) Date of Patent: Jan. 6, 2009

(54) ELECTROPHOTOGRAPHIC PHOTORECEPTOR, IMAGE-FORMING DEVICE, PROCESS CARTRIDGE AND IMAGE-FORMING METHOD

(75) Inventors: Wataru Yamada, Kanagawa (JP); Katsumi Nukada, Kanagawa (JP); Masahiro Iwasaki, Kanagawa (JP); Kenji Yao, Kanagawa (JP); Kazuhiro Koseki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 496 days.

(21) Appl. No.: 11/236,811

(22) Filed: Sep. 28, 2005

(65) Prior Publication Data

US 2006/0292464 A1 Dec. 28, 2006

(30) Foreign Application Priority Data

Jun. 24, 2005 (JP) ..... 2005-185161

(51) Int. Cl.
*G03G 5/06* (2006.01)

(52) U.S. Cl. ..... 430/56

(58) Field of Classification Search ..... 430/56, 430/58.2, 58.75; 399/159

See application file for complete search history.

(56) References Cited

U.S. PATENT DOCUMENTS

| | | | | |
|---|---|---|---|---|
| 6,203,954 | B1 | 3/2001 | Anayama | |
| 2003/0118366 | A1 * | 6/2003 | Nukada et al. | 399/109 |
| 2003/0129451 | A1 * | 7/2003 | Nukada et al. | 428/690 |
| 2003/0232262 | A1 * | 12/2003 | Yamada et al. | 430/58.2 |
| 2004/0197690 | A1 | 10/2004 | Yamada et al. | |

FOREIGN PATENT DOCUMENTS

| | | |
|---|---|---|
| CN | 1467571 A | 1/2004 |
| JP | A 11-38656 | 2/1999 |
| JP | A 2002-6527 | 1/2002 |
| JP | A 2002-82466 | 3/2002 |
| JP | A 2002-82469 | 3/2002 |
| JP | A 2003-186215 | 7/2003 |
| JP | A 2003-186234 | 7/2003 |

* cited by examiner

*Primary Examiner*—John L Goodrow
(74) *Attorney, Agent, or Firm*—Oliff & Berridge, PLC

(57) ABSTRACT

An electrophotographic photoreceptor comprising: a conductive support; and a photo-sensitive layer on the conductive support, wherein the photo-sensitive layer comprises a functional layer comprising a cured product of a curable resin composition, the curable resin composition comprising an alcohol-soluble, curable resin and a polyether-modified silicone oil.

20 Claims, 11 Drawing Sheets

ELECTROPHOTOGRAPHIC PHOTORECEPTOR, IMAGE-FORMING DEVICE, PROCESS CARTRIDGE AND IMAGE-FORMING METHOD

BACKGROUND OF THE INVENTION

1. Field of the Invention

The present invention relates to an electrophotographic photoreceptor, an image-forming device, a process cartridge and an image-forming method.

2. Description of the Related Art

An image-forming device of a so-called xerography system comprises an electrophotographic photoreceptor (hereinafter referred to merely as "photoreceptor" in some cases), a charging device, an exposing device, a developing device and a transferring device and performs image formation according to the electrophotographic process using them.

In recent years, image-forming devices of the xerography system have acquired a higher processing speed and a longer life owing to technical development of constituent members and the system. With such development, requirements for high-speed adaptability and high reliability of each subsystem have increased more than before. In particular, high-speed adaptability and high reliability are more eagerly required with a photoreceptor to be used for recording an image and a cleaning member for cleaning the photoreceptor. Also, the photoreceptor and the cleaning member suffer a more stress than other members due to the sliding movement between the photoreceptor and the cleaning member. Thus, the photoreceptor suffers formation of scratches or wear, which can be the cause of image defects.

Therefore, in order to lengthen the life of the electrophotographic photoreceptor, it is of extreme importance to depress formation of scratches or wear and, in view of improving mechanical strength of the photo-sensitive layer, use of a curable resin has been examined. For example, JP-A-11-38656 described below discloses an electrophotographic photoreceptor having the outermost layer of a cross-linked structure containing a specific silane compound and having a charge transporting ability. Also, JP-A-2002-6527, JP-A-2002-82466, JP-A-2002-82469, JP-A-2003-186215 and JP-A-2003-186234 disclose an electrophotographic photoreceptor having the outermost layer of a cross-linked structure constituted by using a phenol resin and having a charge transporting ability.

However, even conventional electrophotographic photoreceptors described above are liable to suffer coating defects upon production thereof due to, for example, "cissing" of a coating solution containing a silane compound or a phenol resin and can cause a problem of image defects derived from the coating defects. Inparticular, in the case of using an alcohol-soluble curable resin, the problem becomes serious. Additionally, some investigations have been made on physical properties such as mechanical strength of the functional layer containing the silane compound or the phenol resin. Actually, however, sufficient investigations have not necessarily been made in view of improving film-forming properties.

SUMMARY OF THE INVENTION

The invention has been made with such background, and provides an electrophotographic photoreceptor which has sufficiently improved film-forming properties of the functional layer constituted by an alcohol-soluble curable resin and which can stably provide a good image quality over a long period of time, and an image-forming device, a process cartridge and an image-forming method using the electrophotographic photoreceptor.

As a result of intensive investigations to attain the above-described object, the inventors have found that the above-mentioned problems can be solved by incorporating, upon formation of a functional layer comprising a cured product of a curable composition containing an alcohol-soluble, curable resin, both the alcohol-soluble, curable resin and a polyether-modified silicone oil in the curable resin composition, thus having achieved the invention.

That is, the electrophotographic photoreceptor of the invention is an electrophotographic photoreceptor comprising a conductive support and a photo-sensitive layer on the conductive support, wherein the photo-sensitive layer has a functional layer comprising a cured product of a curable resin composition containing an alcohol-soluble, curable resin and a polyether-modified silicone oil.

Additionally, reasons why a long-life electrophotographic photoreceptor can be obtained by the invention without suffering coating failure upon production thereof are not necessarily clarified. However, the inventors surmise as follows.

Generally, it is considered that, in the case of forming a thin film using a coating solution containing an alcohol-soluble, curable resin, surface tension (or surface energy) changes so much upon formation of a film from a coating solution that there result coating defects such as cissing. In contrast, in the invention, it is surmised that the polyether-modified silicone oil exerts an effect of slowing down the change of surface tension (or surface energy) of the curable resin and, as a result, can sufficiently depress generation of the coating defects.

Also, the image-forming device of the invention comprises:

the electrophotographic photoreceptor described above;

a charging unit that charges the electrophotographic photoreceptor;

an exposing unit that exposes the charged electrophotographic photoreceptor to form an electrostatic latent image;

a developing unit that develops the electrostatic latent image with a toner to form a toner image; and a transferring unit that transfers the toner image to a transfer medium.

The process cartridge of the invention comprises:

the electrophotographic photoreceptor described above; and at least one unit selected from the group consisting of a charging unit that charges the electrophotographic photoreceptor, a developing unit that develops an electrostatic latent image formed on the electrophotographic photoreceptor to form a toner image, and a cleaning unit that removes toner particles remaining on the surface of the electrophotographic photoreceptor.

The image-forming method of the invention comprises:

charging the electrophotographic photoreceptor described above;

exposing the charged electrophotographic photoreceptor to form an electrostatic latent image;

developing the electrostatic latent image with a toner; and transferring the toner image to a transfer medium.

According to the image-forming device and the image-forming method of the invention, good image quality can be stably obtained over a long period of time by conducting the electrophotographic process including the steps of charging, exposing, developing, transferring and, further, cleaning using the electrophotographic photoreceptor of the invention having the excellent properties as described above.

BRIEF DESCRIPTION OF THE DRAWINGS

Preferred embodiments of the present invention will be described in detail based on the following figure, wherein.

DETAILED DESCRIPTION OF THE INVENTION

Figure 1:
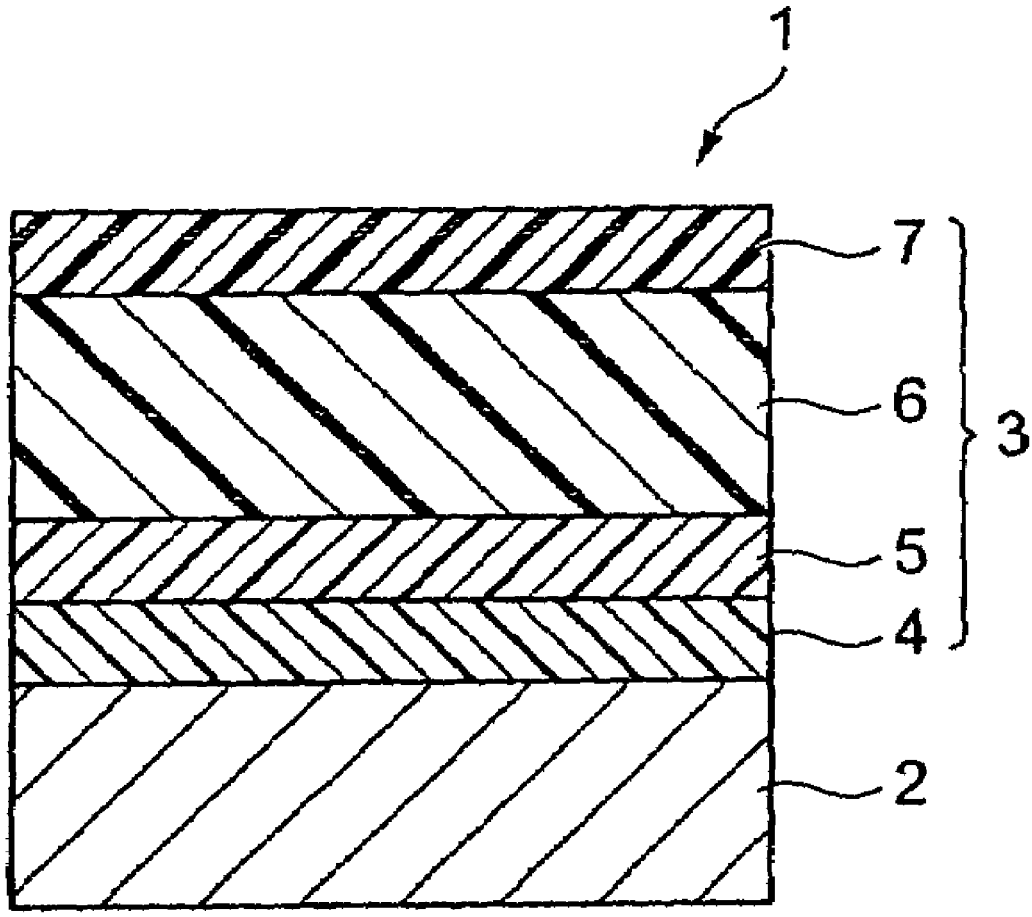
FIG. 1 is a schematic view showing one preferred embodiment of the electrophotographic photoreceptor of the invention.

A preferred embodiment of the invention is described in detail below by reference to drawings. Additionally, in the drawings, the same or corresponding elements are designated by the same reference numbers or signs, and overlapping descriptions are omitted.

(Electrophotographic Photoreceptor)

The electrophotographic photoreceptor of the invention is an electrophotographic photoreceptor comprising a conductive support and a photo-sensitive layer on the conductive support, wherein the photo-sensitive layer has a functional layer comprising a cured product of a curable resin composition containing an alcohol-soluble, curable resin and a polyether-modified silicone oil.

In the electrophotographic photoreceptor of the invention, the curable resin contained in the functional layer is preferably a phenol resin. A sufficient mechanical strength can be imparted to the functional layer by using a phenol resin as the curable resin.

Also, a functional layer comprising a cured product of a curable resin composition containing the phenol resin and the polyether-modified silicone oil shows excellent deposit-removing properties against residual toner particles after the transferring step and against discharge products such as $NO_x$ and an ozone gas generated by the charging stress in the electrophotogjraphic process and is, therefore, particularly preferred as the outermost layer of the electrophotographic photoreceptor (a layer provided at a position the most remote from the conductive support).

FIG. 1 is a schematic cross-sectional view showing one preferred embodiment of the electrophotographic photoreceptor of the invention. An electrophotographic photoreceptor shown by FIG. 1 has a function-separating type photosensitive layer 3 wherein a charge generating layer 5 and a charge transporting layer 6 are separately provided. More specifically, the electreophotographic photoreceptor 1 has a structure wherein a subbing layer 4, a charge generating layer 5, a charge transporting layer 6 and a protective layer 7 are provided in this order on a conductive support 2. The protective layer 7 is a layer comprising a cured product of a curable resin composition containing an alcohol-soluble, curable resin and a polyether-modified silicone oil.

Each element of the electrophotographic photoreceptor 1 is described in detail below.

Examples of the conductive support 2 include a metal plate, a metal drum or a metal belt using a metal such as aluminum, copper, zinc, stainless steel, chromium, nickel, molybdenum, vanadium, indium, gold or platinum or an alloy thereof, and paper, plastic film or belt on which is coated, vacuum deposited or laminated a conductive polymer, a conductive compound such as indium oxide or a metal or alloy of aluminum, palladium or gold.

In order to prevent interference pattern to be generated upon irradiation with a laser light, the surface of the conductive support 2 is preferably roughened. The roughening degree is preferably from 0.04 μm to 0.5 μm in terms of center-line average roughness Ra. In case when Ra is less than 0.04 μm, the surface becomes nearly a specular surface which fails to give the effect of preventing interference and, in case when Ra exceeds 0.5 μm, there results a coarse image quality even when the film of the invention is formed, thus such surface roughness not being preferred.

As a method of roughening the surface of the conductive support 2, a wet honing method conducted by blasting a suspension of an abrasive in water against the support, a centerless grinding method wherein grinding is continuously conducted by press-contacting the support against a rotating grinding wheel or a method of anodic oxidation is preferred. Also, a method of roughening, without roughening the surface of the support, by forming on the surface of the support a resin layer containing dispersed therein conductive or semiconductive powder particles which function to roughen the surface.

The anodic oxidation treatment is a treatment wherein anodic oxidation of aluminum is conducted in an electrolyte solution with the aluminum being an anode to thereby form an aluminum oxide film on the surface of aluminum. Examples of the electrolyte solution include a solution of sulfuric acid and a solution of oxalic acid. However, the thus-produced porous anodized film is chemically active and is liable to be stained, and undergoes a large change in resistance depending upon surrounding conditions. Hence, the anodized aluminum plate is subjected to pore-sealing treatment wherein fine pores in the anodic oxidation film are closed by expansion of volume caused by hydration reaction in pressed steam or boiling water (optionally containing a salt of a metal such as nickel) and are converted to more stable hydrated oxide.

The thickness of the anodized film is preferably from 0.3 to 15 μm. In case where the thickness is less than 0.3 μm, there results a poor barrier property against charge injection whereas, in case where the thickness is more than 15 μm, there results an increase in residual potential after repeated uses.

The treatment with an acidic treating solution comprising phosphoric acid, chromic acid and hydrofluoric acid can be conducted in the following manner. As to the proportion of phosphoric acid, chromic acid and hydrofluoric acid in the acidic treating solution, the concentration of phosphoric acid is in the range of from 10 to 11% by weight, the concentration of chromic acid is in the range of from 3 to 5% by weight, and the concentration of hydrofluoric acid is in the range of from 0.5 to 2% by weight, with the total concentration of these acids being in the range of preferably from 13.5 to 18% by weight. The treating temperature is from 42 to 48° C. A thicker film can be obtained with a higher speed by keeping the treating temperature at a higher level. The thickness of the film is preferably from 0.3 to 15 μm. In case where the thickness is less than 0.3 μm, there results a poor barrier property against charge injection whereas, in case where the thickness is more than 15 μm, there results an increase in residual potential after repeated uses.

Boehmite treatment can be conducted by dipping in a 90 to 100° C. pure water for 5 to 60 minutes or by contacting with a 90 to 120° C.-heated steam for 5 to 60 minutes. The thickness of the film is preferably from 0.1 to 5 μm. The thus-treated product may further be subjected to anodic oxidation treatment using an electrolyte solution having a low film-dissolving ability such as a solution of adipic acid, boric acid, borate, phosphate, phthalate, maleate, benzoate, tartrate or citrate.

Additionally, in the case of using a light source emitting a light which does not cause interference, the roughening treatment for preventing interference pattern is not particularly required and, since defects due to uneven surface of the conductive support 2 can be avoided, such light source is suited for realizing a longer life.

The subbing layer 4 is provided as needed. However, particularly in the case where the conductive support 2 has been subjected to the treatment with an acidic solution or to the boehmite treatment, defects-covering ability of the conductive support 2 tends to become sufficient, and hence it is preferred to provide the subbing layer 4.

Examples of the materials to be used for the subbing layer 4 include organic zirconium compounds such as a zirconium chelate compound, a zirconium alkoxide compound and a zirconium coupling agent; organic titanium compounds such as a titanium chelate compound, a titanium alkoxide compound and a titanate coupling agent; organic aluminum compounds such as an aluminum chelate compound and an aluminum coupling agent; and organometallic compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound and an aluminum zirconium alkoxide. Organic zirconium compounds, organic titanium compounds and organic aluminum compounds are particularly preferably used since they show a low residual potential and good electrophotographic properties.

The subbing layer 4 may further contain a silane coupling agent. Examples of the silane coupling gagent include vinyltrichlorosilane, vinyltrimethoxysilane, vinyltriethoxysilane, vinyl-tris-2-methoxyethoxysilane, vinyltriacetoxysilane, γ-glycidoxypropyltrimethoxysilane, γ-methacryloxypropyltrimethoxysilane, -γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexyltrimethoxysilane. The mixing proportion thereof can properly be determined as needed.

The subbing layer 4 may further contain a binder resin. As the binder resin, known binder resins such as polyvinyl alcohol, polyvinyl methyl ether, poly-N-vinylimidazole, polyethylenoxide, ethyl cellulose, methyl cellulose, ethylene-acrylic acid copolymer, polyamide, polyimide, casein, gelatin, polyethylene, polyester, phenol resin, vinyl chloride-vinyl acetate copolymer, epoxy resin, polyvinylpyrrolidone, polyvinylpyridine, polyurethane, polyglutamic acid and polyacrylic acid may also be used. The mixing proportion thereof can properly be determined as needed.

Also, in view of reducing the residual potential or improving stability to environmental conditions, the subbing layer 4 may contain an electron transporting pigment. Examples of such electron transporting pigment include organic pigments such as perylene pigments described in JP-A-47-30330, bis-benzimidazoleperylene pigments, polycyclic quinine pigments, indigo pigments and quinacridone pigments; organic pigments such as bisazo pigments and phthalocyanine pigments having an electron attractive substituent such as a cyano group, a nitro group, a nitroso group or a halogen atom; and inorganic pigments such as zinc oxide and titanium oxide. Of these pigments, perylene pigments, bis-benzimidazoleperylene pigments, polycyclic quinine pigments, zinc oxide and titanium oxide are preferably used due to their high electron mobility. The surface of the pigments may be subjected to surface treatment with the above-described coupling agent or binder for the purpose of controlling dispersing properties and charge transporting properties. When used in an excess amount, the electron transporting pigments reduce the strength of the subbing layer and cause coating defects, thus being used in an amount of 95% by weight or less, preferably 90% by weight or less.

Also, in view of improvement of electric properties or improvement of light-scattering properties, the subbing layer 4 may further contain fine powders of various organic compounds or fine powders of inorganic compounds. In particular, inorganic pigments such as white pigments (e.g., titanium oxide, zinc oxide, zinc flower, zinc sulfide, white lead and lithopone) and extender pigments (e.g., alumina, calcium carbonate and barium sulfate), polyethylene terephthalate resin particles, benzoguanamine resin particles and styrene resin particles are effective. The particle size of the fine powders to be added is from 0.01 to 2 μm. The fine powders are added as needed, and the amount thereof is preferably from 10 to 90% by weight, more preferably from 30 to 80% by weight, based on the total weight of the solid components of the subbing layer 4.

The subbing layer 4 can be formed by coating a coating solution containing the above-described constituents on the conductive support 2 and drying it. As the solvent to be used in the coating solution for forming the subbing layer 4, any organic solvent may be used that can dissolve the organometallic compounds and the resins and do not cause gelation or agglomeration upon mixing/dispersing an electron transporting pigment. For example, common organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used independently or in combination of two or more thereof. Also, as a method of dispersing treatment for the coating solution, there may be employed a method of using, for example, roll mill, ball mill, vibration ball mill, attritor, sand mill, colloid mill, paint shaker or ultrasonic wave. Further, as a method for coating the coating solution, there may be employed a common method such as a blade coating method, a wire bar coating method, a spray coating method, a dip coating method, a bead coating method, an air knife coating method or a curtain coating method. Drying after coating is conducted at a temperature at which the solvent can be evaporated to form a film. The thickness of the subbing layer 4 is generally from 0.01 to 30 μm, preferably from 0.05 to 25 μm.

The charge generating layer 5 contains a charge generating material and a binder resin. As the charge generating material, known ones such as organic pigments exemplified by azo pigments (e.g., bis-azo pigments and tris-azo pigments), condensed ring-containing aromatic pigments (e.g., dibromoanthoanthrone), perylene pigments, pyrrolopyrrol pigments and phthalocyanine pigments; and inorganic pigments exemplified by trigonal selenium and zinc oxide. In particular, in the case where an exposure light of from 380 to 500 nm in wavelength is used upon image formation, a metal phthalocyanine pigments, a metal-free phthalocyanine pigments, trigonal selenium and dibromoanthoanthrone are preferred. Of these, hydroxygallium phthalocyanine disclosed in JP-A-5-263007 and JP-A-5-279591, chlorogallium phthalocyanine disclosed in JP-A-5-98181, dichlorotin phthalocyanine disclosed in JP-A-5-140472 and JP-A-5-140473, and titanyl phthalocyanine disclosed in JP-A-4-189873 and JP-A-5-43813 are particularly preferred.

The binder resin for the charge generating layer 5 can be selected from a wide scope of insulating resins. It may also be selected from organic photo-conductive polymers such as poly-N-vinylcarbazole, polyvinylanthracene, polyvinylpyrene and polysilane. Preferred examples of the binder resin include insulating resins such as a polyvinyl butyral resin, a polyarylate resin (e.g., a polycondensate between bisphenol A and phthalic acid), a polycarbonate resin, a polyester resin, a phenoxy resin, a vinyl chloride-vinyl acetate copolymer, a polyamide resin, an acryl resin, a polyacrylamide resin, a polyvinylpyridine resin, a cellulose resin, an urethane resin, an epoxy resin, casein, a polyvinyl alcohol resin and a polyvinylpyrrolidone resin which, however, are not limitative at all. These binder resins may be used independently or in combination of two or more thereof. The ratio by weight of the charge generating material to the binder resin is in the range of preferably from 10:1 to 1:10.

The charge generating layer 5 can be formed by coating a coating solution containing the above-described constituents on the subbing layer 4 and drying it. As the solvent to be used for the coating solution for forming the charge generating layer 5, there may be used common organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxoane, tetrahydrofuran, methylene chloride, chloroform, chlorobenzene and toluene independently or in combination of two or more thereof. Also, as a dispersing method to be employed upon preparation of the coating solution, there may be employed common methods such as a ball mill dispersing method, an attritor dispersing method and a sand mill dispersing method. However, as dispersing conditions, those conditions must be employed under which the charge generating material of the pigment does not undergo change in crystal form. Further, upon dispersion, it is effective to adjust the particle size of the pigment to be 0.5 μm or less, preferably 0.3 μm or less, more preferably 0.15 μm or less. Further, as a method for coating the coating solution, there may be employed common methods such as a blade coating method, a wire bar coating method, a spray coating method, a dip coating method, a bead coating method, an air knife coating method and a curtain coating method. Drying after coating is conducted at a temperature at which the solvent is evaporated to form a film. The thickness of the charge generating layer 5 is generally from 0.1 to 5 μm, preferably from 0.2 to 2.0 μm.

The charge transporting layer 6 is constituted by a charge transporting material and a binder resin or by a high molecular electron transporting material.

Examples of the charge transporting material include electron transporting compounds such as quinone-based compounds (e.g., p-benzoquinone, chloranil, bromanil and anthraquinone); tetracyanoquinodimethane-based compounds; fluorenone compounds (e.g., 2,4,7-trinitrofluorenone; xanthone-based compounds; benzophenone-based compounds; cyanovinyl-based compounds and ethylenic compounds and positive hole transporting compounds such as triarylamine-based compounds; benzidine-based compounds; arylalkane-based compounds; aryl-substituted ethylenic compounds; stilbene-based compounds; anthracene-based compounds and hydrazone-based compounds. However, these are not limitative at all. These charge transporting materials may be used independently or in combination of two or more thereof.

In view of mobility, the charge transporting material is preferably a compound represented by the following general formula (a-1), (a-2) or (a-3).

(a-1)

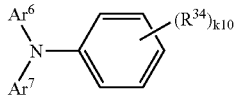

In the above formula (a-1), $R^{34}$ represents a hydrogen atom or a methyl group, k10 represents 1 or 2. $Ar^6$ and $Ar^7$ each represents a substituted or unsubstituted aryl group, $—C_6H_4—C(R^{38})=C(R^{39})(R^{40})$ or $—C_6H_4—CH=CH—CH=C(Ar)_2$, with examples of the substituent including a halogen atom, an alkyl group containing from 1 to 5 carbon atoms, an alkoxy group containing from 1 to 5 carbon atoms and a substituted amino group substituted by an alkyl group containing from 1 to 3 carbon atoms. $R^{38}$, $R^{39}$ and $R^{40}$ each represents a hydrogen atom, a substituted or unsubstituted alkyl group or a substituted or unsubstituted aryl group, and Ar represents a substituted or unsubstituted aryl group.

(a-2)

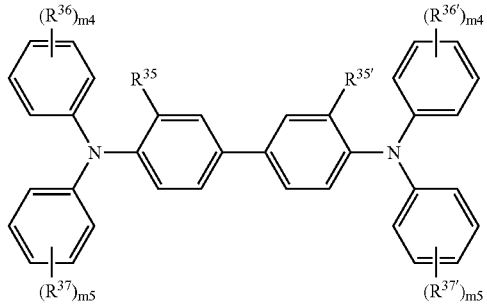

In the above-described formula (a-2), $R^{35}$ and $R^{35'}$ each independently represents a hydrogen atom, a halogen atom, an alkyl group containing from 1 to 5 carbon atoms or an alkoxy group containing from 1 to 5 carbon atoms, $R^{36}$, $R^{36'}$, $R^{37}$ and $R^{37'}$ each independently represents a halogen atom, an alkyl group containing from 1 to 5 carbon atoms, an alkoxy group containing from 1 to 5 carbon atoms, an amino group substituted by an alkyl group containing from 1 to 2 carbon atoms, a substituted or unsubstituted aryl group, —C($R^{38}$)=C($R^{39}$)($R^{40}$) or —CH=CH—CH=C(AR)$_2$, $R^{38}$, $R^{39}$ and $R^{40}$ each independently represents a hydrogen atom, a substituted or unsubstituted alkyl group or a substituted or unsubstituted aryl group, and Ar represents a substituted or unsubstituted aryl group. Also, m4 and m5 each independently represents an integer of 0 to 2.

(a-3)

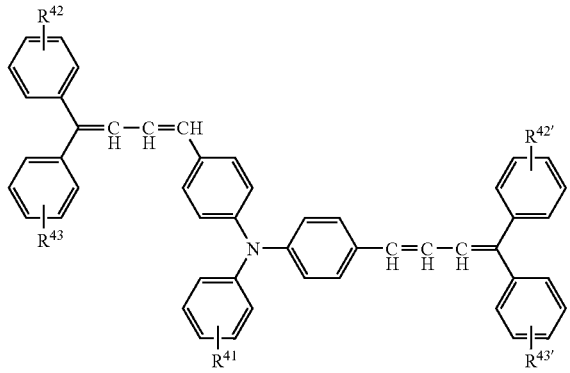

In the above-described formula (a-3), $R^{41}$ represents a hydrogen atom, an alkyl group containing from 1 to 5 carbon atoms, an alkoxy group containing from 1 to 5 carbon atoms, a substituted or unsubstituted aryl group or —CH=CH—CH=C(AR)$_2$, and Ar represents a substituted or unsubstituted aryl group. $R^{42}$, $R^{42'}$, $R^{43}$ and $R^{43'}$ each independently represents a hydrogen atom, a halogen atom, an alkyl group containing from 1 to 5 carbon atoms, an alkoxy group containing from 1 to 5 carbon atoms, an amino group substituted by an alkyl group containing from 1 to 2 carbon atoms, or a substituted or unsubstituted aryl group.

Examples of the binder resin to be used for the charge transporting layer 6 include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin and a styrene-alkyd resin. These binder resins may be used independently or in combination of two or more thereof. The mixing ratio of the charge transporting material to the binder resin (by weight) is preferably from 10:1 to 1:5.

As the high molecular charge transporting material, known ones having a charge transporting ability, such as poly-N-vinylcarbazole or polysilane may be used. In particular, polyester-based high molecular charge transporting material shown in JP-A-8-176293 and JP-A-8-208820 are preferred due to their high charge transporting ability. The high molecular charge transporting materials may be used by themselves as the constituents of the charge generating layer 6, but may be formed into a film by mixing with the above-described binder resin.

The charge transporting layer 6 can be formed by coating a coating solution containing the above-described constituents on the charge generating layer 5, and drying it. Examples of a solvent to be used for the coating solution for forming the charge transporting layer include common organic solvents such as aromatic hydrocarbons (e.g., benzene, toluene, xylene and chlorobenzene), ketones (e.g., acetone and 2-butanone), halogenated aliphatic hydrocarbons (e.g., methylene chloride, chloroform and ethylene chloride) and cyclic or straight-chain ethers (e.g., tetrahydrofuran and ethyl ether). These may be used independently or in combination of two or more thereof. As a method for coating the coating solution for forming the charge transporting layer, there may be employed common methods such as a blade coating method, a wire bar coating method, a spray coating method, a dip coating method, a bead coating method, an air knife coating method and a curtain coating method. Drying after coating is conducted at a temperature at which the solvent is evaporated to form a film. The thickness of the charge transporting layer 6 is generally from 5 to 50 μm, preferably from 10 to 30 μm.

Further, for the purpose of preventing deterioration of the electrophotographic photoreceptor with ozone or an oxidizing gas generated in a copier or by light or heat, an antioxidant, a light stabilizer, a heat stabilizer, etc. may be added to the charge transporting layer 6 constituting the photo-sensitive layer 3. Examples of the antioxidant include hindered phenols, hindered amines, p-phenylenediamines, arylalkanes, hydroquinones, spirochromans, spiroindanones and the derivatives thereof, organic sulfur-containing compounds, and organic phosphorus-containing compounds. Examples of the light stabilizer include derivatives of benzophenone, benzotriazole, dithiocarbamate and tetramethylpiperidine.

Further, at least one electron receptive substance may be incorporated in the photo-sensitive layer 3 for the purpose of improving sensitivity, reducing residual potential and reducing fatigue after repeated use.

Examples of the electron receptive substance include succinic acid anhydride, maleic acid anhydride, dibromomaleic acid anhydride, phthalic acid anhydride, tetrabromophthalic acid anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Of these, fluorenone-based compounds, quinine-based compounds, and benzene derivatives having an electron attractive substituent such as Cl, CN or $NO_2$ are particularly preferred.

The protective layer 7 comprises, as described hereinbefore, a cured product of a curable resin composition containing the alcohol-soluble, curable resin and the polyether-modified silicone.

As the alcohol-soluble, curable resin, thermosetting resins such as a phenol resin, a thermosetting acrylic resin, a thermosetting silicone resin, an epoxy resin, a melamine resin and an urethane resin are preferred, with a phenol resin, a melamine resin, siloxane resin and urethane resin being particularly preferred. Of these curable resins, the phenol resin is preferred in view of mechanical strength, electric properties and deposition-removing properties of the cured product of the curable resin composition.

As the phenol resin, a compound having a phenol structure such as phenol, a substituted phenol having one hydroxyl group (e.g., cresol, xylenol or p-alkylphenol), a substituted phenol having two hydroxyl groups (e.g., catechol, resorcinol or hydroquinone), a bisphenol (e.g., bisphenol A or bisphenol Z) or a biphenol is reacted with formaldehyde or paraformaldehyde in the presence of an acid or alkali catalyst to prepare a monomer such as monomethylolphenol, dimethylolphenol or trimethylolphenol or a mixture thereof, or a oligomerization product thereof, or a mixture of the monomer and the oligomer. Of these, those which have a comparatively large molecular size wherein a structural unit repeats about 2 to about 20 times are the oligomers, and those which have a smaller molecular size are the monomers.

As the acid catalyst to be used in this reaction, sulfuric acid, p-toluenesulfonic acid, phenolsulfonic acid and phosphoric acid are used. Also, as the alkali acid catalyst, hydroxides and oxides of alkali metals and alkaline earth metals, such as NaOH, KOH, $Ca(OH)_2$, $Mg(OH)_2$, $Ba(OH)_2$, CaO and MgO, amine-based catalysts, or acetates such as zinc acetate and sodium acetate are used.

Examples of the amine-based catalyst include ammonia, hexamethylenetetramine, trimethylamine, triethylamine and triethanolamine which, however, are not limitative at all.

In the case where the basic catalyst is used, carrier can be seriously trapped in some cases to seriously deteriorate electrophotographic properties due to the remaining catalyst. In such cases, it is preferred to distill off the remaining catalyst under reduced pressure, neutralize it with an acid, or inactivate or remove it by contacting with an adsorbent such as silicagel or an ion-exchange resin. It is also possible to use a curing catalyst upon curing. The catalyst to be used in the curing is not particularly limited so long as it does not exert detrimental influences on electric properties.

The polyether-modified silicone oil is a hydrophobic dimethylsilicone in which a hydrophilic polyoxyalkylene is introduced therein, and commercially available ones can be used.

Examples of the polyether-modified silicone oil include KF351(A), KF352(A), KF353(A), KF354(A), KF355(A), KF615(A), KF618, KF945(A), KF6004 (these being products of Shin-Etsu Chemical Co., Ltd.), TSF4440, TSF4445, TSF4450, TSF4446, TSF4452, TSF4453 and TSF4460 (these being products of GE Toshiba Silicone K.K.).

The content of the polyether-modified silicone oil based on the total weight of solid components in the protective layer 7 is preferably from 0.01 to 10% by weight, more preferably from 0.1 to 5% by weight. In case where the content of the polyether-modified silicone oil is less than 0.01% by weight, there tends to result an insufficient effect of preventing coating deficiency. Also. in case where the content of the polyether-modified silicone oil exceeds 10% by weight, there tends to result a reduced strength of the resulting cured product and staining of surrounding members due to bleedout of the polyether-modified silicone oil.

The protective layer 7 preferably further contains conductive fine particles or a charge transporting material in addition to the above-described constituents in order to improve electric properties.

Examples of the conductive fine particles include fine particles of metals, metal oxides and carbon black. Examples of the metal fine particles include fine particles of aluminum, zinc, copper, chromium, nickel, silver and stainless steel and fine particles of plastics on the surface of which are vacuum deposited these metals. Examples of the fine particles of metal oxides include fine particles of zinc oxide, titanium oxide, tin oxide, antimony oxide, indium oxide, bismuth oxide, tin-doped indium oxide, antimony- or tantalum-doped tin oxide, and antimony-doped zirconium oxide. These may be used independently or in combination of two or more thereof. In the case of using them in combination of two or more thereof, they may be merely mixed with each other or may be in the form of solid solution or in the fusion bonded form. The average particle size of the conductive particles to be used in the invention is preferably 0.3 μm or less, particularly preferably 0.1 μm or less, in view of transparency of the protective layer. Also, in the invention, use of metal oxide particles is particularly preferred among the above-described conductive particles in view of transparency. In order to control dispersibility, it is preferred to treat the surface of the fine particles. Examples of the surface-treating agent include silane coupling agents, silicone oils, siloxane compounds and surfactants. These agents preferably contain fluorine atoms.

As the charge transporting material, those which are compatible with a curable resin to be used are preferred. Further, those which can form chemical bond with the curable resin to be used are more preferred.

As a charge transporting substance having a reactive functional group, compounds represented by the following general formulae (I), (II), (III), (IV) and (V) are preferred due to their excellent film-forming properties, mechanical strength and stability.

$$F—[(X^1)_{n1}R^1\text{-}Z^1H]_{m1} \quad (I)$$

In the formula (I), F represents an organic group derived from a compound having a positive hole-transporting ability, $R^1$ represents an alkylene group, $Z^1$ represents an oxygen atom, a sulfur atom, NH or COO, $X^1$ represents an oxygen atom or a sulfur atom, m1 represents an integer of from 1 to 4, and n1 represents 0 or 1.

$$F—[(X^2)_{n2}—(R^2)_{n3}\text{-}(Z^2)_{n4}G]_{n5} \quad (II)$$

In the formula (II), F represents an organic group derived from a compound having a positive hole-transporting ability, $X^2$ represents an oxygen atom or a sulfur atom, $R^2$ represents an alkylene group, $Z^2$ represents an oxygen atom, a sulfur atom, NH or COO, G represents an epoxy group, n2, n3 and n4 each independently represents 0 or 1, and n5 represents an integer of from 1 to 4.

$$F[\text{-}D\text{-}Si(R^3)_{(3-a)}Q_a]_b \quad (III)$$

In the formula (III), F represents a b-valent organic group derived from a compound having a positive hole-transporting ability, D represents a flexible 2-valent group, $R^3$ represents a hydrogen atom, a substituted or unsubstituted alkyl group or a substituted or unsubstituted aryl group, Q represents a hydrolysable group, a represents an integer of from 1 to 3, and b represents an integer of from 1 to 4.

(IV)

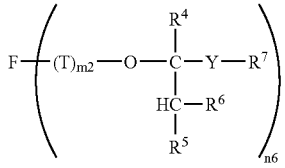

In the formula (IV), F represents an organic group derived from a compound having a positive hole-transporting ability, T represents a 2-valent group, Y represents an oxygen atom or a sulfur atom, $R^4$, $R^5$ and $R^6$ each independently represents a hydrogen atom or a monovalent organic group, $R^7$ represents a monovalent organic group, m2 represents 0 or 1, and n6 represents an integer of from 1 to 4, provided that $R^6$ and $R^7$ may be connected to each other to form a hetero ring wherein Y is a hetero atom.

(V)

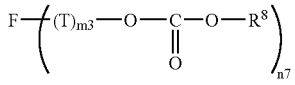

In the formula (V), F represents an organic group derived from a compound having a positive hole-transporting ability, T represents a 2-valent group, $R^8$ represents a monovalent organic group, m3 represents 0 or 1, and n7 represents an integer of from 1 to 4.

F in the above general formulae (I) to (V) is preferably a group represented by the following general formula (VI).

(VI)

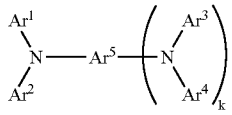

In the formula (VI), $Ar^1$, $Ar^2$, $Ar^3$ and $Ar^4$ each independently represents a substituted or unsubstituted aryl group, $Ar^5$ represents a substituted or unsubstituted aryl group or arylene group, with 1 to 4 of $Ar^1$ to $Ar^5$ having a connecting bond to the moiety represented by the following formula (VII) in the compound represented by the general formula (I), the moiety represented by the following formula (VIII) in the compound represented by the general formula (II), the moiety represented by the following formula (IX) in the compound represented by the general formula (III), the moiety represented by the following formula (X) in the compound represented by the general formula (IV) or to the moiety represented by the general formula (XI) in the compound represented by the general formula (V):

(VII)

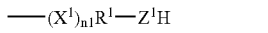

(VIII)

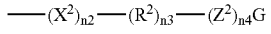

(IX)

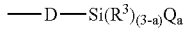

(X)

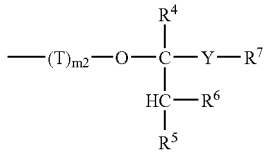

(XI)

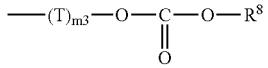

As the unsubstituted or substituted aryl group represented by $Ar^1$ to $Ar^4$ in the above formula (VI), those aryl groups represented by the following general formulae (1) to (7) are specifically preferred.

TABLE 1

(1)

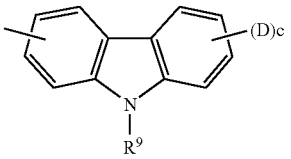

TABLE 1-continued (2)

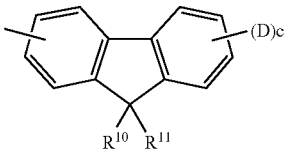

(3)

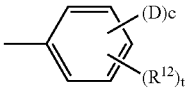

(4)

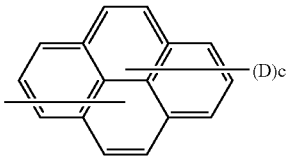

(5)

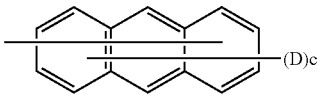

(6)

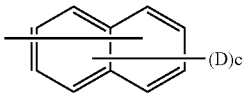

—Ar—(Z')s—Ar—(D)c (7)

In the above formulae (1) to (7), $R^9$ represents a hydrogen atom, an alkyl group containing from 1 to 4 carbon atoms, an alkoxy group containing from 1 to 4 carbon atoms, a phenyl group substituted by these groups, an unsubstituted phenyl group or an aralkyl group containing from 7 to 10 carbon atoms, $R^{10}$ to $R^{12}$ each represents a hydrogen atom, an alkyl group containing from 1 to 4 carbon atoms, an alkoxy group containing from 1 to 4 carbon atoms, a phenyl group substituted by these groups, an unsubstituted phenyl group, an aralkyl group containing from 7 to 10 carbon atoms or a halogen atom, Ar represents a substituted or unsubstituted arylene group, D represents one of the structures represented by the above-described formulae (VII) to (XI), c and s each represents 0 or 1, and t represents an integer of 1 to 3.

As Ar in the aryl group represented by the above-described formula (7), an arylene group represented by the following formula (8) or (9) is preferred.

TABLE 2

(8)

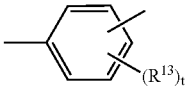

(9)

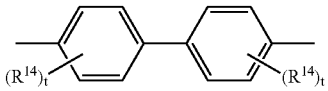

In the formulae (8) and (9), $R^{13}$ and $R^{14}$ each represents a hydrogen atom, an alkyl group containing from 1 to 4 carbon atoms, an alkoxy group containing from 1 to 4 carbon atoms, a phenyl group substituted by an alkoxy group containing from 1 to 4 carbon atoms, an unsubstituted phenyl group, an aralkyl group containing from 7 to 10 carbon atoms, or a halogen atom, and t represents an integer of 1 to 3.

As Z' in the aryl group shown by the formula (7), those divalent groups are preferred which are shown by the following formulae (10) to (17).

TABLE 3

| | |
|---|---|
| $—(CH_2)_q—$ | (10) |
| $—(CH_2CH_2O)_r—$ | (11) |
| 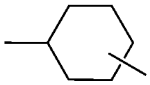 | (12) |
| 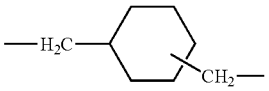 | (13) |
| 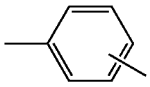 | (14) |
| 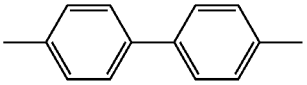 | (15) |
| 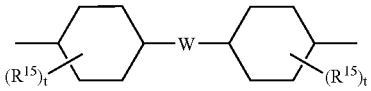 | (16) |
| 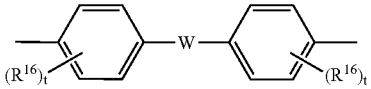 | (17) |

In the formulae (10) to (17), $R^{15}$ and $R^{16}$ each represents a hydrogen atom, an alkyl group containing from 1 to 4 carbon atoms, an alkoxy group containing from 1 to 4 carbon atoms, a phenyl group substituted by an alkoxy group containing from 1 to 4 carbon atoms, an unsubstituted phenyl group, an aralkyl group containing from 7 to 10 carbon atoms, or a halogen atom, W represents a divalent group, q and r each represents an integer of 1 to 10, and each t represents an integer of 1 to 3.

In the above formulae (16) and (17), W represents a divalent group shown by the following formulae (18) to (26). Additionally, in the formula (25), u represents an integer of 0 to 3.

TABLE 4

| | |
|---|---|
| $—CH_2—$ | (18) |
| $—C(CH_3)_2—$ | (19) |
| —O— | (20) |
| —S— | (21) |
| $—C(CF_3)_2—$ | (22) |
| $—Si(CH_3)_2—$ | (23) |
| 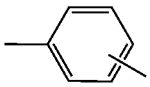 | (24) |
| 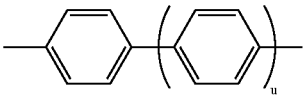 | (25) |

TABLE 4-continued

| | |
|---|---|
| 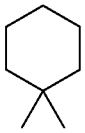 | (26) |

As a specific structure of $Ar^5$ in the general formula (VI), there can be illustrated a structure wherein c in the specific structure of $Ar^1$ to $Ar^4$ is 1 when k=0, and a structure wherein c in the specific structure of $Ar^1$ to $Ar^4$ is 0.

Also, more specific examples of the compound represented by the general formula (I) include the following compounds represented by (I-1) to (I-37). Additionally, in the following Table, the connecting bond with no substituent represents a methyl group.

TABLE 5

| | |
|---|---|
| I-1 | 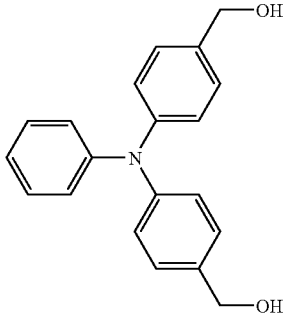 |
| I-2 | 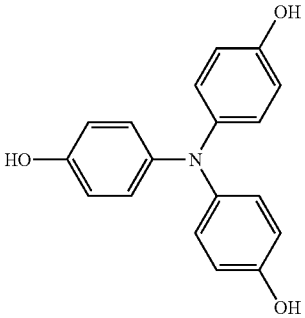 |
| I-3 | 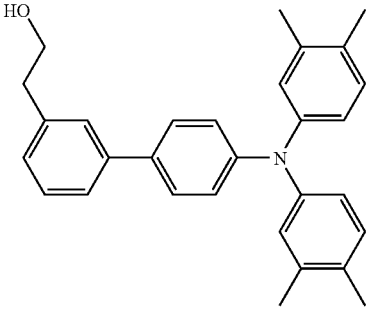 |

TABLE 5-continued
I-4
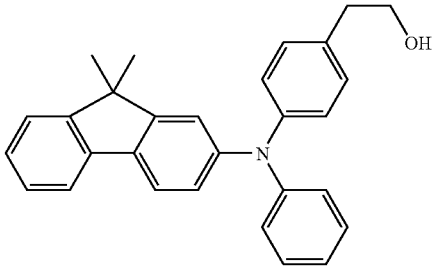
I-5
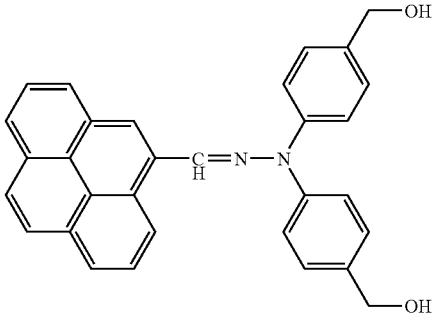
TABLE 6
I-6
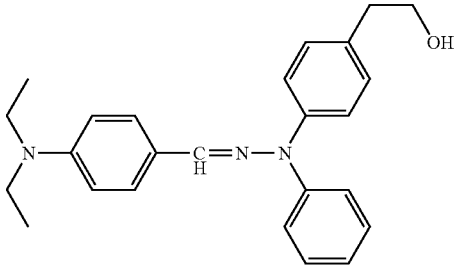
I-7
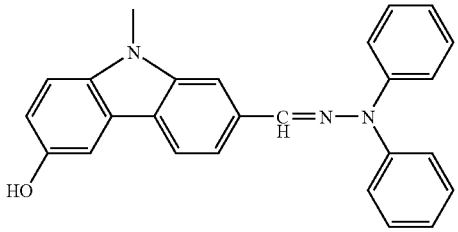
I-8
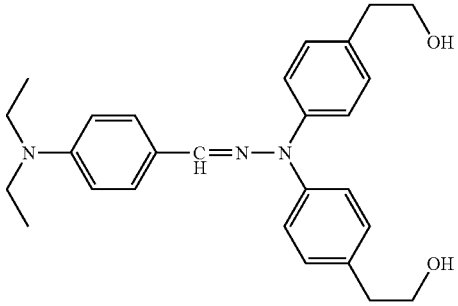
TABLE 6-continued
I-9
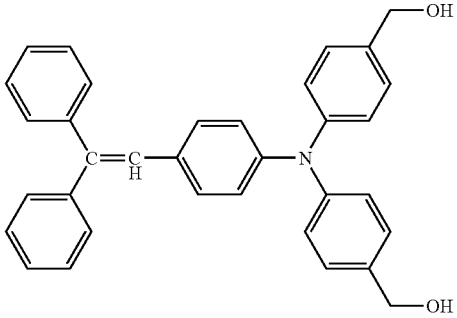
I-10
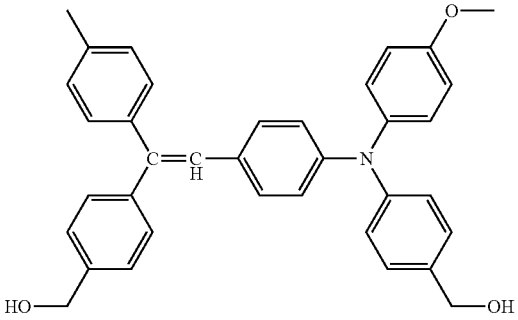
TABLE 7
I-11
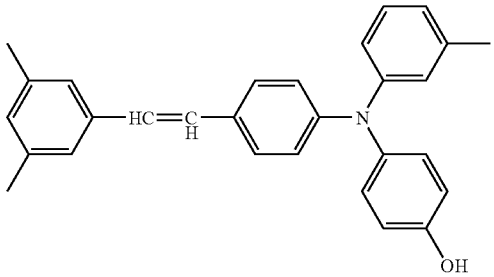
I-12
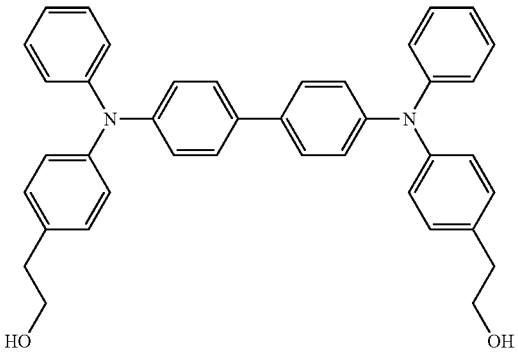

TABLE 7-continued
I-13
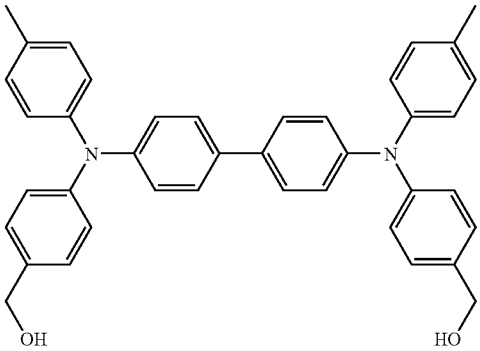
I-14
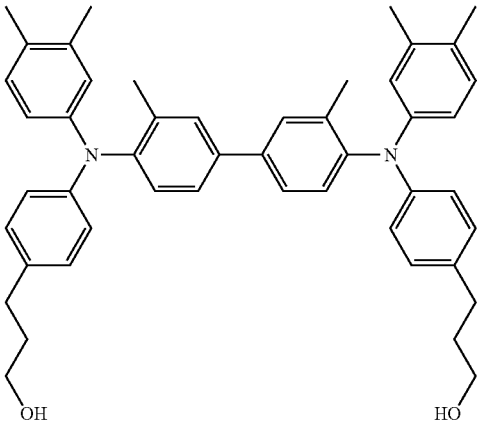
TABLE 8
I-15
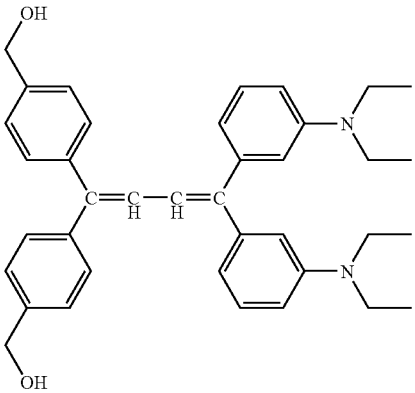
I-16
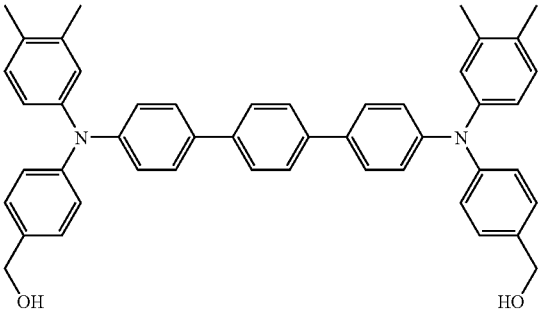
TABLE 8-continued
I-17
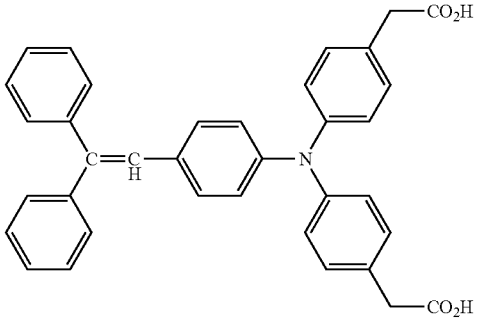
I-18
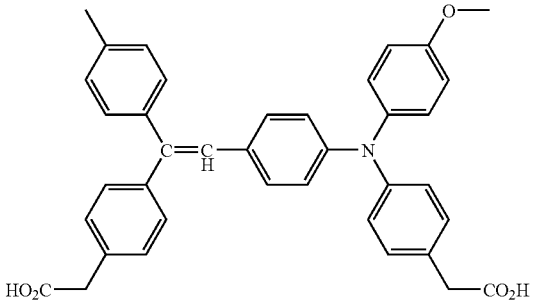
TABLE 9
I-19
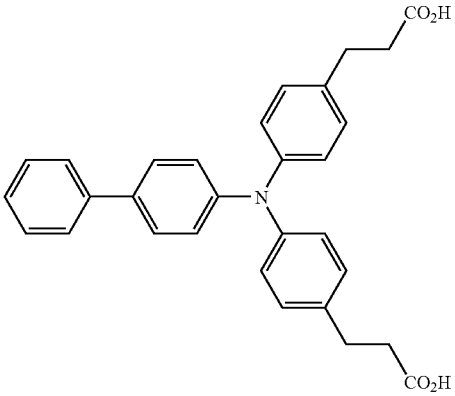
I-20
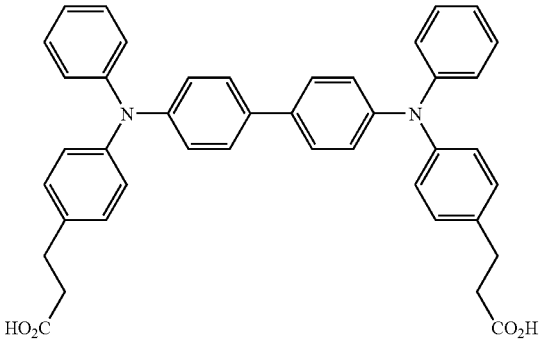

TABLE 9-continued
I-21
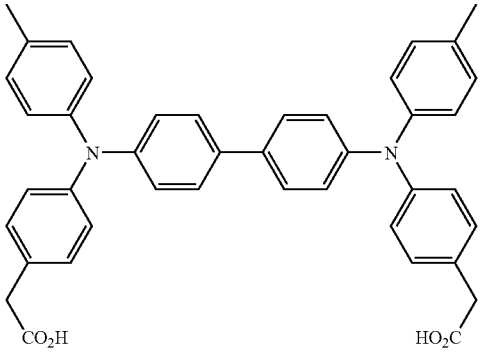
I-22
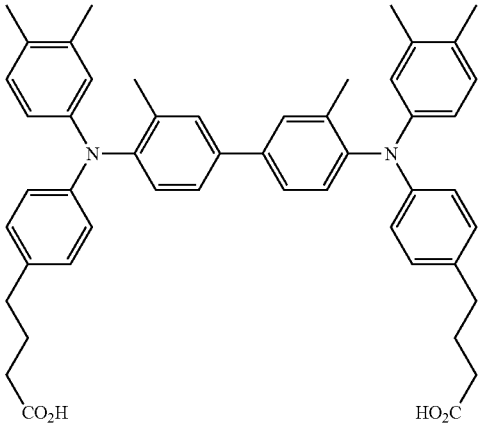
TABLE 10
I-23
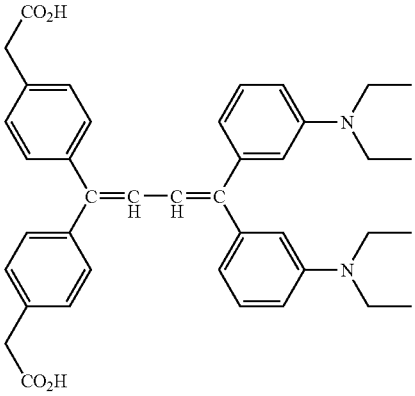
I-24
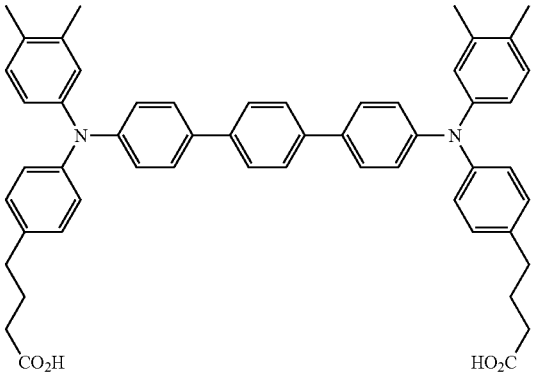
TABLE 10-continued
I-25
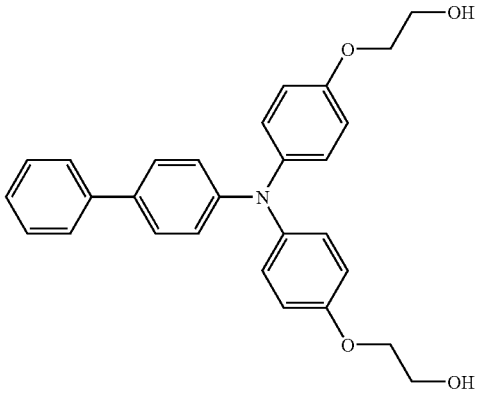
I-26
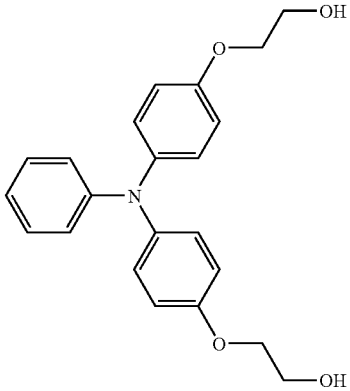
TABLE 11
I-27
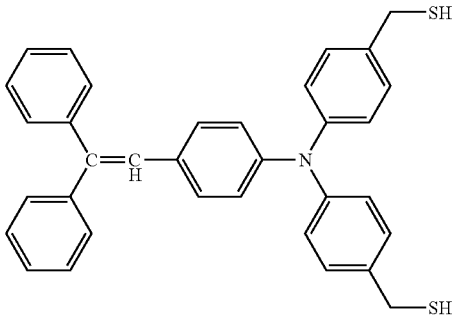
I-28
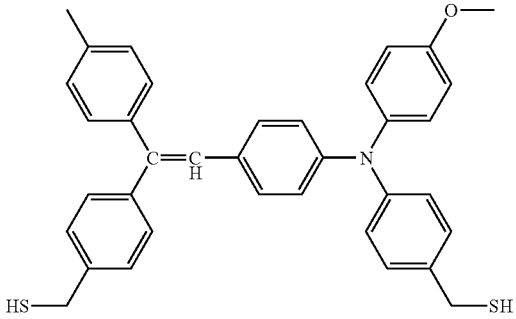

TABLE 11-continued
I-29
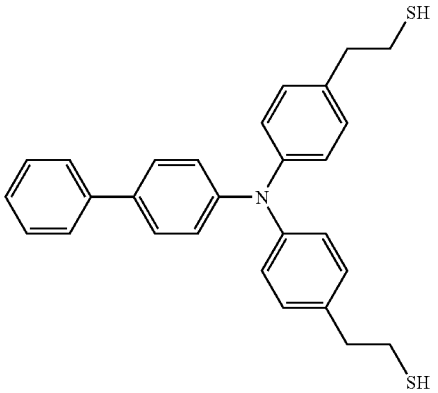
TABLE 12
I-30
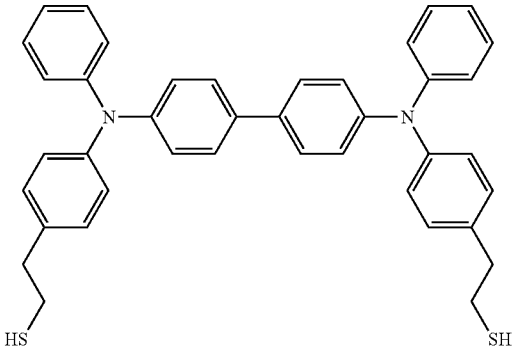
I-31
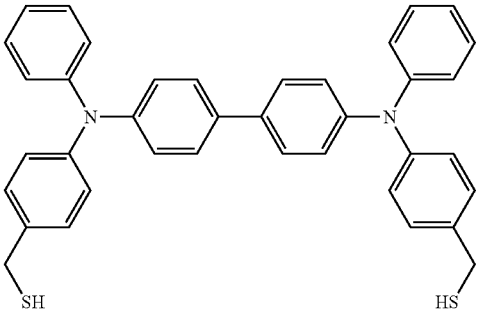
I-32
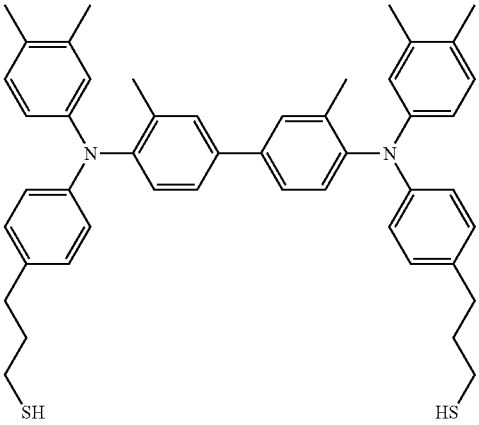
TABLE 12-continued
I-33
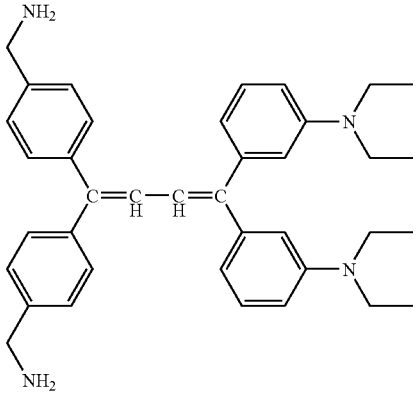
TABLE 13
I-34
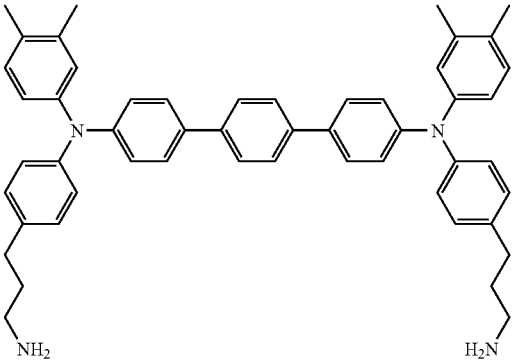
I-35
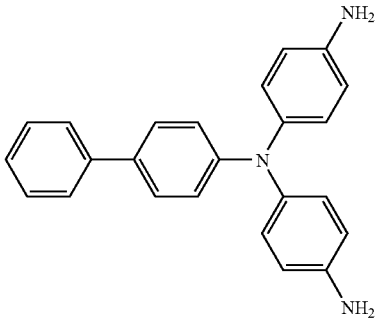
I-36
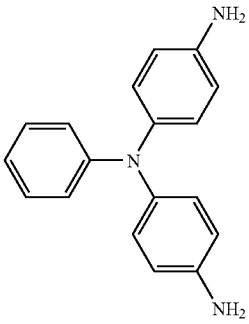

TABLE 13-continued
| | |
|---|---|
| I-37 | 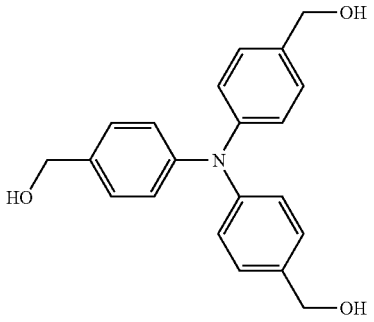 |
Also, more specific examples of the compound represented by the general formula (II) include the following compounds represented by (II-1) to (II-47). Additionally, in the following Table, Me or the connecting bond with no substituent represents a methyl group, and Et represents an ethyl group.
TABLE 14
| | |
|---|---|
| II-1 | 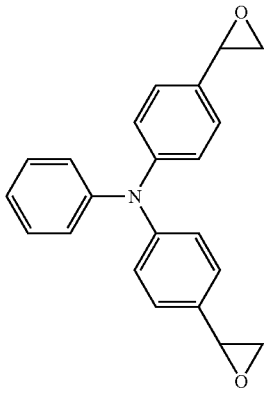 |
| II-2 | 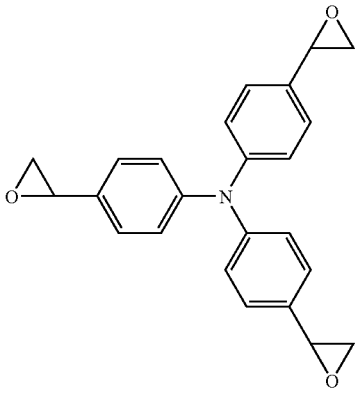 |
TABLE 14-continued
| | |
|---|---|
| II-3 | 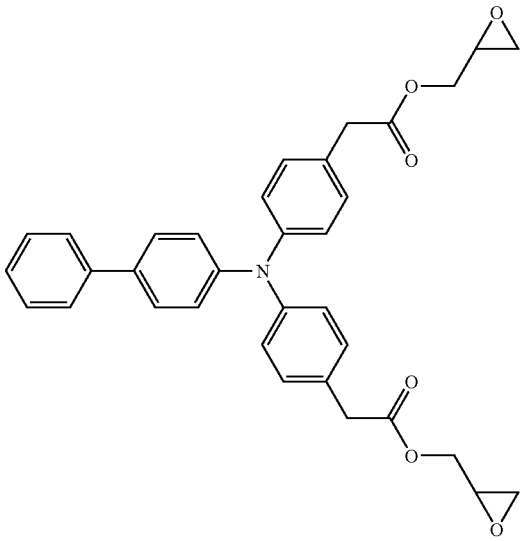 |
| II-4 | 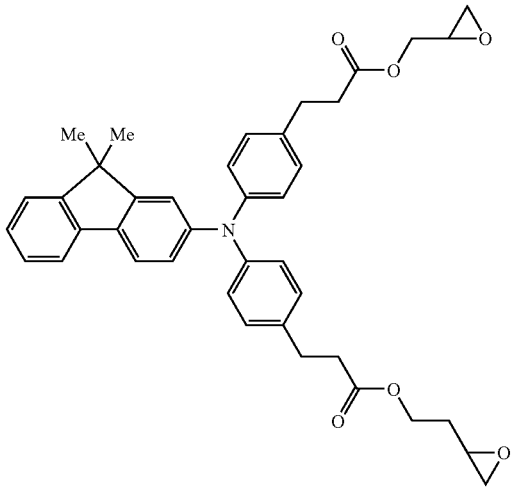 |
TABLE 15
| | |
|---|---|
| II-5 | 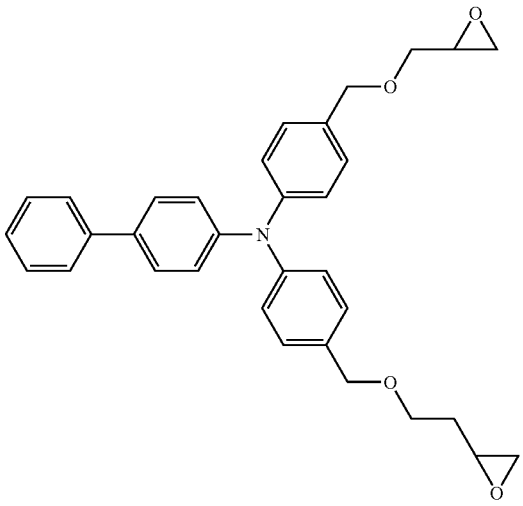 |

TABLE 15-continued
II-6
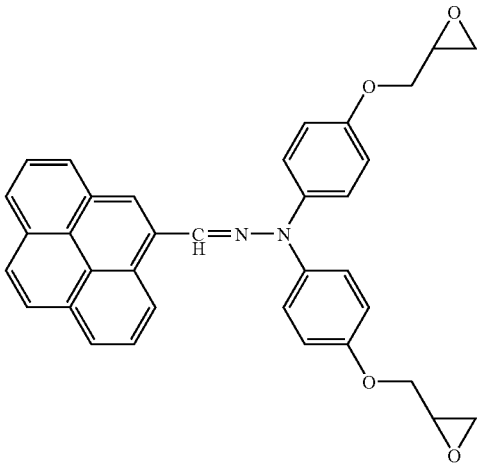
II-7
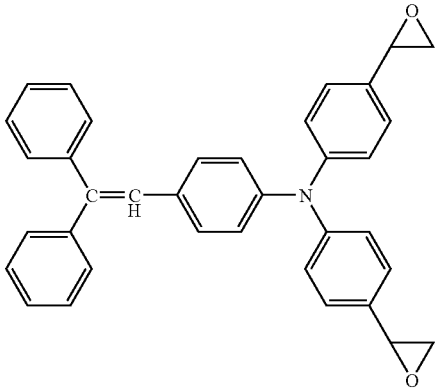
II-8
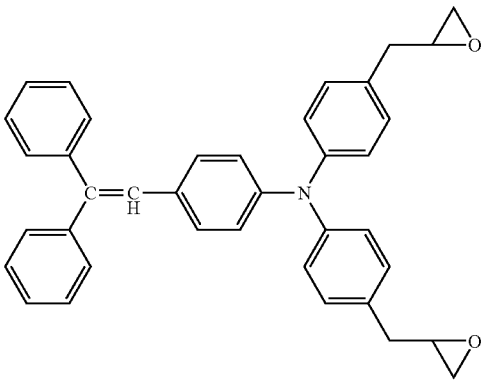
TABLE 16
II-9
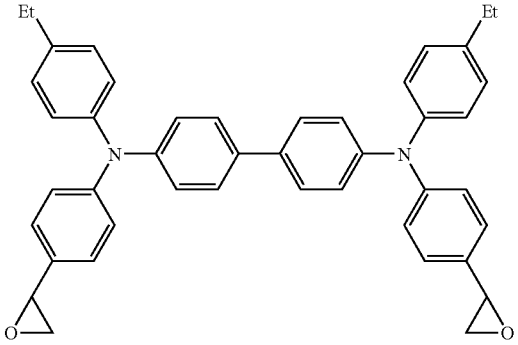
II-10
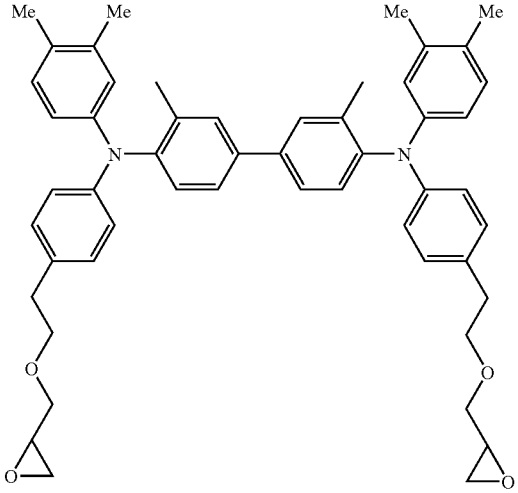
II-11
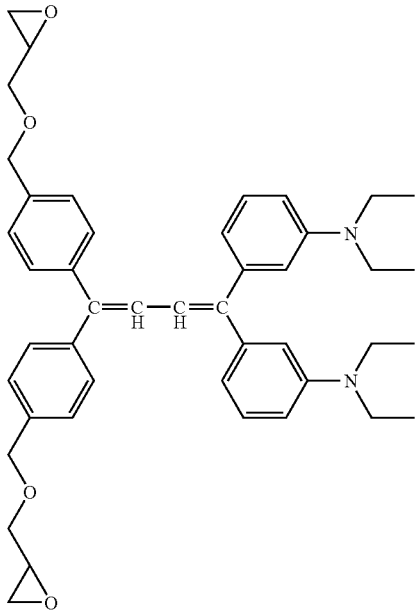

TABLE 17
II-12
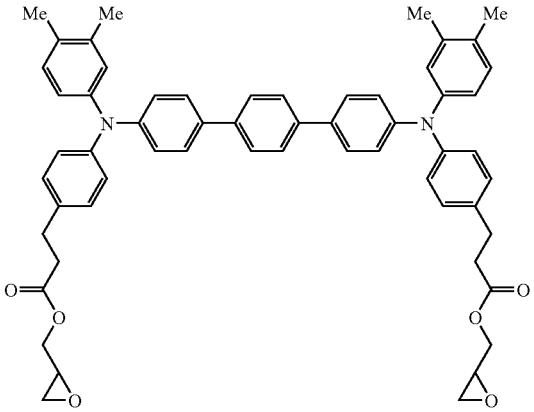
II-13
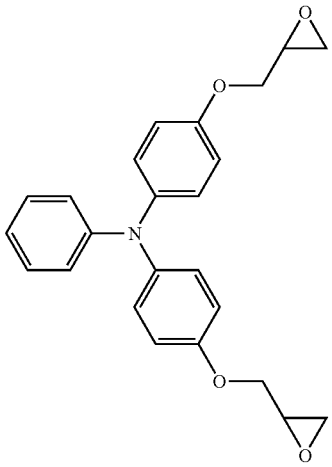
II-14
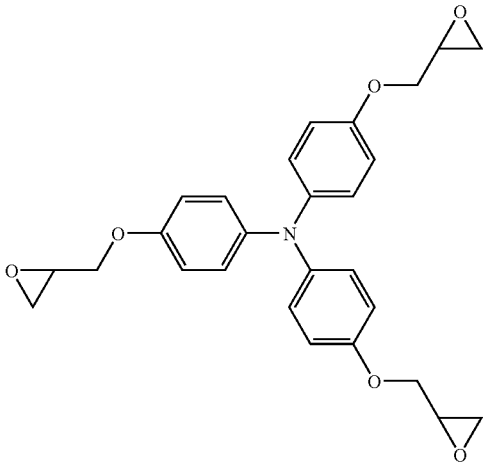
TABLE 18
II-15
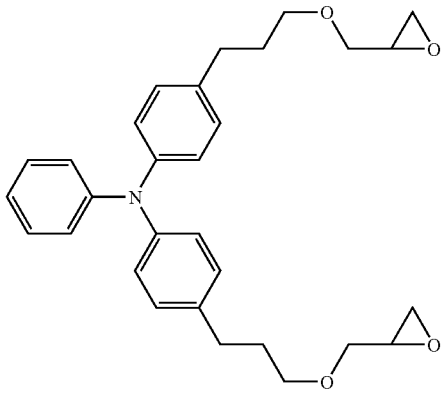
II-16
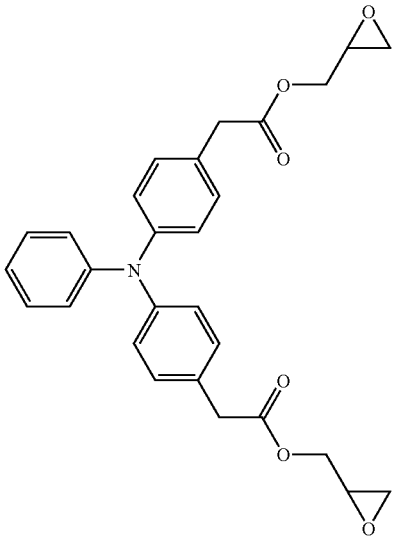
II-17
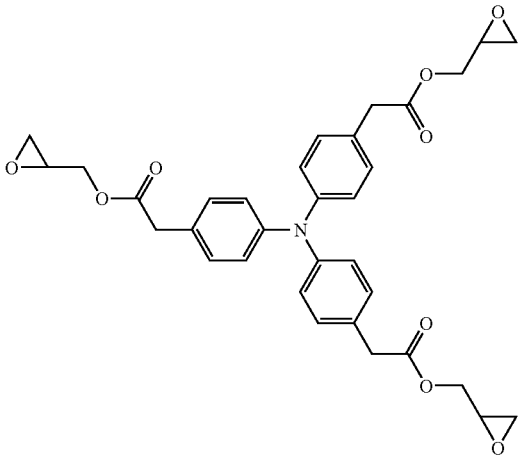

TABLE 19
II-18
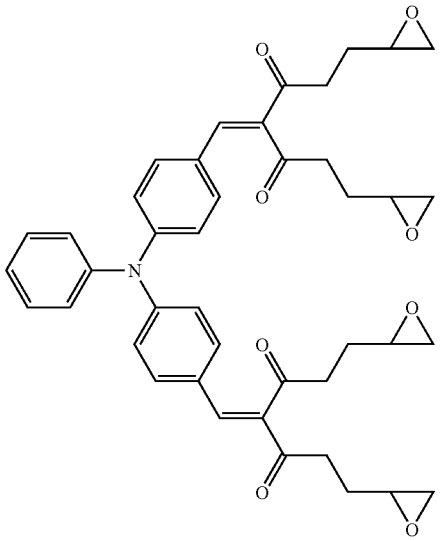
II-19
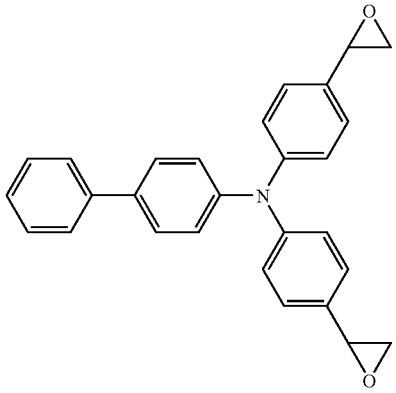
II-20
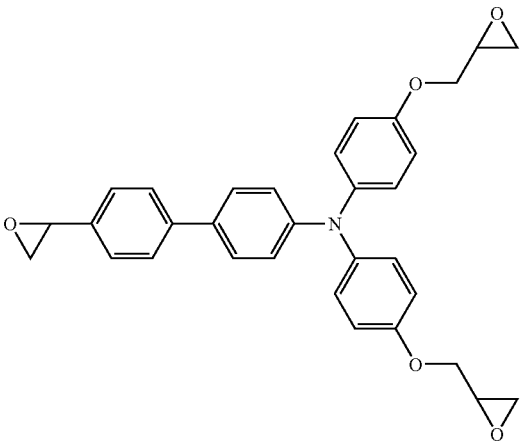
TABLE 19-continued
II-21
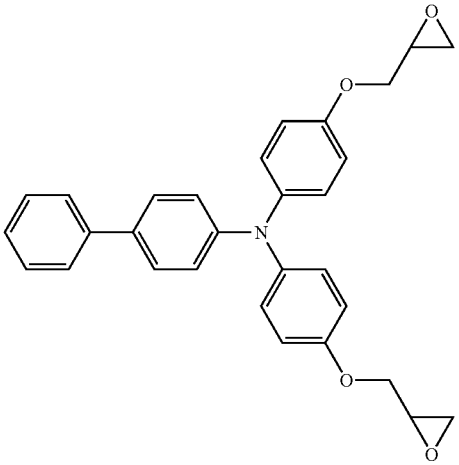
TABLE 20
II-22
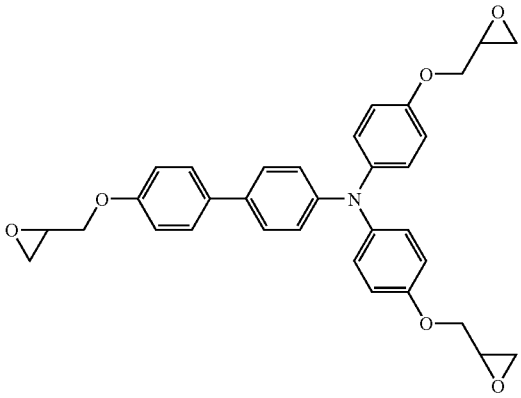
II-23
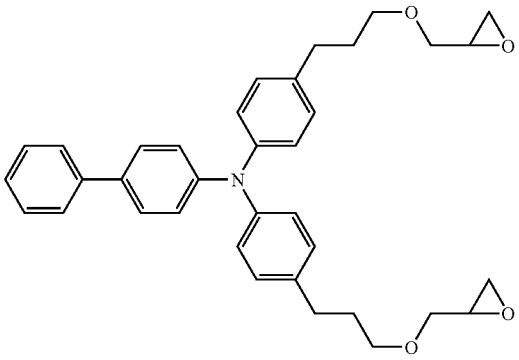

TABLE 20-continued
II-24
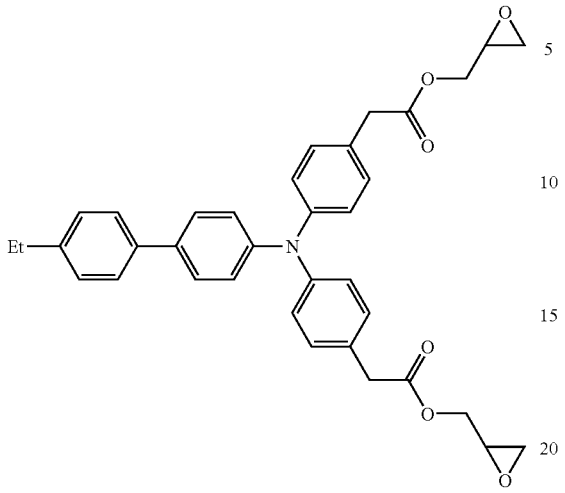
TABLE 21
II-25
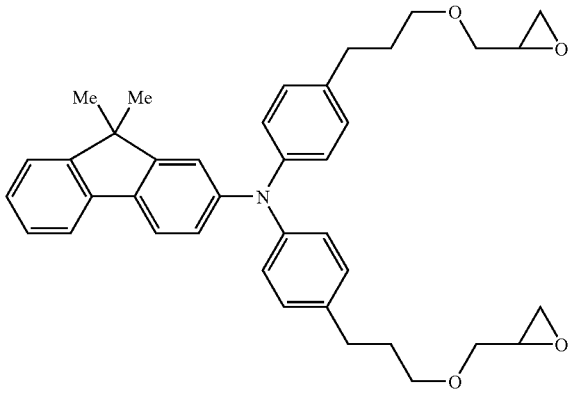
II-26
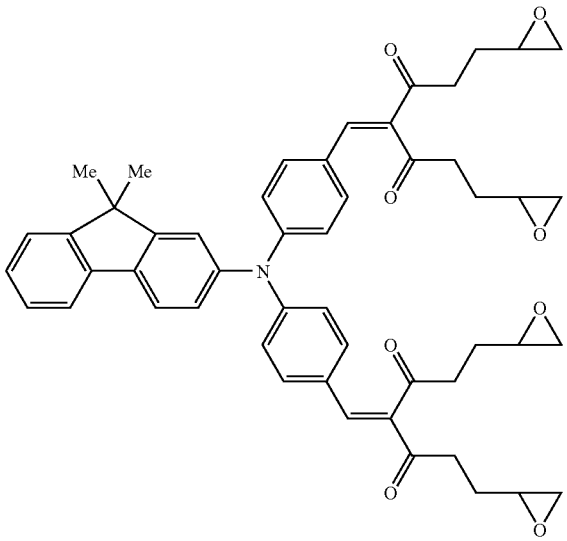

TABLE 21-continued
| | |
|---|---|
| II-27 | 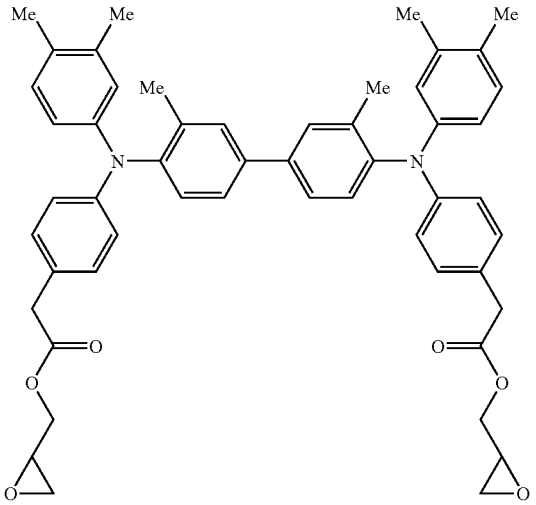 |
TABLE 22
| | |
|---|---|
| II-28 | 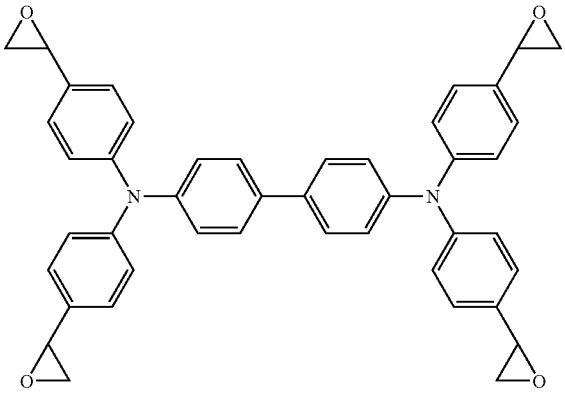 |
| II-29 | 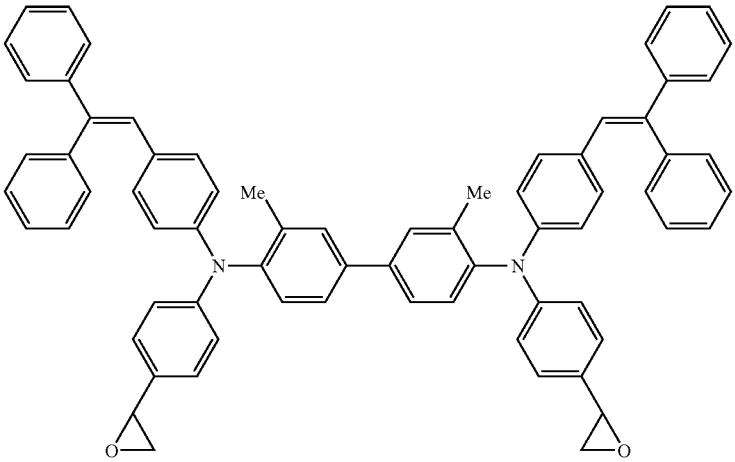 |

TABLE 22-continued
| | |
|---|---|
| II-30 | 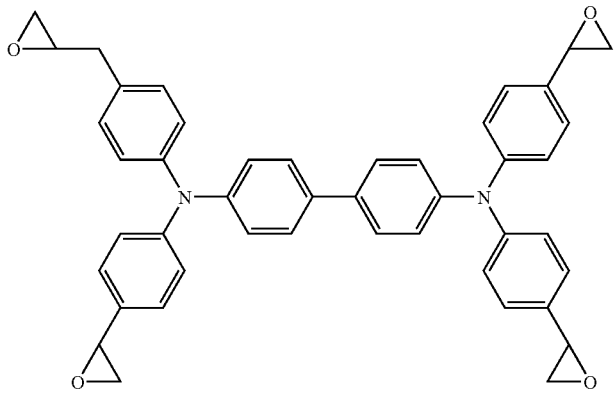 |
| II-31 | 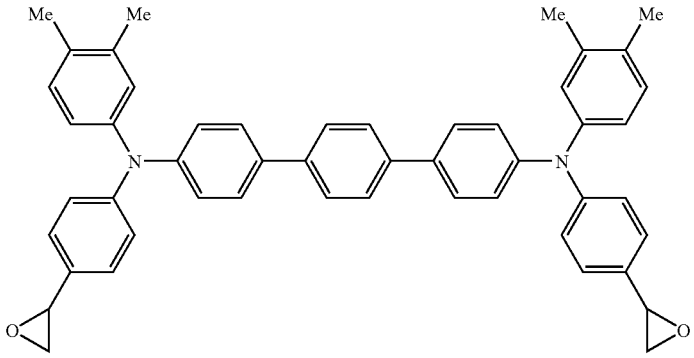 |
TABLE 23
| | |
|---|---|
| II-32 | 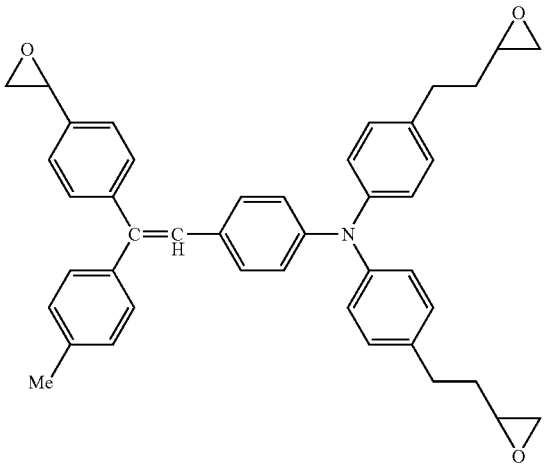 |

TABLE 23-continued
II-33
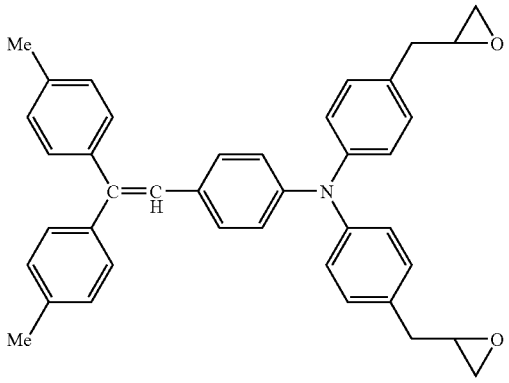
II-34
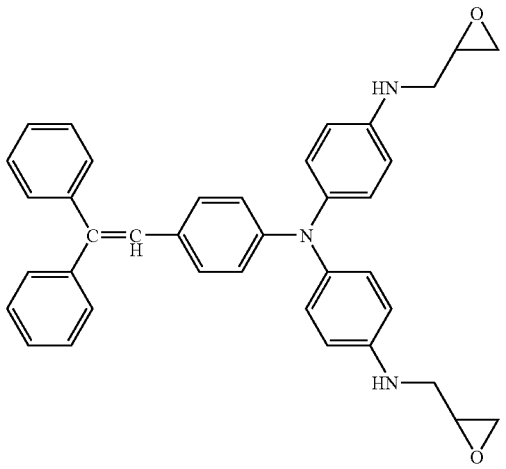
II-35
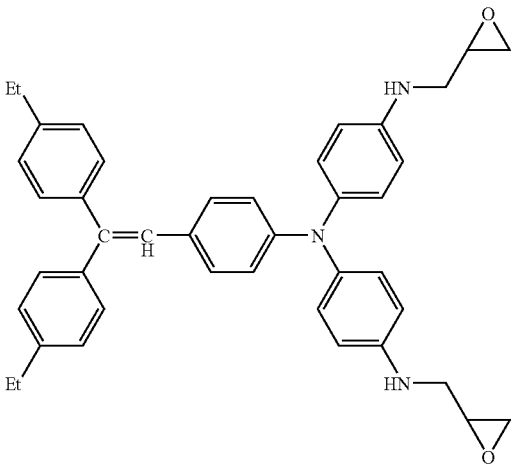

TABLE 24
II-36
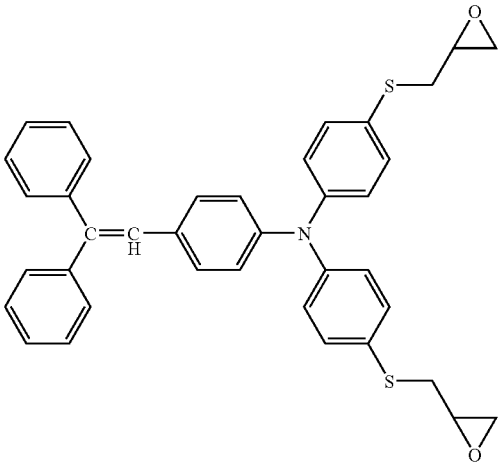
II-37
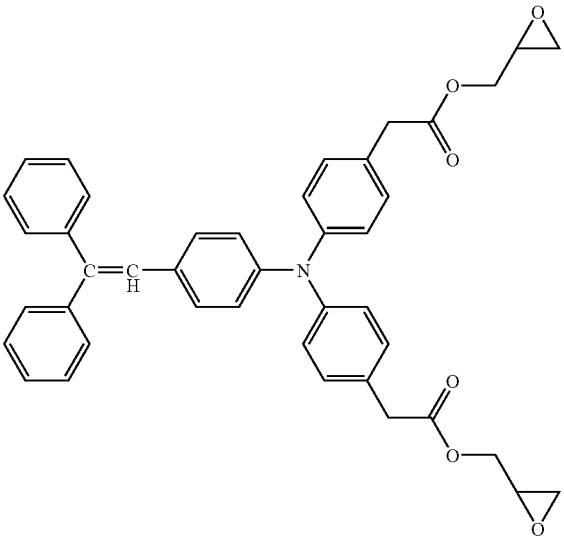
II-38
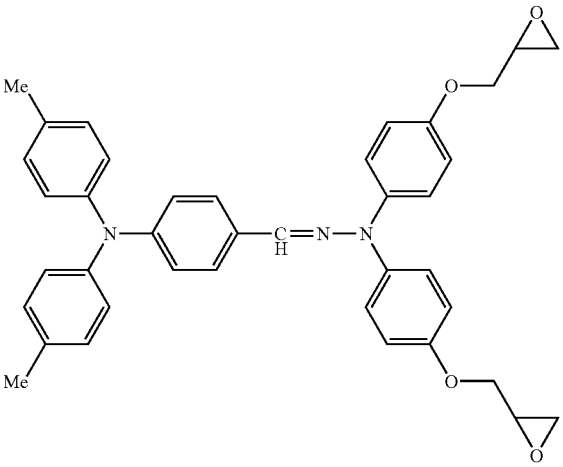

TABLE 25
II-39
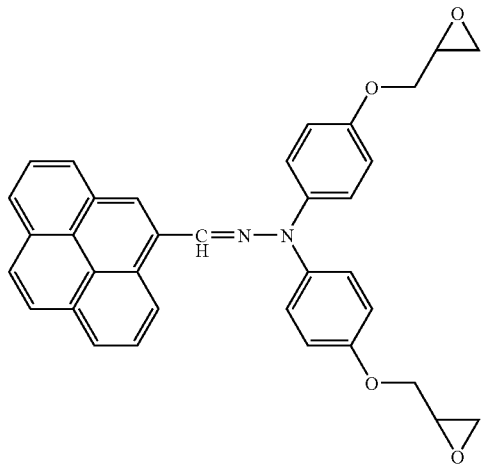
II-40
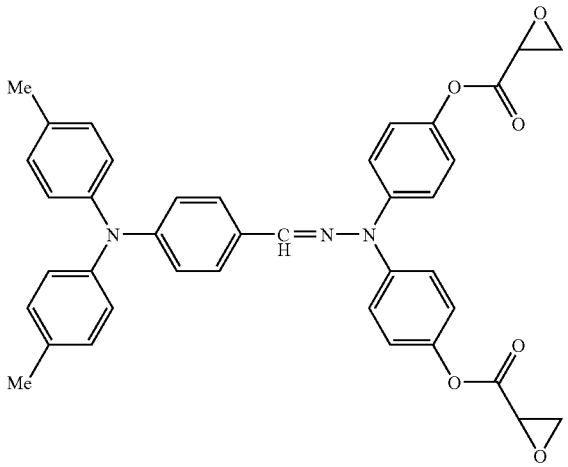
II-41
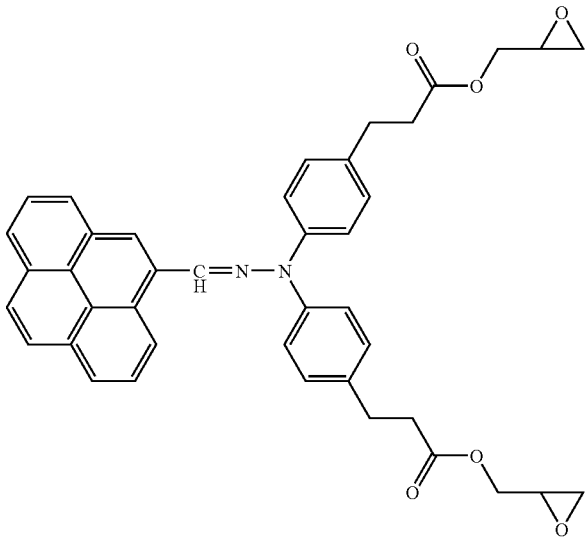

TABLE 26
| | |
|---|---|
| II-42 | 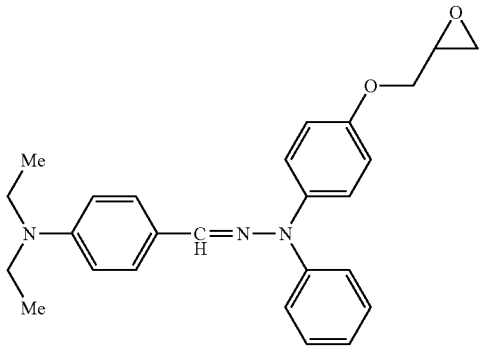 |
| II-43 | 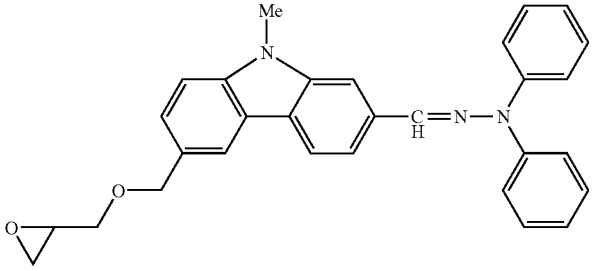 |
| II-44 | 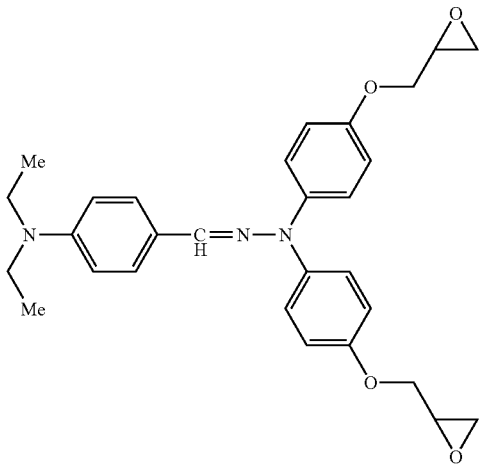 |
TABLE 27
| | |
|---|---|
| II-45 | 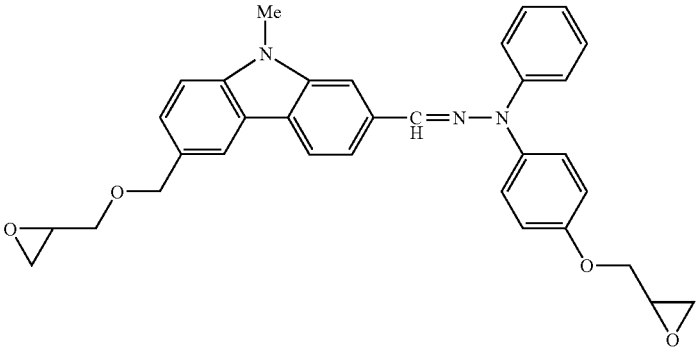 |

TABLE 27-continued

| | |
|---|---|
| II-46 | 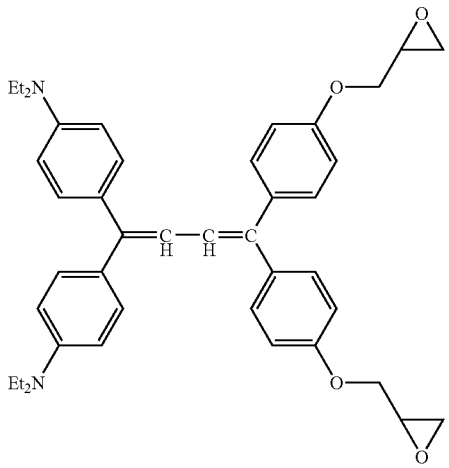 |
| II-47 | 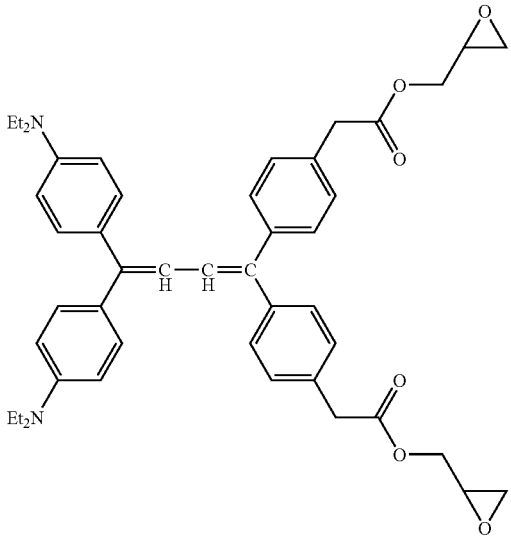 |

Also, more specific examples of the compound represented by the general formula (III) include the following compounds represented by (III-1) to (III-61). Additionally, the following compounds (III-1) to (III-61) are those wherein $Ar^1$ to $Ar^5$ and k of the compound represented by the general formula (VI) are combined as shown in the following table and the alkoxysilyl group (s) is specified as shown in the following table.

TABLE 28

| No. | $Ar^1$ | $Ar^2$ | $Ar^3$ | $Ar^4$ |
|---|---|---|---|---|
| III-1 | 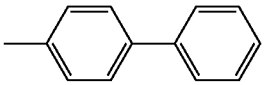 | 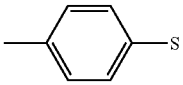 | — | — |
| III-2 | 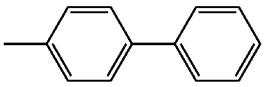 | 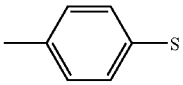 | — | — |
| III-3 | 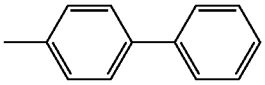 | 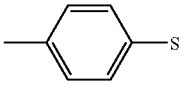 | — | — |

TABLE 28-continued
| | | | | |
|---|---|---|---|---|
| III-4 | 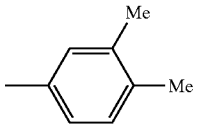 | 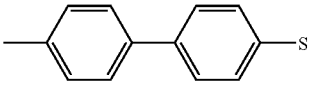 | — | — |
| III-5 | 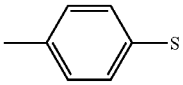 | 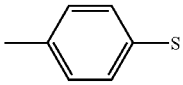 | — | — |
| III-6 | 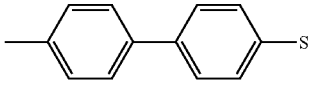 | 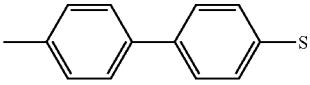 | — | — |
| III-7 | 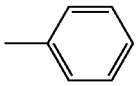 | 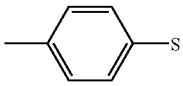 | 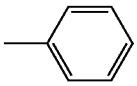 | 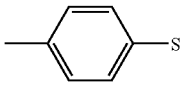 |
| No. | $Ar^5$ | k | S |
|---|---|---|---|
| III-1 | 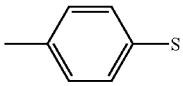 | 0 | —(CH2)2—COO—(CH2)3—Si(OiPr)3 |
| III-2 | 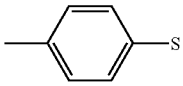 | 0 | —(CH2)2—COO—(CH2)3—Si(OiPr)2Me |
| III-3 | 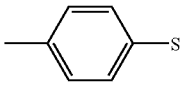 | 0 | —(CH2)2—COO—(CH2)3—Si(OiPr)Me2 |
| III-4 | 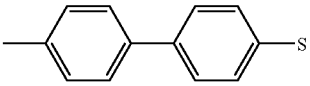 | 0 | —COO—(CH2)3—Si(OiPr)3 |
| III-5 | 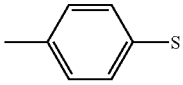 | 0 | —(CH2)2—COO—(CH2)3—Si(OiPr)3 |
| III-6 | 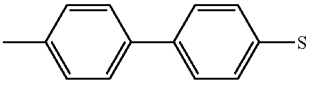 | 0 | —COO—(CH2)3—Si(OiPr)3 |
| III-7 | 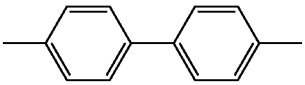 | 1 | —(CH2)4—Si(OEt)3 |

TABLE 29
| No. | $Ar^1$ | $Ar^2$ | $Ar^3$ | $Ar^4$ | $Ar^5$ | k | S |
|---|---|---|---|---|---|---|---|
| III-8 | 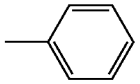 | 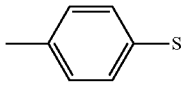 | 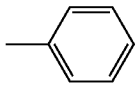 | 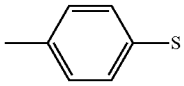 | 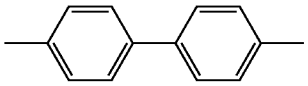 | 1 | —(CH2)4—Si(OiPr)3 |
| III-9 | 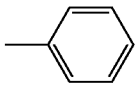 | 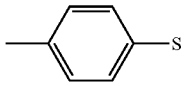 | 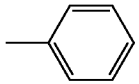 | 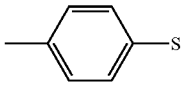 | 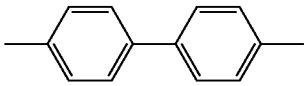 | 1 | —CH═CH—(CH2)2—Si(OiPr)3 |
| III-10 | 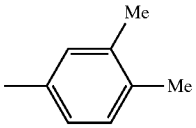 | 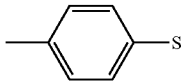 | 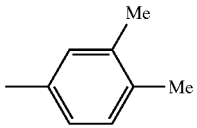 | 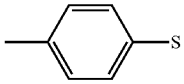 | 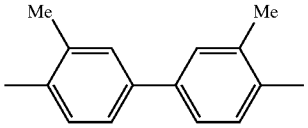 | 1 | —(CH2)4—Si(OMe)3 |
| III-11 | 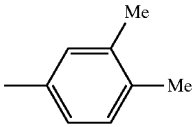 | 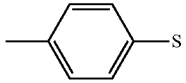 | 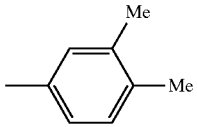 | 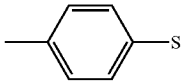 | 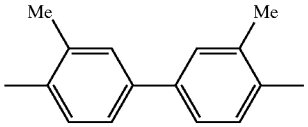 | 1 | —(CH2)4—Si(OiPr)3 |
| III-12 | 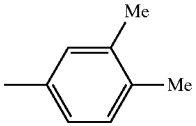 | 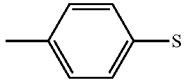 | 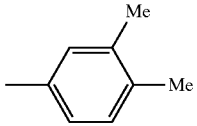 | 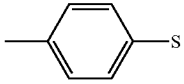 | 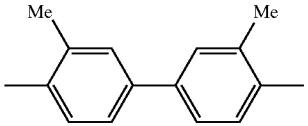 | 1 | —CH═CH—(CH2)2—Si(OiPr)3 |
| III-13 | 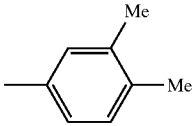 | 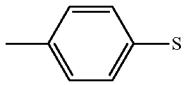 | 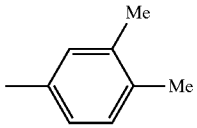 | 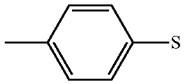 | 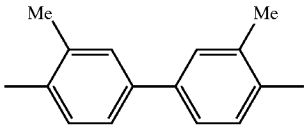 | 1 | —CH═N—(CH2)3—Si(OiPr)3 |
| III-14 | 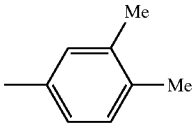 | 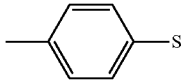 | 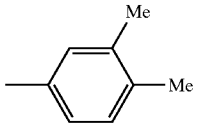 | 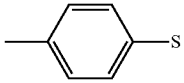 | 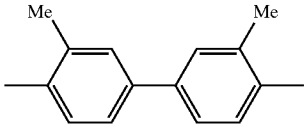 | 1 | —O—(CH2)3—Si(OiPr)3 |

TABLE 30
| No. | $Ar^1$ | $Ar^2$ | $Ar^3$ | $Ar^4$ | $Ar^5$ | k | S |
|---|---|---|---|---|---|---|---|
| III-15 | 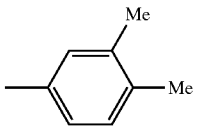 | 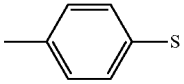 | 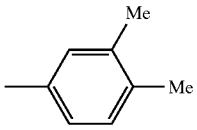 | 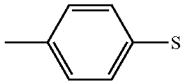 | 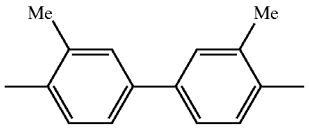 | 1 | —COO—(CH2)3—Si(OiPr)3 |
| III-16 | 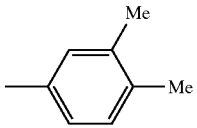 | 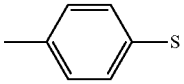 | 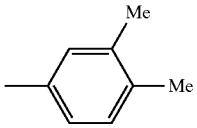 | 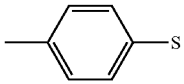 | 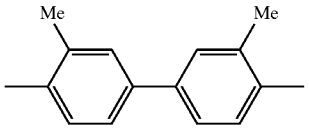 | 1 | —(CH2)2—COO—(CH2)3—Si(OiPr)3 |
| III-17 | 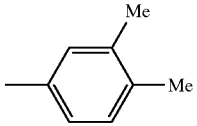 | 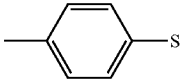 | 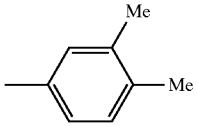 | 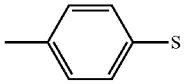 | 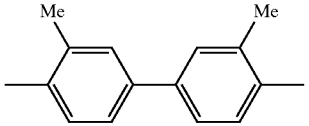 | 1 | —(CH2)2—COO—(CH2)3—Si(OiPr)2Me |
| III-18 | 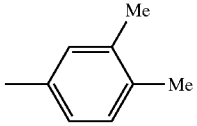 | 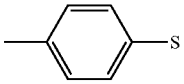 | 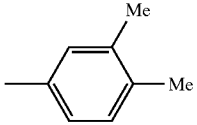 | 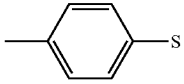 | 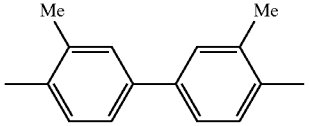 | 1 | —(CH2)2—COO—(CH2)3—Si(OiPr)Me2 |
| III-19 | 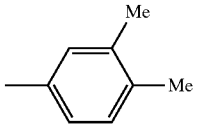 | 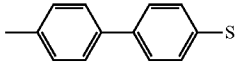 | 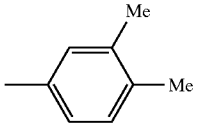 | 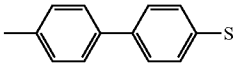 | 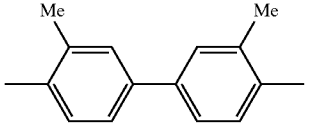 | 1 | —COO—(CH2)3—Si(OiPr)3 |
| III-20 | 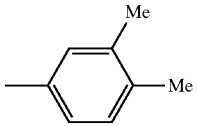 | 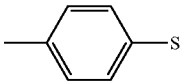 | 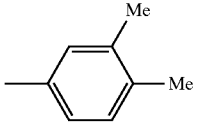 | 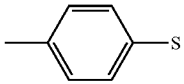 | 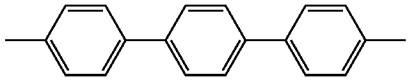 | 1 | —(CH2)4—Si(OiPr)3 |

TABLE 31
| No. | $Ar^1$ | $Ar^2$ | $Ar^3$ | $Ar^4$ | $Ar^5$ | k | S |
|---|---|---|---|---|---|---|---|
| III-21 | 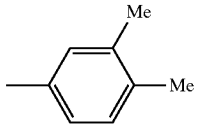 | 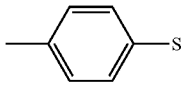 | 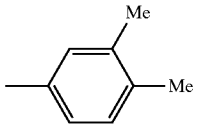 | 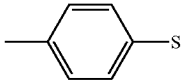 | 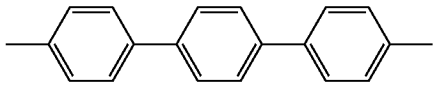 | 1 | —CH═CH—(CH2)2—Si(OiPr)3 |
| III-22 | 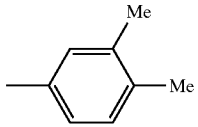 | 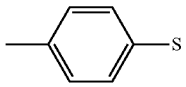 | 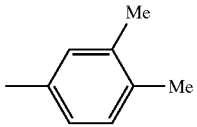 | 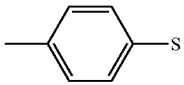 | 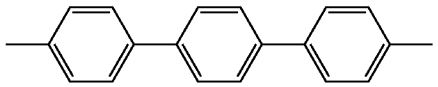 | 1 | —(CH2)2—COO—(CH2)3—Si(OiPr)3 |
| III-23 | 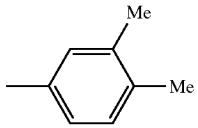 | 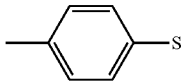 | 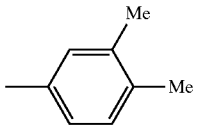 | 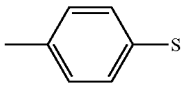 | 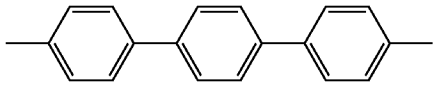 | 1 | —(CH2)2—COO—(CH2)3—Si(OiPr)2Me |
| III-24 | 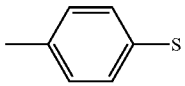 | 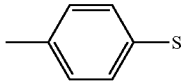 | 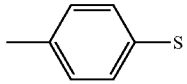 | 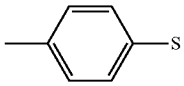 | 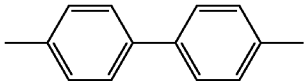 | 1 | —COO—(CH2)3—Si(OiPr)3 |
| III-25 | 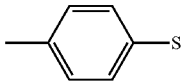 | 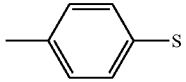 | 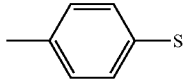 | 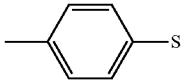 | 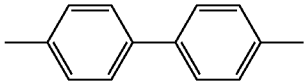 | 1 | —(CH2)2—COO—(CH2)3—Si(OiPr)3 |
| III-26 | 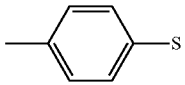 | 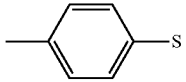 | 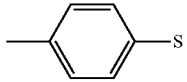 | 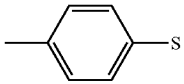 | 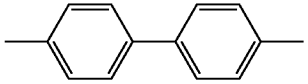 | 1 | —(CH2)2—COO—(CH2)3—Si(OiPr)2Me |
| III-27 | 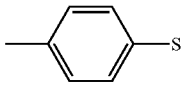 | 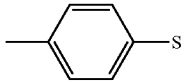 | 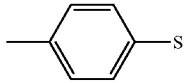 | 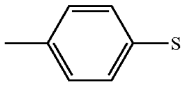 | 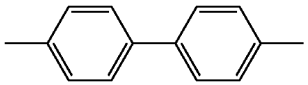 | 1 | —(CH2)2—COO—(CH2)3—Si(OiPr)Me2 |
| III-28 | 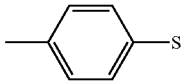 | 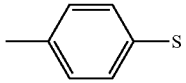 | 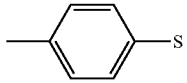 | 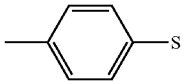 | 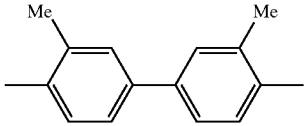 | 1 | —COO—(CH2)3—Si(OiPr)3 |

TABLE 32
| No. | $Ar^1$ | $Ar^2$ | $Ar^3$ | $Ar^4$ | $Ar^5$ | k | S |
|---|---|---|---|---|---|---|---|
| III-29 | 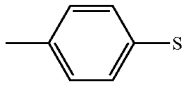 | 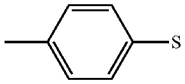 | 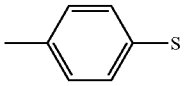 | 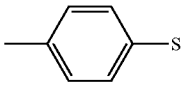 | 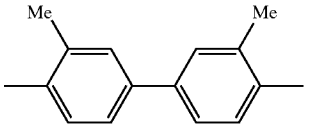 | 1 | —(CH2)2—COO—(CH2)3—Si(OiPr)3 |
| III-30 | 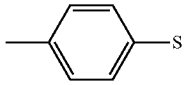 | 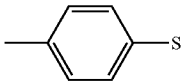 | 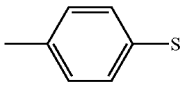 | 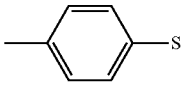 | 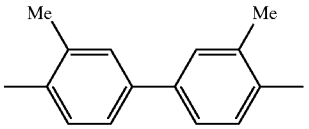 | 1 | —(CH2)2—COO—(CH2)3—Si(OiPr)2Me |
| III-31 | 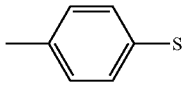 | 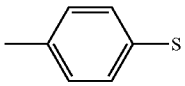 | 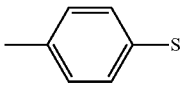 | 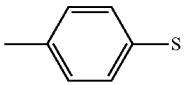 | 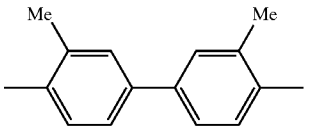 | 1 | —(CH2)2—COO—(CH2)3—Si(OiPr)Me2 |
| III-32 | 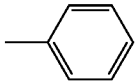 | 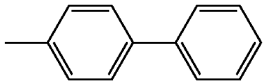 | — | — | 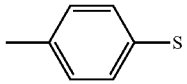 | 0 | —(CH2)4—Si(OiPr)3 |
| III-33 | 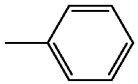 | 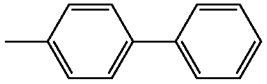 | — | — | 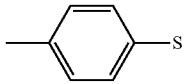 | 0 | —(CH2)4—Si(OEt)3 |
| III-34 | 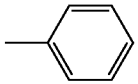 | 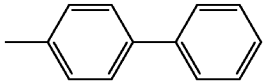 | — | — | 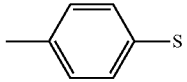 | 0 | —(CH2)4—Si(OMe)3 |
| III-35 | 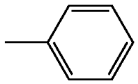 | 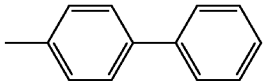 | — | — | 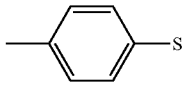 | 0 | —(CH2)4—SiMe(OMe)2 |
| III-36 | 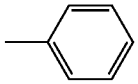 | 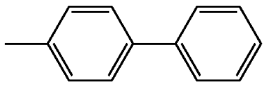 | — | — | 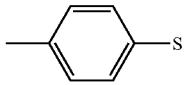 | 0 | —(CH2)4—SiMe(OiPr)2 |

TABLE 33
| No. | $Ar^1$ | $Ar^2$ | $Ar^3$ | $Ar^4$ | $Ar^5$ | k | S |
|---|---|---|---|---|---|---|---|
| III-37 | 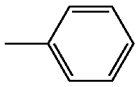 | 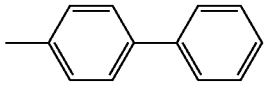 | — | — | 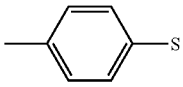 | 0 | —CH═CH—(CH2)2—Si(OiPr)3 |
| III-38 | 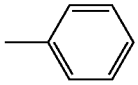 | 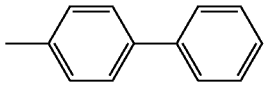 | — | — | 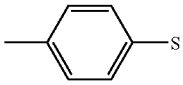 | 0 | —CH═CH—(CH2)2—Si(OMe)3 |
| III-39 | 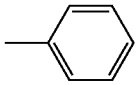 | 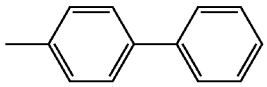 | — | — | 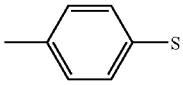 | 0 | —CH═N—(CH2)3—Si(OiMe)3 |
| III-40 | 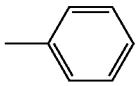 | 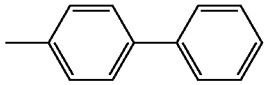 | — | — | 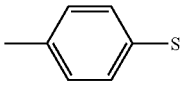 | 0 | —CH═N—(CH2)3—Si(OiPr)3 |
| III-41 | 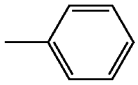 | 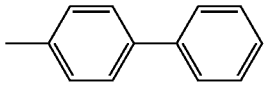 | — | — | 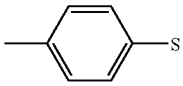 | 0 | —O—(CH2)3—Si(OiPr)3 |
| III-42 | 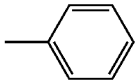 | 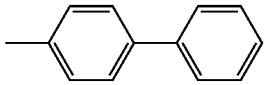 | — | — | 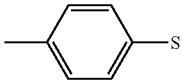 | 0 | —COO—(CH2)3—Si(OiPr)3 |
| III-43 | 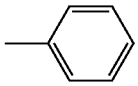 | 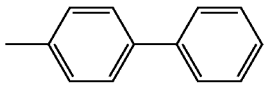 | — | — | 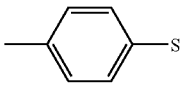 | 0 | —(CH2)2—COO—(CH2)3—Si(OiPr)3 |
| III-44 | 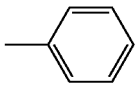 | 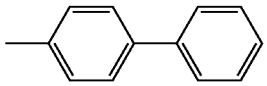 | — | — | 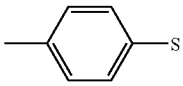 | 0 | —(CH2)2—COO—(CH2)3—Si(OiPr)2Me |
TABLE 34
| No. | $Ar^1$ | $Ar^2$ | $Ar^3$ | $Ar^4$ | $Ar^5$ | k | S |
|---|---|---|---|---|---|---|---|
| III-45 | 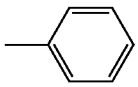 | 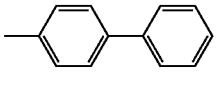 | — | — | 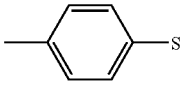 | 0 | —(CH2)2—COO—(CH2)3—Si(OiPr)Me2 |
| III-46 | 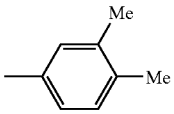 | 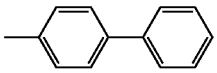 | — | — | 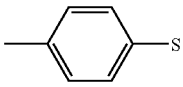 | 0 | —(CH2)4—Si(OMe)3 |

TABLE 34-continued
| No. | $Ar^1$ | $Ar^2$ | $Ar^3$ | $Ar^4$ | $Ar^5$ | k | S |
|---|---|---|---|---|---|---|---|
| III-47 | 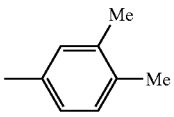 | 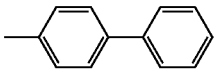 | — | — | 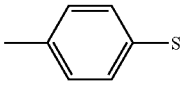 | 0 | —(CH2)2—COO—(CH2)3—Si(OiPr)3 |
| III-48 | 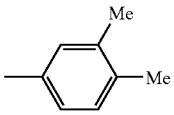 | 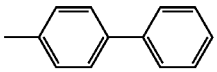 | — | — | 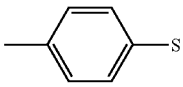 | 0 | —(CH2)2—COO—(CH2)3—SiMe(OiPr)2 |
| III-49 | 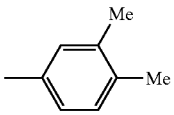 | 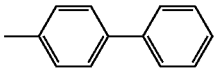 | — | — | 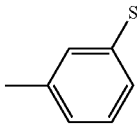 | 0 | —O—(CH2)3—Si(OiPr)3 |
| III-50 | 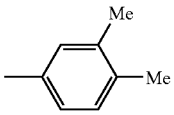 | 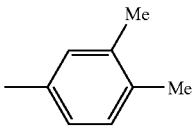 | — | — | 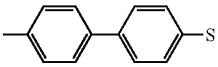 | 0 | —COO—(CH2)3—Si(OiPr)3 |
| III-51 | 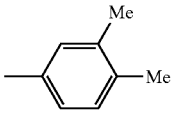 | 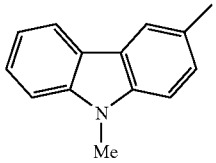 | — | — | 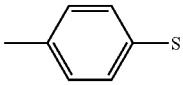 | 0 | —(CH2)4—Si(OiPr)3 |
| III-52 | 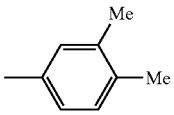 | 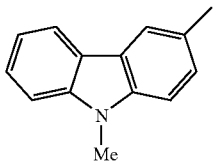 | — | — | 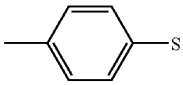 | 0 | —(CH2)2—COO—(CH2)3—Si(OiPr)3 |

TABLE 35
| No. | $Ar^1$ | $Ar^2$ | $Ar^3$ | $Ar^4$ | $Ar^5$ | k | S |
|---|---|---|---|---|---|---|---|
| III-53 | 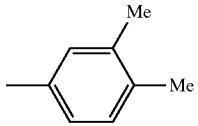 | 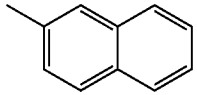 | — | — | 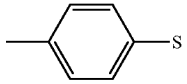 | 0 | —(CH2)4—Si(OiPr)3 |
| III-54 | 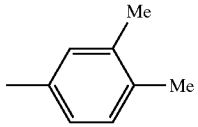 | 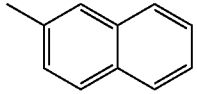 | — | — | 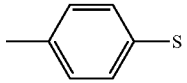 | 0 | —(CH2)2—COO—(CH2)3—Si(OiPr)3 |
| III-55 | 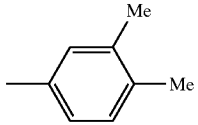 | 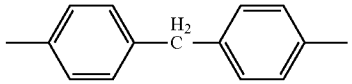 | — | — | 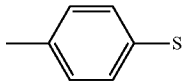 | 0 | —(CH2)4—Si(OiPr)3 |
| III-56 | 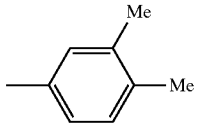 | 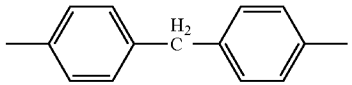 | — | — | 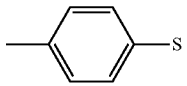 | 0 | —(CH2)2—COO—(CH2)3—Si(OiPr)3 |
| III-57 | 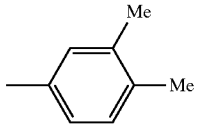 | 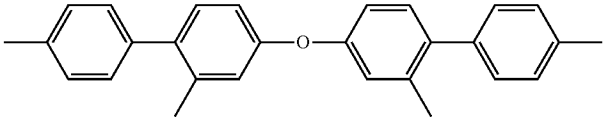 | — | — | 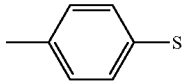 | 0 | —(CH2)4—Si(OiPr)3 |

TABLE 35-continued
| No. | $Ar^1$ | $Ar^2$ | $Ar^3$ | $Ar^4$ | $Ar^5$ | k | S |
|---|---|---|---|---|---|---|---|
| III-58 | 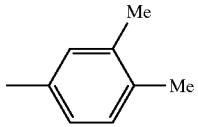 | 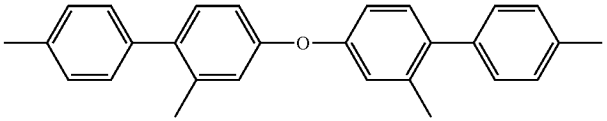 | — | — | 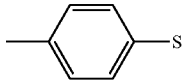 | 0 | —(CH2)2—COO—(CH2)3—Si(OiPr)3 |
| III-59 | 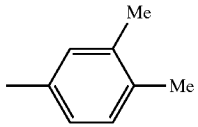 | 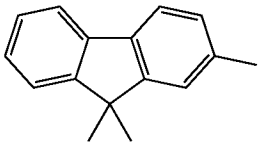 | — | — | 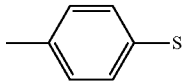 | 0 | —(CH2)2—COO—(CH2)3—Si(OiPr)3 |
| III-60 | 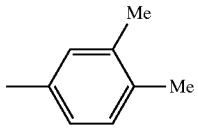 | 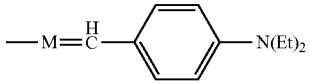 | — | — | 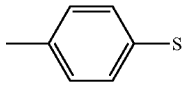 | 0 | —(CH2)2—COO—(CH2)3—Si(OiPr)3 |
| III-61 | 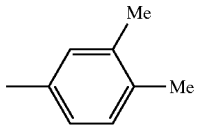 | 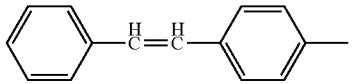 | — | — | 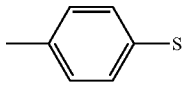 | 0 | —(CH2)2—COO—(CH2)3—Si(OiPr)3 |

Also, more specific examples of the compound represented by the general formula (IV) include the following compounds represented by (IV-1) to (IV-40). Additionally, in the following table, Me or the connecting bond with no substituent represents a methyl group, and Et represents an ethyl group.
TABLE 36
IV-1
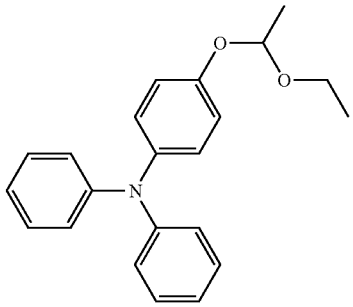
IV-2
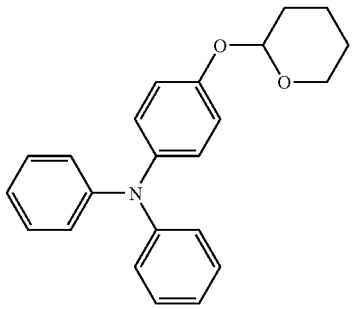
IV-3
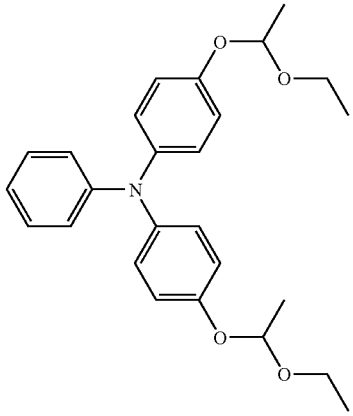
TABLE 36-continued
IV-4
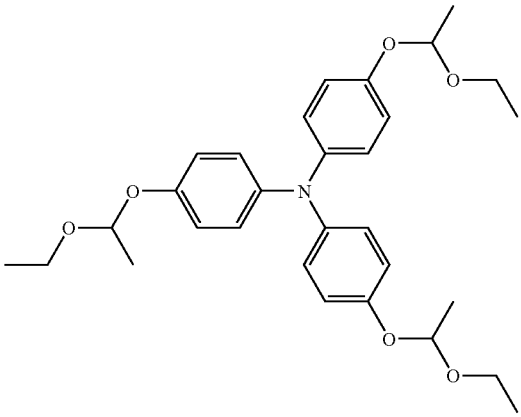
TABLE 37
IV-5
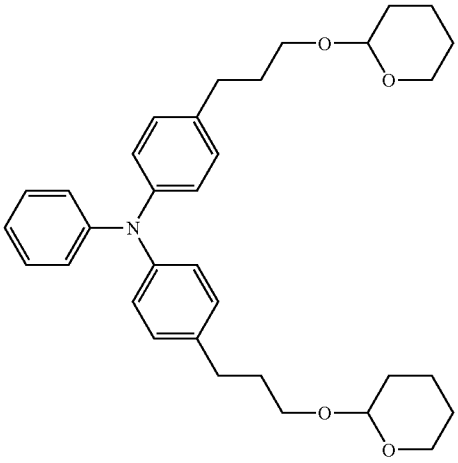
IV-6
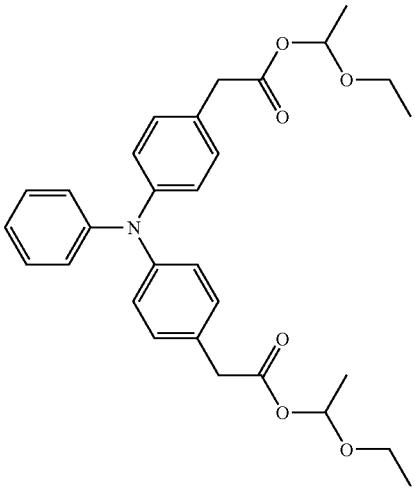

TABLE 37-continued
IV-7
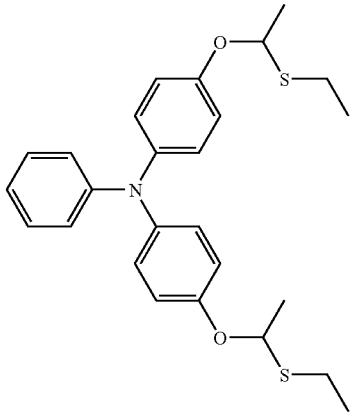
IV-8
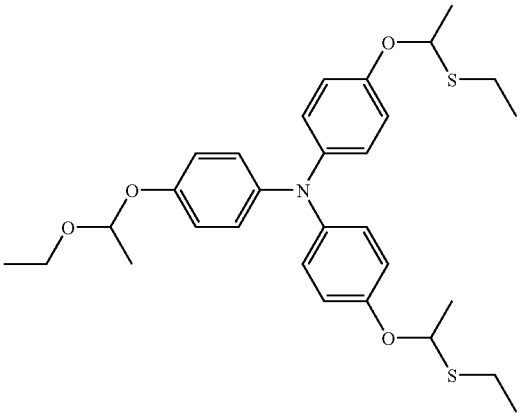
TABLE 38
IV-9
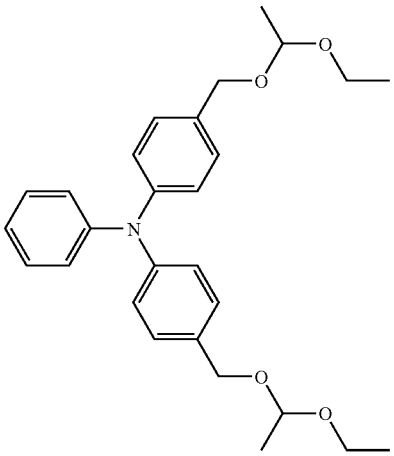
TABLE 38-continued
IV-10
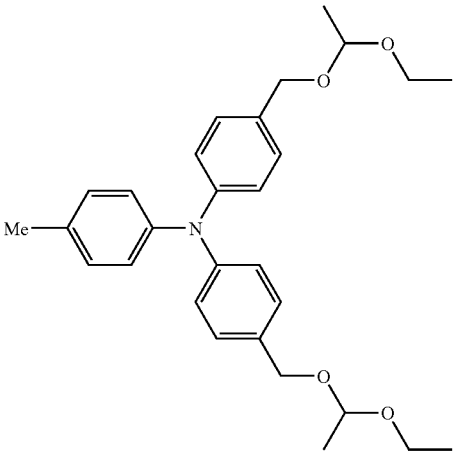
IV-11
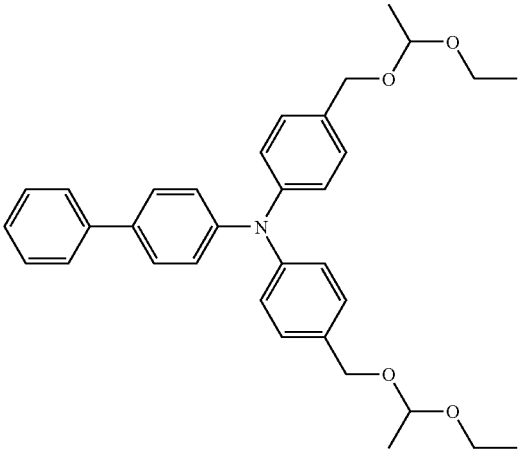
IV-12
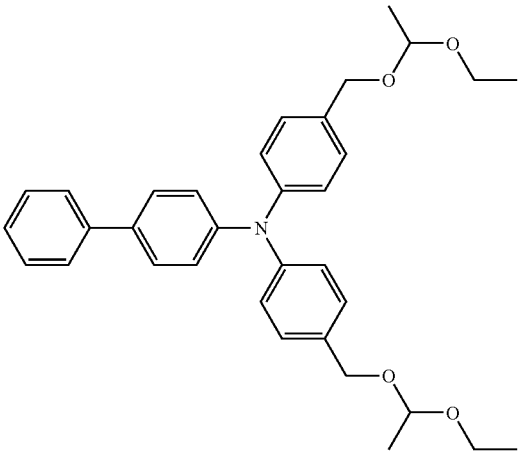

TABLE 39
IV-13
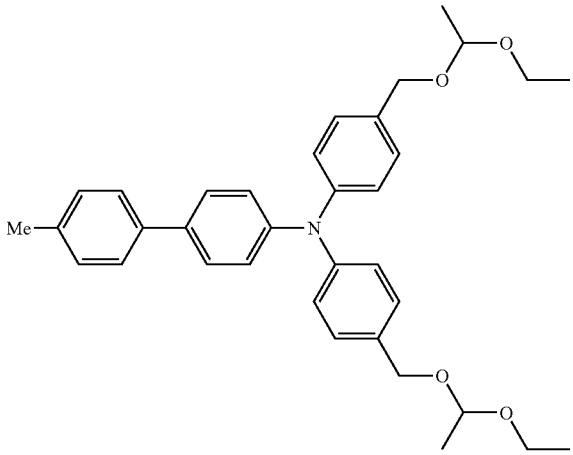
IV-14
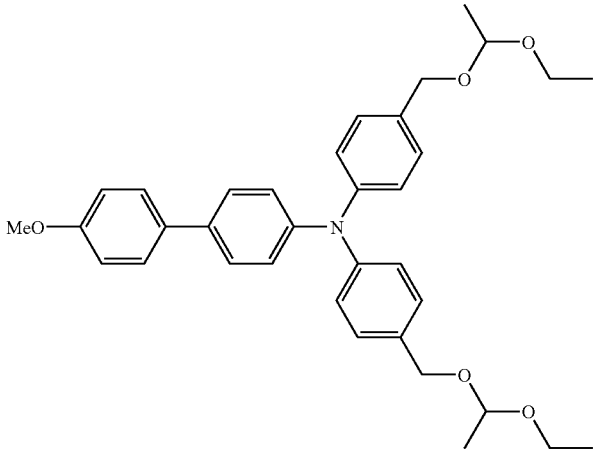
IV-15
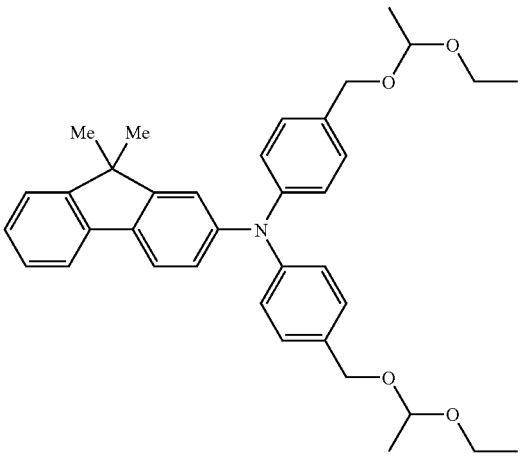

TABLE 39-continued
| | |
|---|---|
| IV-16 | 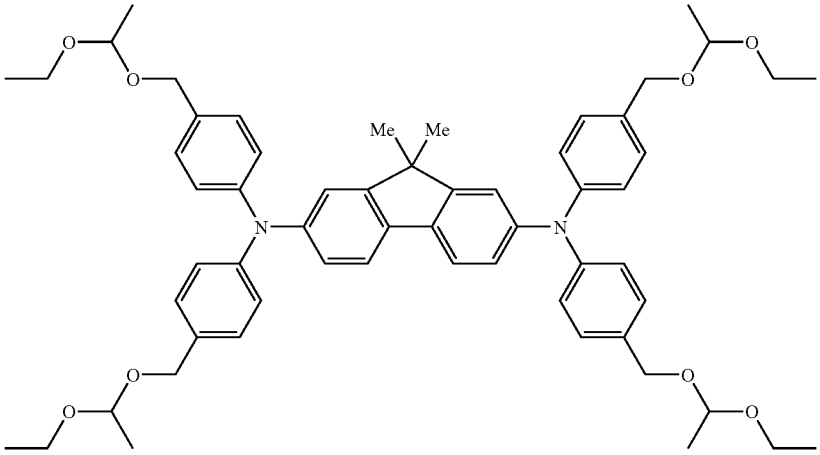 |
TABLE 40
| | |
|---|---|
| IV-17 | 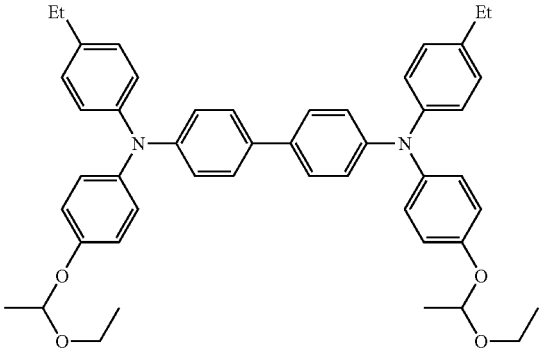 |
| IV-18 | 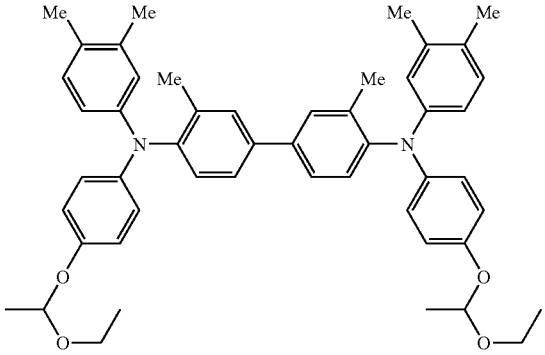 |
TABLE 40-continued
| | |
|---|---|
| IV-19 | 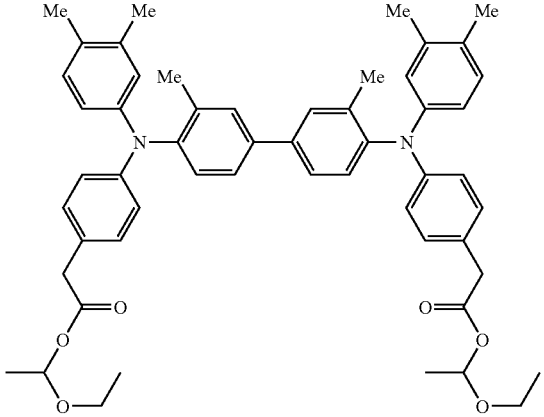 |
| IV-20 | 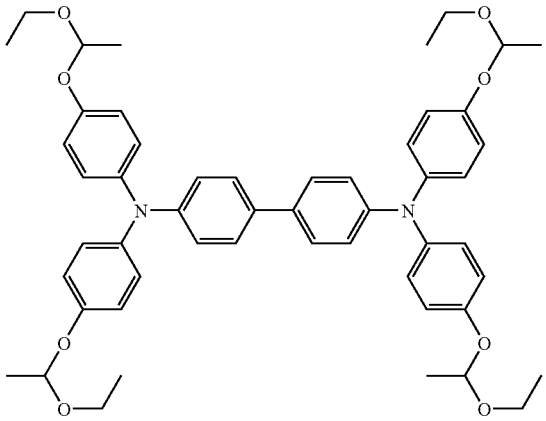 |

TABLE 41
IV-21
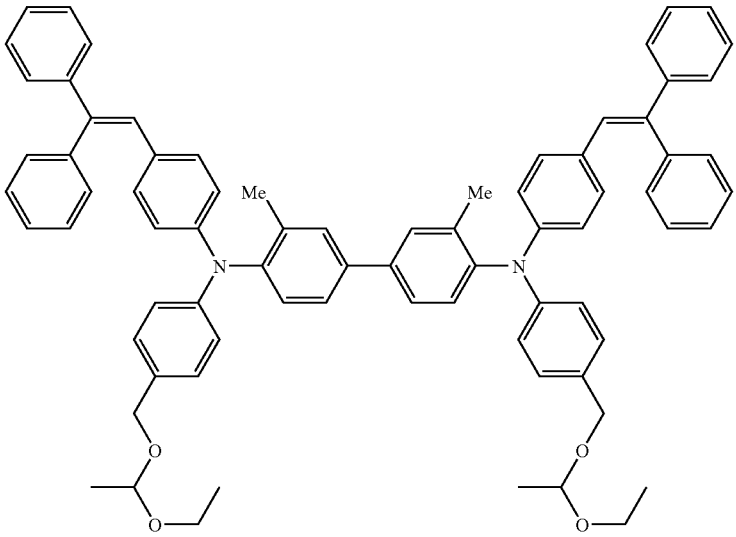
IV-22
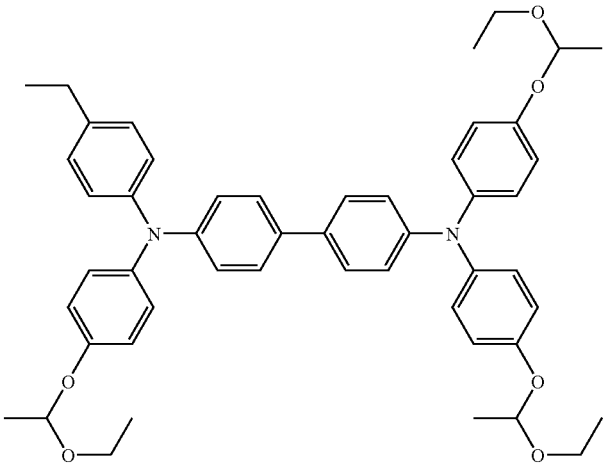
IV-23
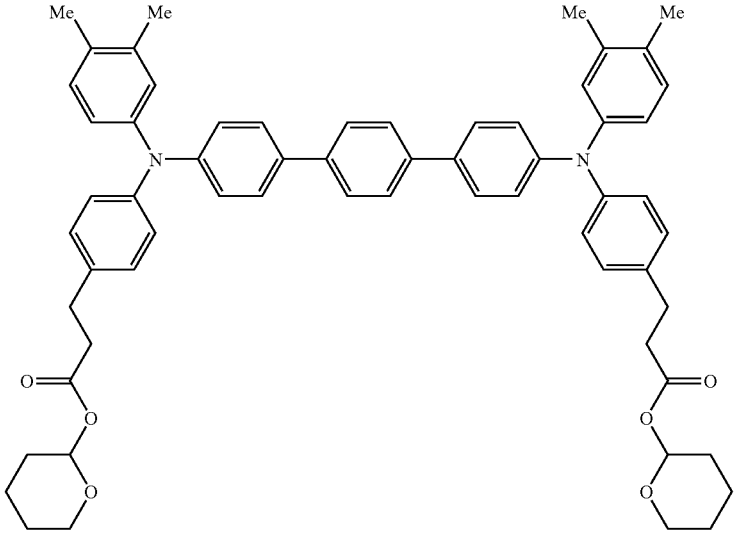

TABLE 41-continued
IV-24
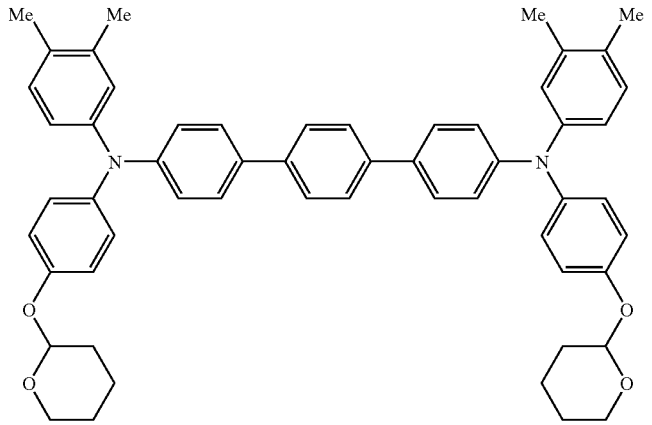
TABLE 42
IV-25
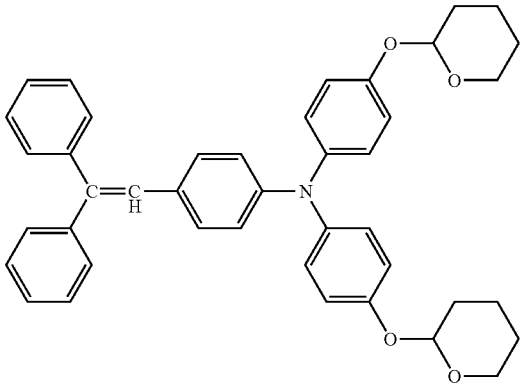
IV-26
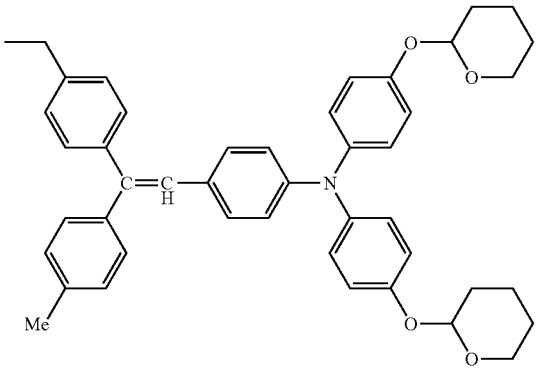
IV-27
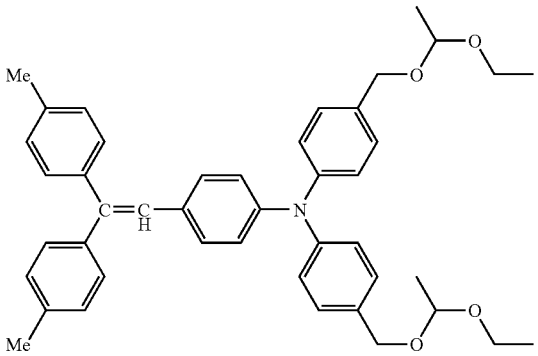
TABLE 42-continued
IV-28
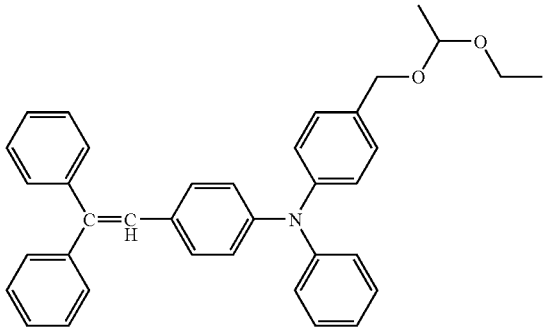
TABLE 43
IV-29
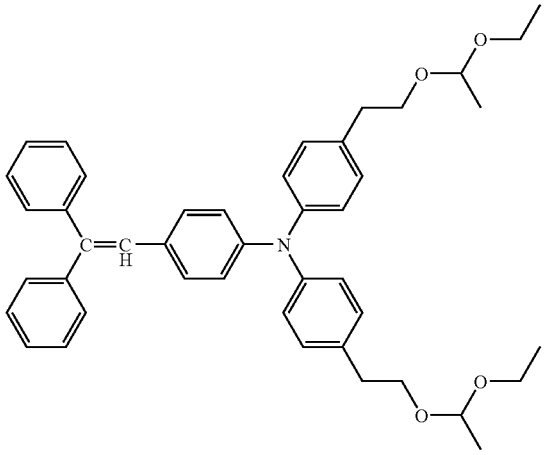

TABLE 43-continued
IV-30
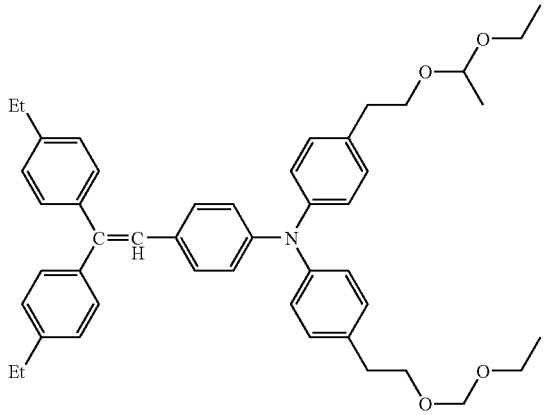
IV-31
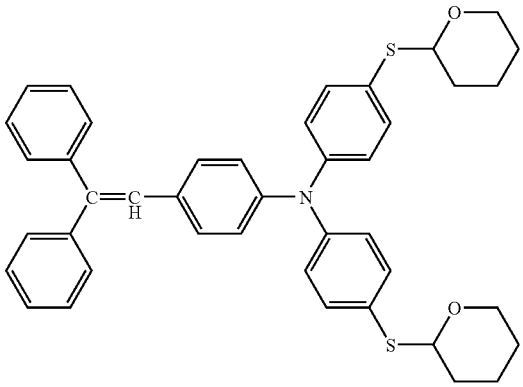
IV-32
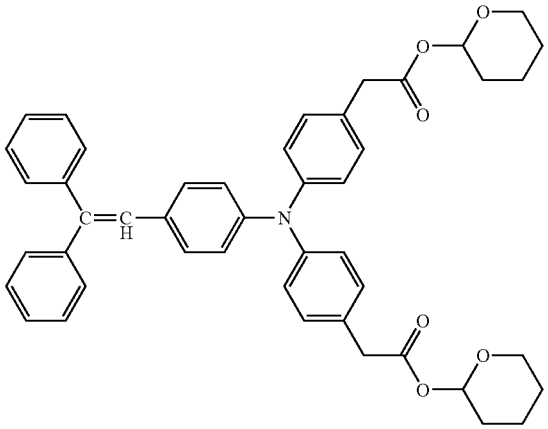
TABLE 44
IV-33
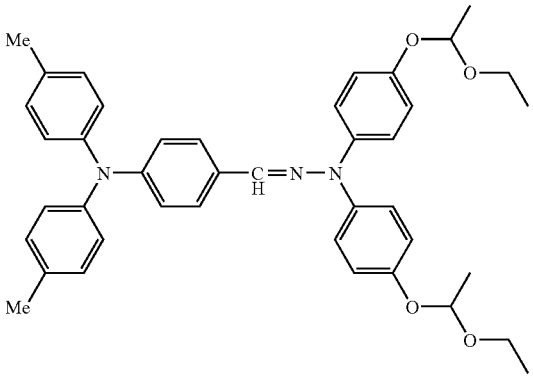
IV-34
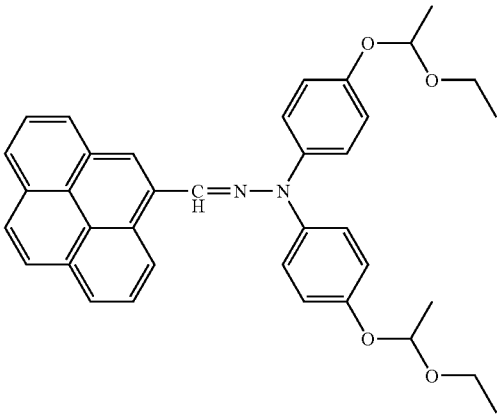
IV-35
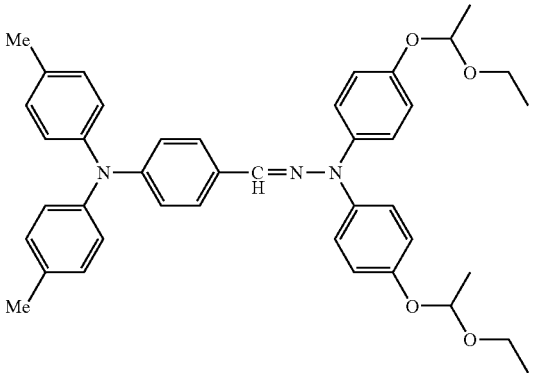
IV-36
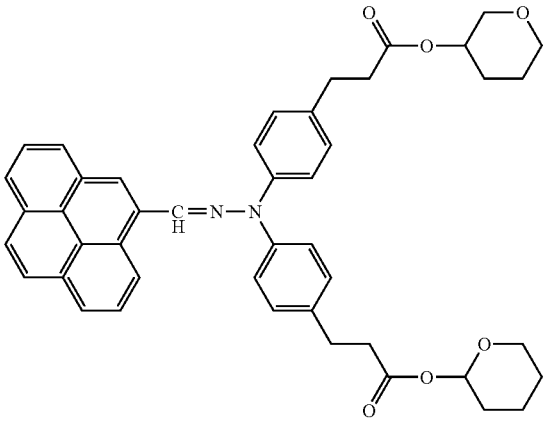

TABLE 45
IV-37
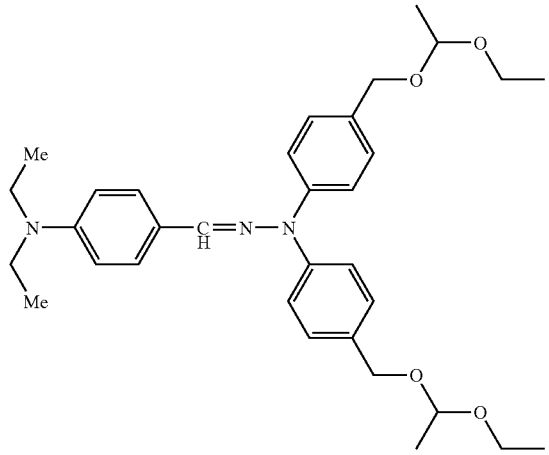
IV-38
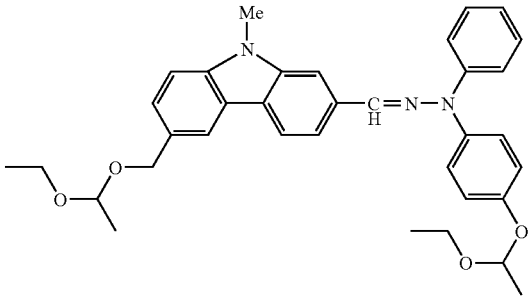
IV-39
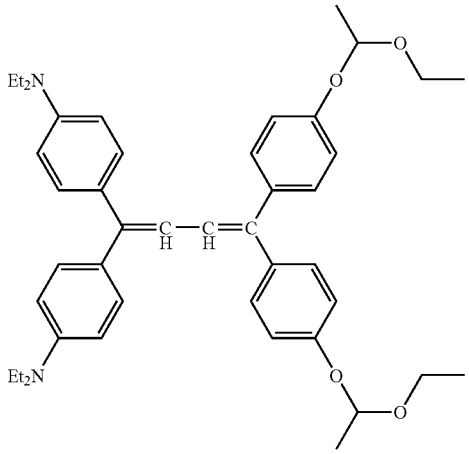
TABLE 45-continued
IV-40
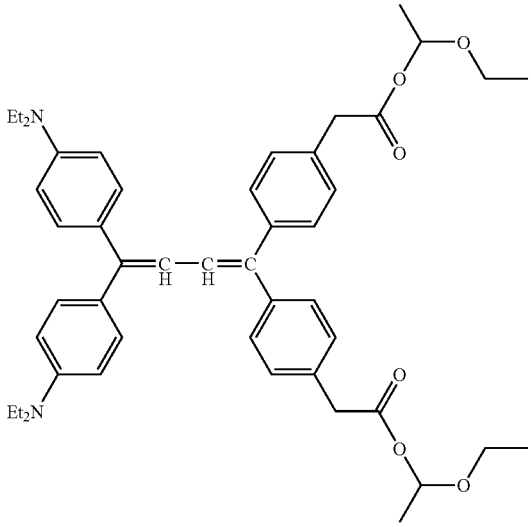
Also, more specific examples of the compound represented by the general formula (V) include the following compounds represented by (V-1) to (V-55). Additionally, in the following table, Me or the connecting bond with no substituent represents a methyl group.
TABLE 46
(V-1)
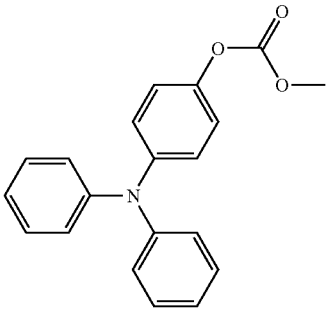
(V-2)
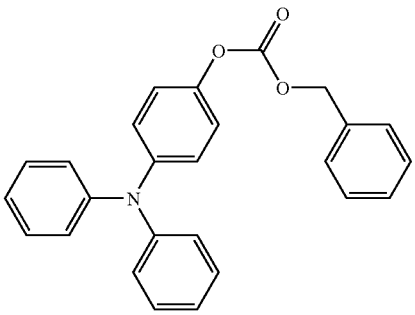

TABLE 46-continued
(V-3)
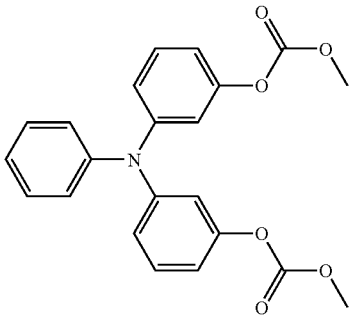
(V-4)
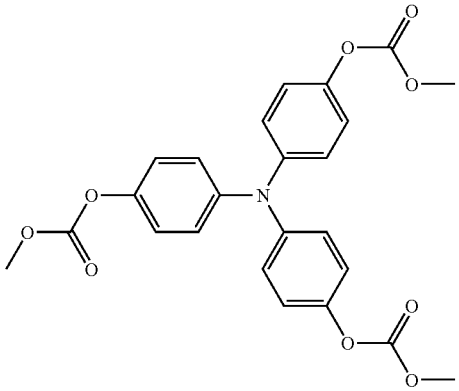
(V-5)
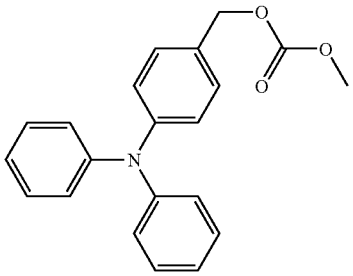
(V-6)
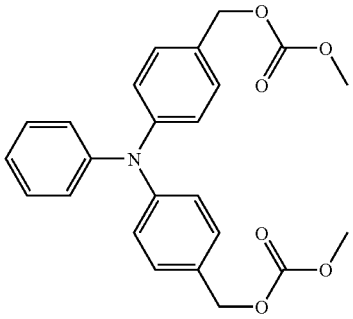
(V-7)
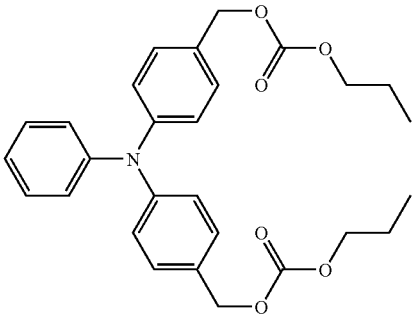
TABLE 46-continued
(V-8)
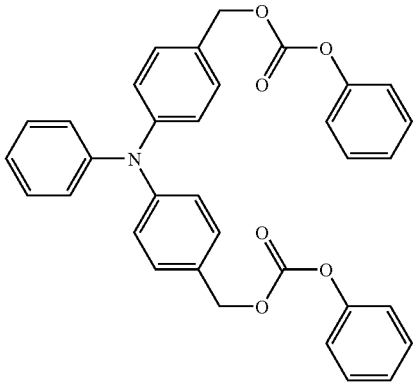
TABLE 47
(V-9)
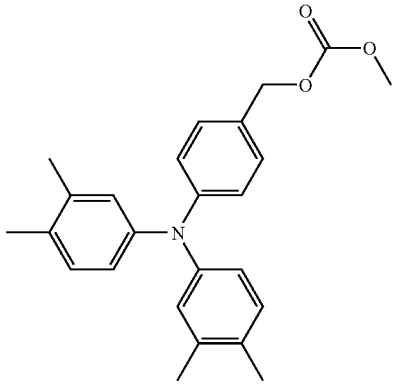
(V-10)
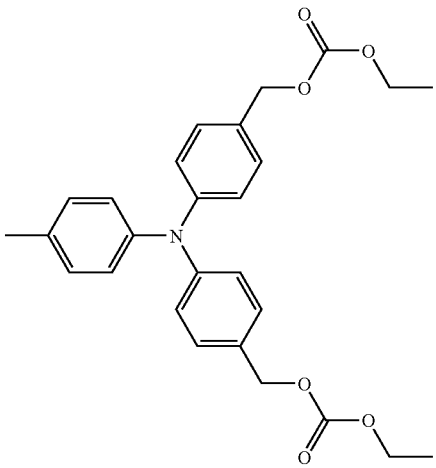

TABLE 47-continued
(V-11)
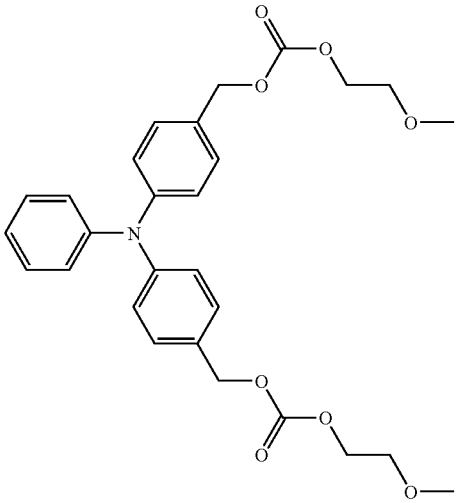
(V-12)
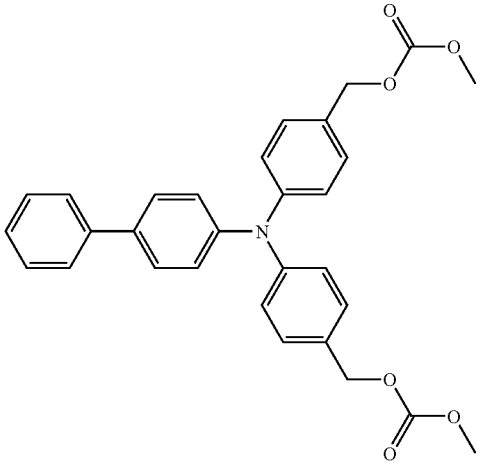
(V-13)
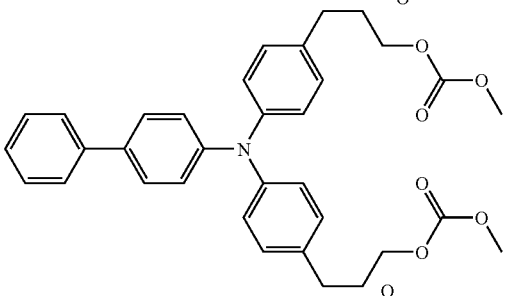
(V-14)
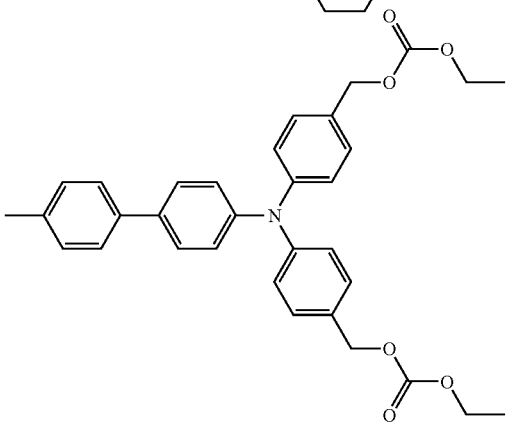
TABLE 48
(V-15)
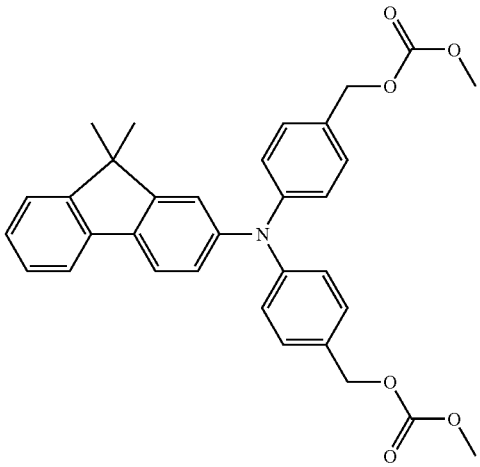
(V-16)
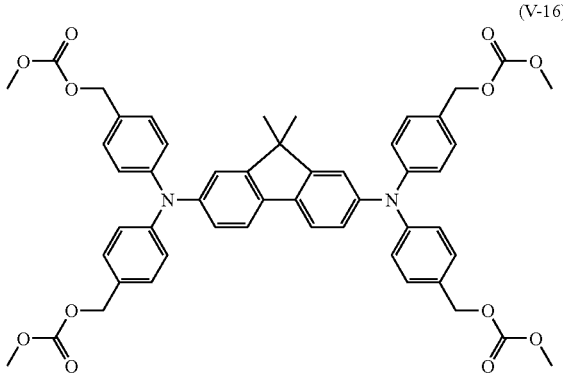
(V-17)
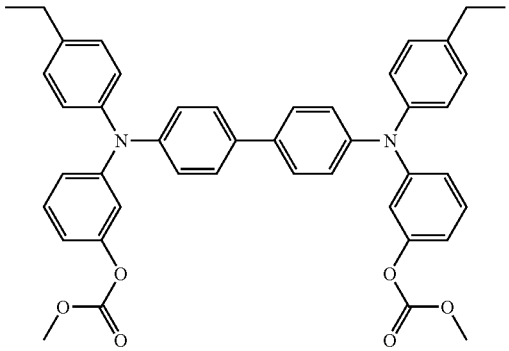
(V-18)
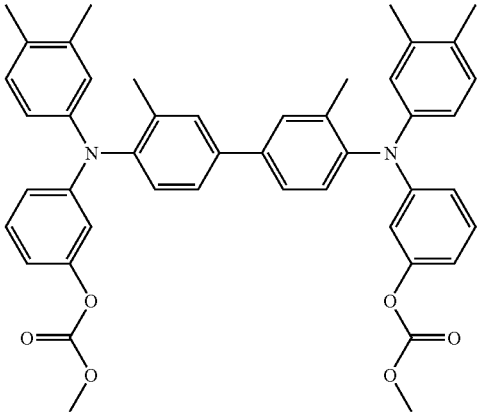

TABLE 48-continued
(V-19)
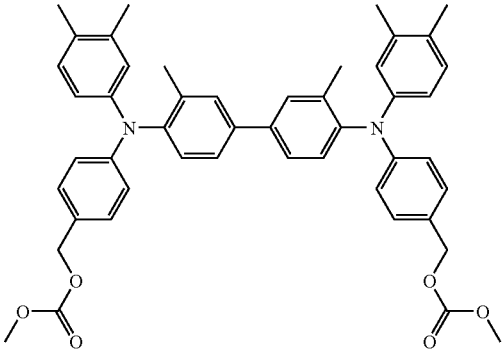
(V-20)
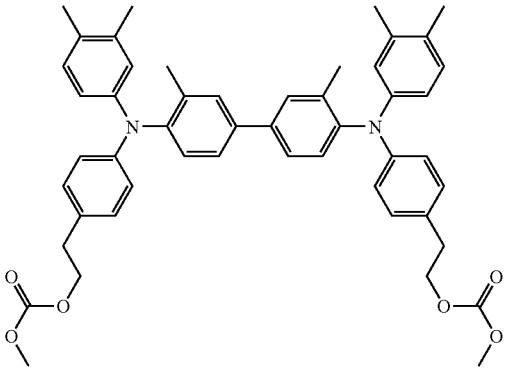
TABLE 49
(V-21)
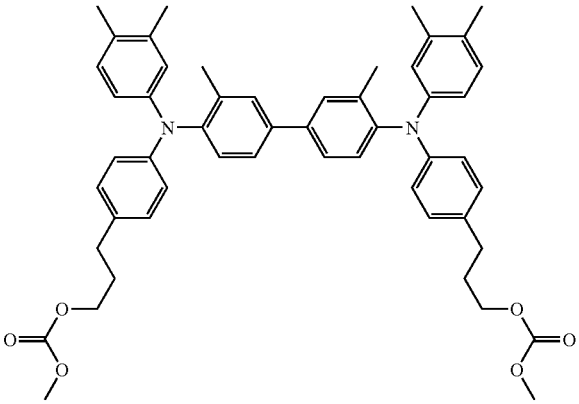
TABLE 49-continued
(V-22)
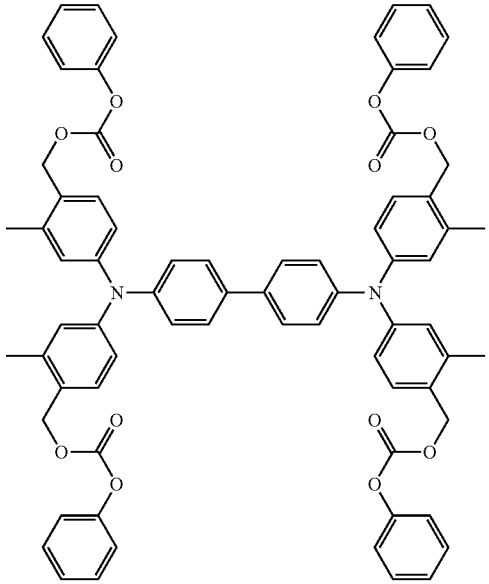
(V-23)
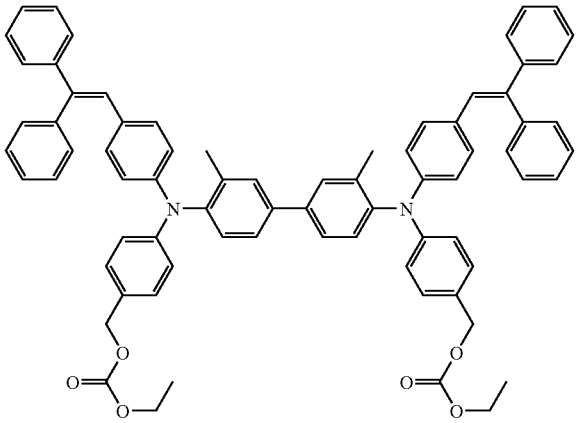
(V-24)
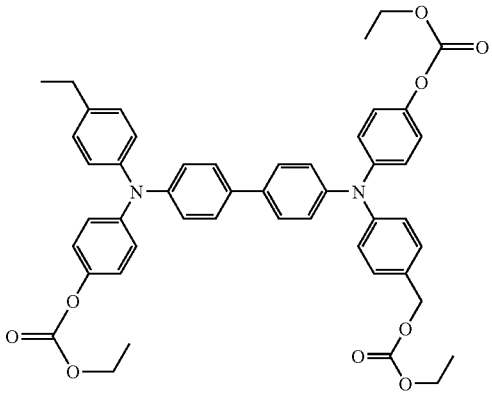

TABLE 49-continued
(V-25)
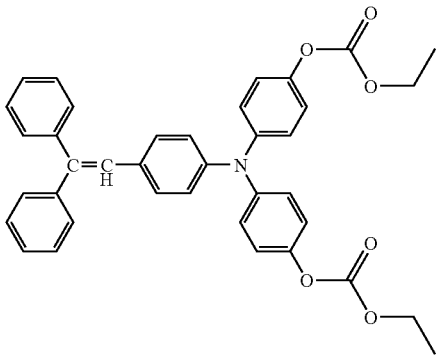
(V-26)
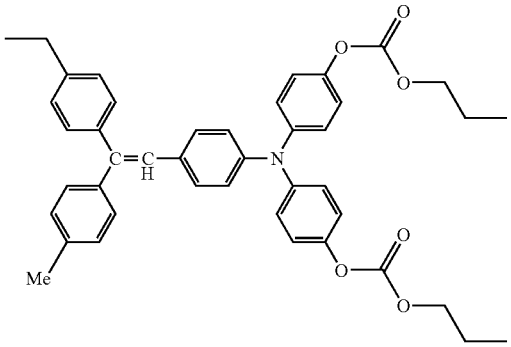
TABLE 50
(V-27)
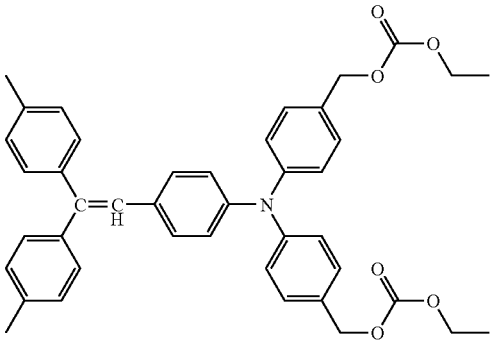
(V-28)
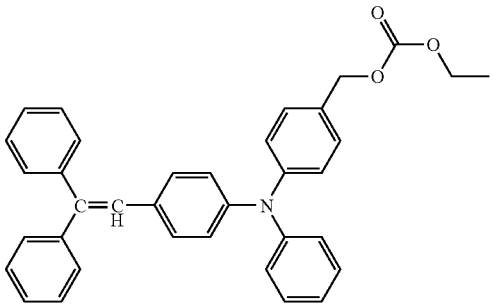
TABLE 50-continued
(V-29)
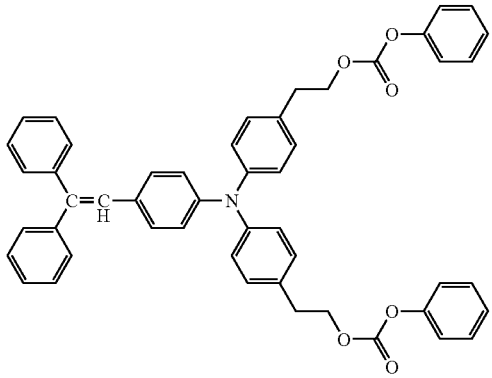
(V-30)
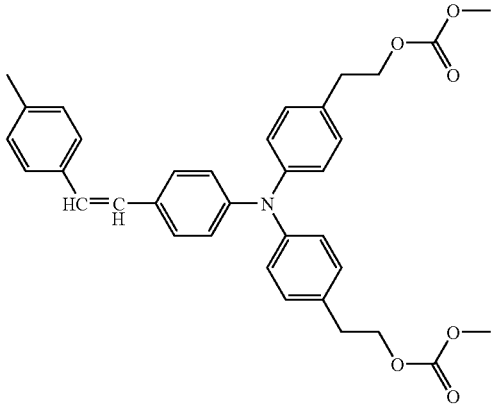
(V-31)
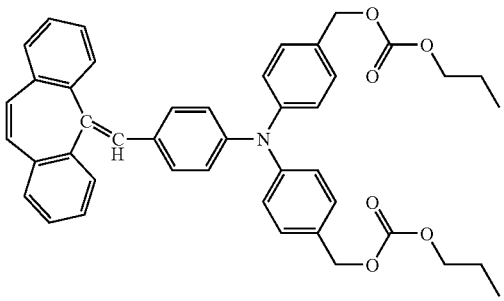
(V-32)
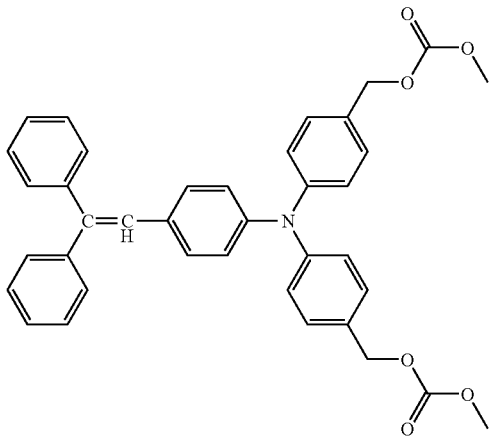

TABLE 51
(V-33)
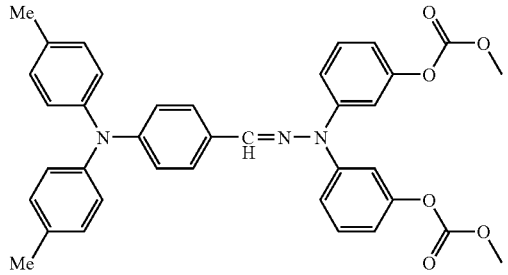
(V-34)
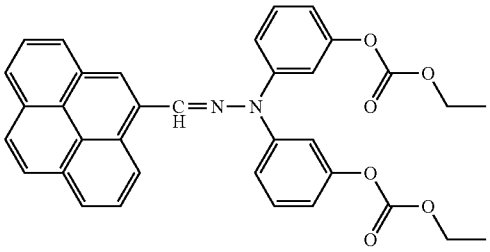
(V-35)
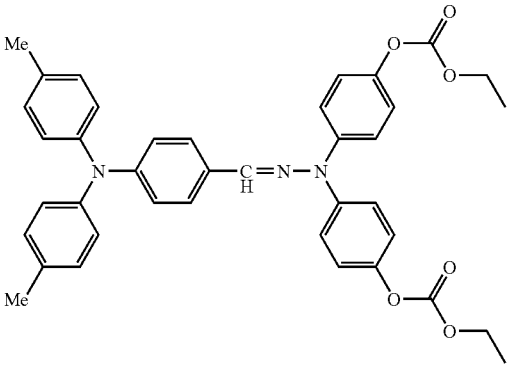
TABLE 51-continued
(V-36)
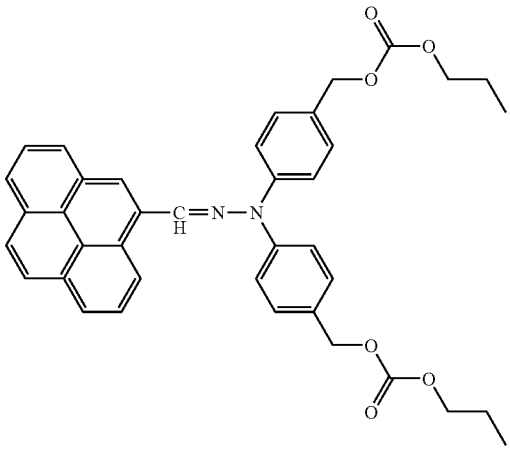
(V-37)
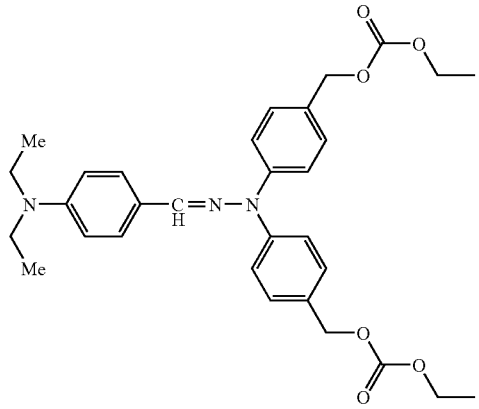
(V-38)
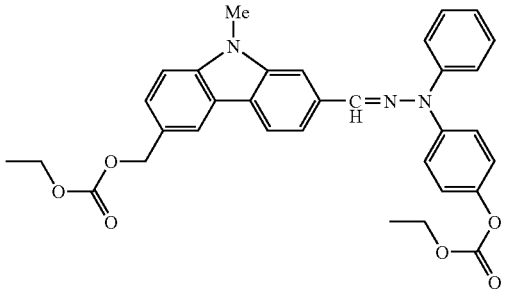

TABLE 52
(V-39)
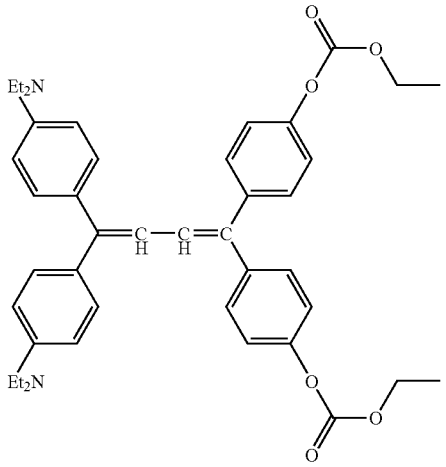
(V-40)
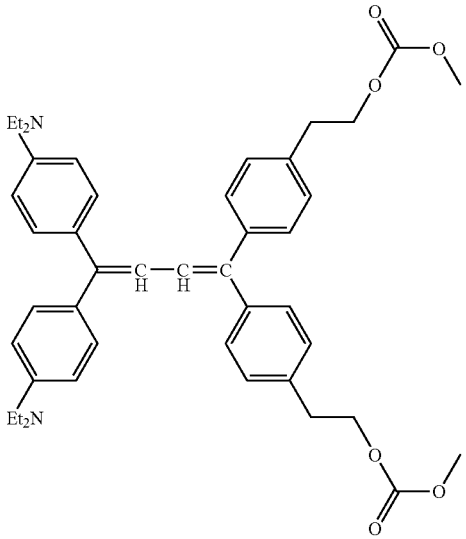
(V-41)
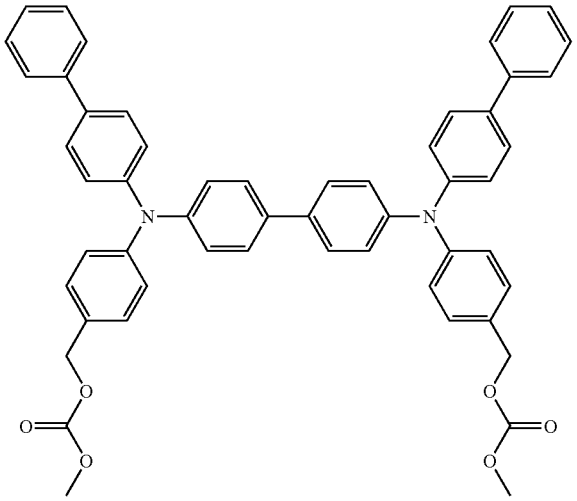

TABLE 52-continued
(V-42)
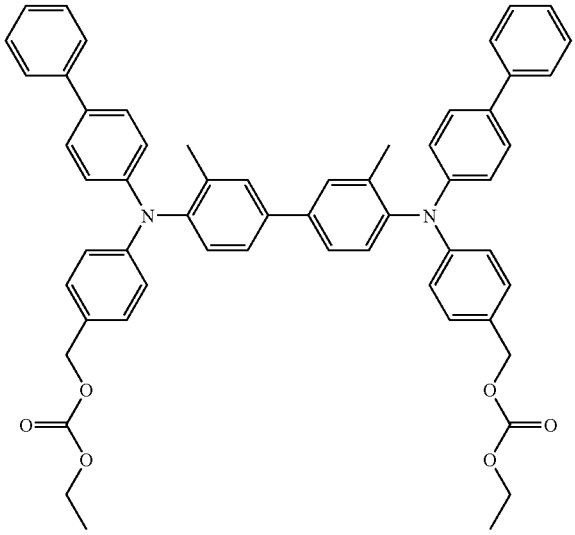
(V-43)
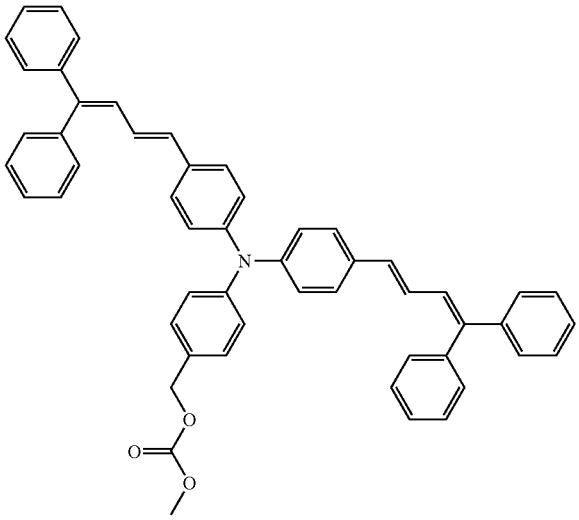
(V-44)
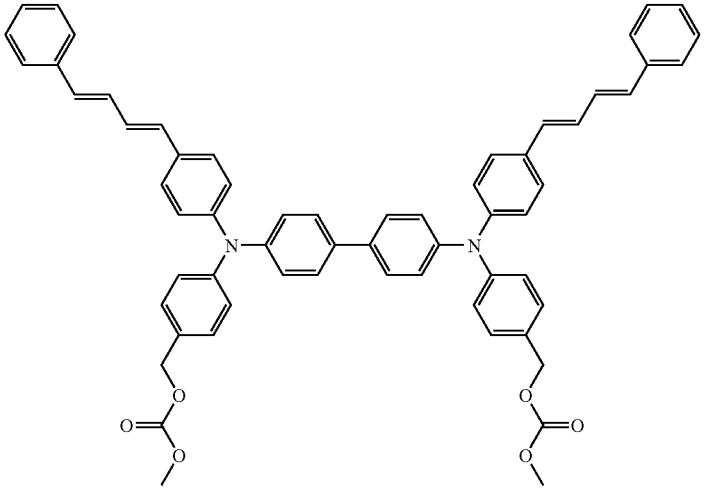

TABLE 53
(V-45)
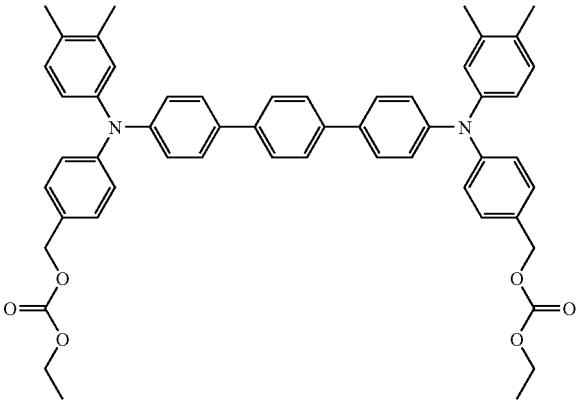
(V-46)
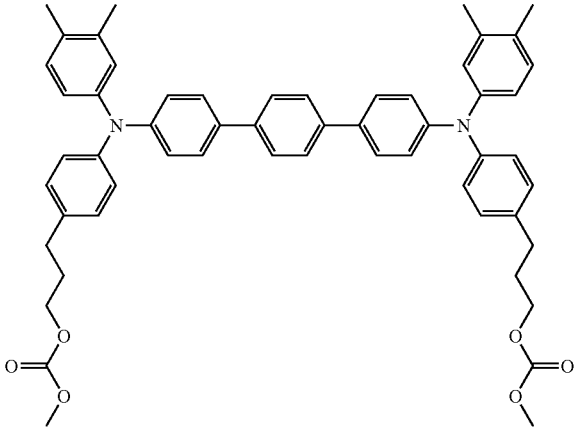
TABLE 54
(V-47)
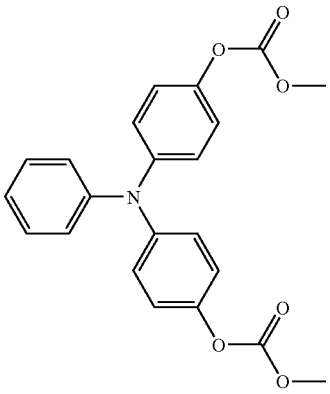
TABLE 54-continued
(V-48)
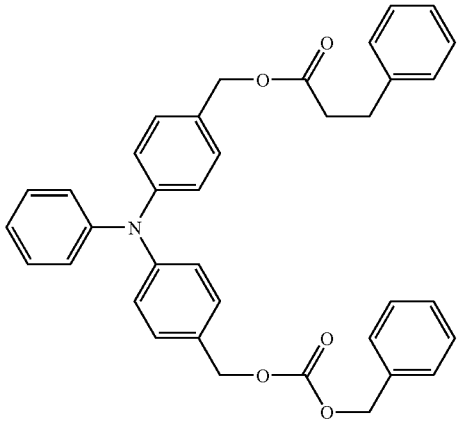
(V-49)
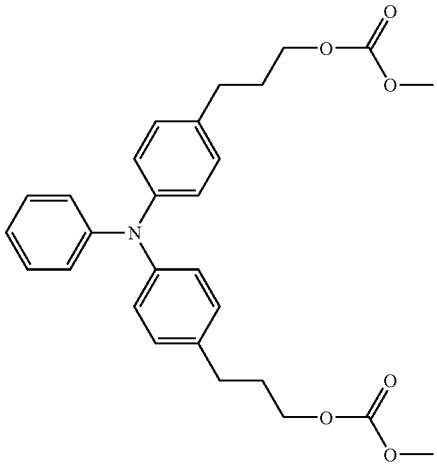
(V-50)
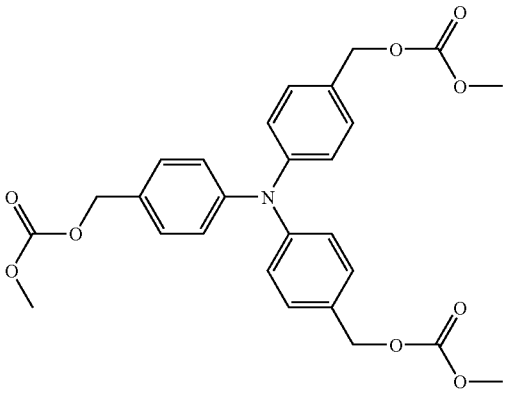

TABLE 55

(V-51)

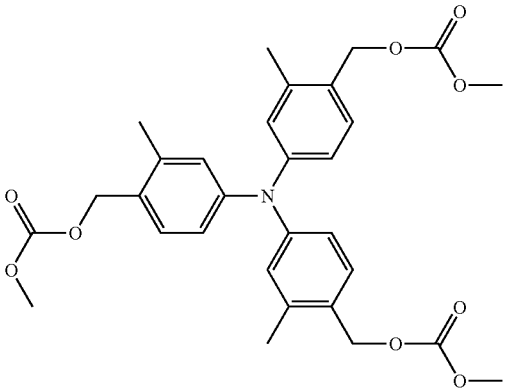

(V-52)

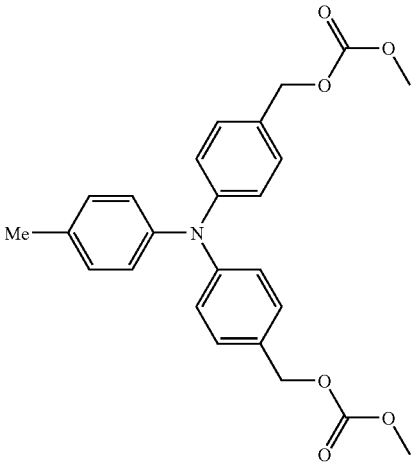

(V-53)

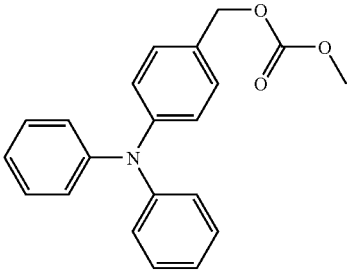

(V-54)

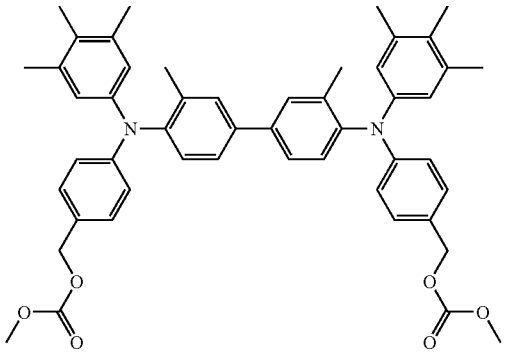

TABLE 55-continued (V-55)

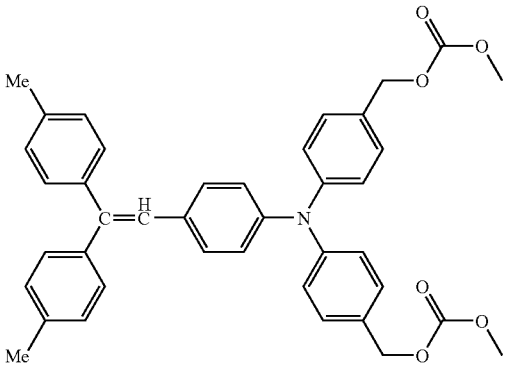

To the curable resin composition for forming the protective layer 7 may be added a compound represented by the following general formula (XII) in order to control various physical properties of the protective layer 7 such as strength and film resistance thereof.

$$Si(R^{50})_{(4-c)}Q_c \quad (XII)$$

In the above formula (XII), $R^{50}$ represents a hydrogen atom, an alkyl group or a substituted or unsubstituted aryl group, Q represents a hydrolysable group, and c represents an integer of from 1 to 4.

Specific examples of the compound represented by the above formula (XII) include the following silane coupling agents. As the silane coupling agents, there may be illustrated tetrafunctional alkoxysilanes (c=4) such as tetramethoxysilane and tetraethoxysilane; trifunctional alkoxysilanes (c=3) such as methyltrimethoxysilane, methyltriethoxysilane, ethyltrimethoxysilane, methyltrimethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethylmethyldimethoxysilane, N-β(aminoethyl)-γ-aminopropyltriethoxysilane, (tridecafluoro-1,1,2,2-tetrahydrooctyl)triethoxysilane, (3,3,3-trifluoropropyl) trimethoxysilane, 3-(heptafluoroisopropoxy) propyltriethoxysilane, 1H,1H,2H,2H-perfluoroalkyltriethoxysilane, 1H,1H,2H,2H-perfluorodexyltriethoxysilane and 1H,1H,2H,2H-perfluloroocytyltriethoxysilane; bifunctional alkoxysilanes (c=2) such as dimethyldimethoxysilane, diphenyldimethoxysilane and methylphenyldimethoxysilane; and monofunctional alkoxysilanes such as trimethylmethoxysilane. In order to increase strength of the film, tri- and tetra-functional alkoxysilanes are preferred while, in order to improve flexibility and filming properties, mono- and di-functional alkoxysilanes are preferred.

Also, a silicone-based hard coat agent prepared from the coupling agent may be used. As the commercially available hard coat agent, KP-85, X-40-9740, X-40-2239 (these being products of Shin-etsu Silicone K.K.), AY-42-440, AY42-441- and AY49-208 (these being products of Toray Dow Coning K.K.) may be used.

It is also preferred to use a compound having two or more silicon atoms as shown by the following formula (XIII) in the curable resin composition for forming the protective layer 7 in order to enhance strength of the protective layer.

$$B—(Si(R^{51})_{(3-d)}Q_d)_2 \quad (XIII)$$

In the above formula (XIII), B represents a divalent organic group, $R^{51}$ represents a hydrogen atom, an alkyl group or a substituted or unsubstituted aryl group, Q represents a hydrolysable group, and d represents an integer of from 1 to 3.

As more specific preferred examples of the compound represented by the formula (XIII), there are illustrated the following compounds (XIII-1) to (XIII-16).

TABLE 56

| | |
|---|---|
| XIII-1 | $(MeO)_3Si—(CH_2)_2—Si(OMe)_3$ |
| XIII-2 | $(MeO)_2MeSi—(CH_2)_2—SiMe(OMe)_2$ |
| XIII-3 | $(MeO)_2MeSi—(CH_2)_6—SiMe(OMe)_2$ |
| XIII-4 | $(MeO)_3Si—(CH_2)_6—Si(OMe)_2$ |
| XIII-5 | $(EtO)_3Si—(CH_2)_5—Si(OEt)_3$ |
| XIII-6 | $(MeO)_2MeSi—(CH_2)_{10}—SiMe(OMe)_2$ |
| XIII-7 | $(MeO)_3Si—(CH_2)_3—NH—(CH_2)_3—Si(OMe)_3$ |
| XIII-8 | $(MeO)_3Si—(CH_2)_3—NH—(CH_2)_2—NH—(CH_2)_3—Si(OMe)_3$ |
| XIII-9 | 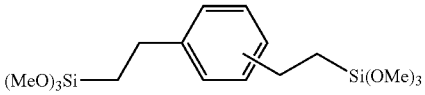 |
| XIII-10 | 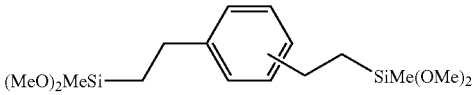 |
| XIII-11 | 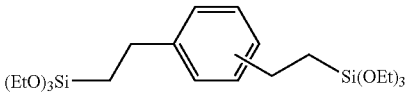 |
| XIII-12 | 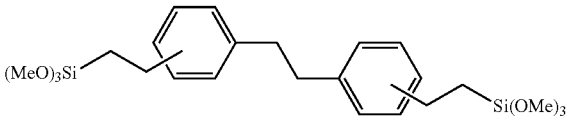 |
| XIII-13 | 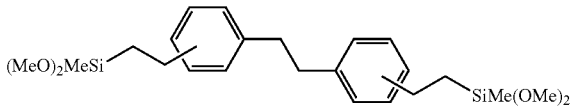 |
| XIII-14 | 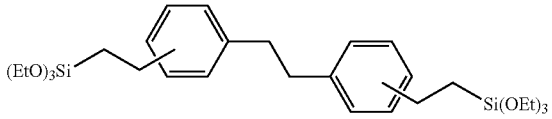 |
| XIII-15 | $(MeO)_3SiC_3H_6—O—CH_2CH\{—O—C_3H_6Si(OMe)_3\}—CH_2\{—O—C_3H_6Si(OMe)_3\}$ |
| XIII-16 | $(MeO)_3SiC_2H_4—SiMe_2—O—SiMe_2—O—SiMe_2—C_2H_4Si(OMe)_3$ |

Further, various resins may be added for the purpose of improving resistance to gases generated by discharge, mechanical strength, scratch resistance and particle-dispersing properties, controlling viscosity, reducing torque, controlling the wear amount and prolonging pot life. In this embodiment, it is preferred to further add an alcohol-soluble resin. Examples of the alcohol-soluble resin include polyvinyl acetal resins such as a polyvinyl butyral resin, a polyvinyl formal resin and a partially acetallized polyvinyl acetal resin wherein part of butyral is modified with formal or acetacetal (e.g., S-LEC B, K, etc.), polyamide resins and cellulose resins. In particular, in view of improving electric properties, polyvinyl acetal resins are preferred.

The weight-average molecular weight of the above-described resin is preferably from 2,000 to 100,000, more preferably from 5,000 to 50,000. Resins with a weight-average molecular weight of less than 2,000 tend to give undesired effects, whereas resins with a weight-average molecular weight of more than 100,000 tend to acquire a reduced solubility which limits the addition amount thereof or to cause filming failure upon coating. The addition amount is preferably from 1 to 40% by weight, more preferably from 1 to 30% by weight, most preferably from 5 to 20% by weight. In case where the addition amount is less than 1% by weight, desired effects become difficult to obtain whereas, in case where the amount is more than 40% by weight, there arises the possibility of forming blurred images under high temperature and high humidity. The resins may be used independently or may be used in combination thereof.

Further, in order to prolong pot life and control film properties, it is preferred to incorporate a cyclic compound having the repeating structural unit represented by the following general formula (XIV) or a derivative from the compound.

(XIV)

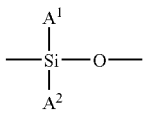

In the above formula (XIV), $A^1$ and $A^2$ each independently represents a monovalent organic group.

As the cyclic compound having the repeating structural unit represented by the formula (XIV), there may be illustrated commercially available cyclic siloxanes. Specific examples thereof include cyclic dimethylcyclosiloxanes such as hexamethylcyclotrisiloxane, octamethylcyclotetrasiloxane, decamethylcyclopentasiloxane and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane; cyclic phenylcyclosiloxanes such as hexaphenylcyclotrisilooxane; fluorine atom-containing cyclosiloxanes such as 3-(3,3,3-trifluoropropyl)methyl-cyclotrisiloxane; methylhydrosiloxane mixture; hydrosilyl group-containing pentamethylcyclopentasiloxane and phenylhydrocyclosiloxane; vinyl group-containing cyclosiloxanes such as pentavinylpentamethylcyclopentasiloxane. These cyclic siloxane compounds may be used independently or in combination of two or more thereof.

Further, in order to control resistance to deposition of pollutants, lubricating properties and hardness of the surface of the electrophotographic photoreceptor, various fine particles may be added to the curable resin composition for forming the protective layer 7.

One example of the fine particles is silicon atom-containing fine particles. The silicon atom-containing fine particles are fine particles containing silicon as constituting element, and specific examples thereof include colloidal silica and silicone fine particles. Colloidal silica to be used as silicon atom-containing fine particles has a volume average particle size of preferably from 1 to 100 nm, more preferably from 10 to 30 nm, and is selected from among an acidic or alkaline aqueous dispersion and those which are dispersed in an organic solvent such as alcohol, ketone or ester. Commercially available ones may be used. The solid content of colloidal silica in the curable resin composition is not particularly limited but, in view of filming properties, electric properties and strength, colloidal silica is used in the range of preferably from 0.1 to 50% by weight, more preferably from 0.1 to 30% by weight, based on the total weight of solid components in the curable resin composition.

The silicone fine particles to be used as the silicon atom-containing fine particles are spherical and have a volume average particle size of preferably from 1 to 500 nm, more preferably from 10 to 100 nm, and are selected from among silicone resin particles, silicone rubber particles and silica particles surface-treated with silicone. Commercially available ones may be used.

The silicone fine particles are particles with a small diameter chemically inert and excellent in dispersibility into a resin. Further, since only a small content thereof is sufficient to obtain enough characteristic properties, they can improve surface properties of the electrophotographic photoreceptor without inhibiting cross-linking reaction. That is, they can improve lubricating properties and water-repelling properties of the surface of the electrophotographic photoconductor in a state of being uniformly taken up in a strong cross-linked structure, which serves to keep good wear resistance and resistance to deposition of pollutants over a long period of time. The content of the silicone fine particles in the curable resin composition is preferably from 0.1 to 30% by weight, more preferably from 0.5 to 10% by weight, based on the total weight of the solid components in the curable resin composition.

Examples of other fine particles include fluorine-containing fine particles such as fine particles of tetrafluoroethylene, trifluoroethylene, hexafluoropropylene, vinyl fluoride and vinylidene fluoride; fine particles comprising a resin obtained by copolymerizing a fluorine-containing resin with a hydroxyl group-containing monomer as shown in 8$^{th}$ *Polymer Material Forum, Koen Yokoshu,* p. 89; and semiconductive metal oxides such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $In_2O_3$, ZnO and MgO.

Further, in order to control resistance to deposition of pollutants, lubricating properties and hardness of the surface of the electrophotographic photoreceptor, silicone oils other than polyether-modified silicones may be added. Examples of such silicone oil include silicone oils such as dimethylpolysiloxane, diphenylpolysiloxane and phenylmethylsiloxane; amino-modified polysiloxanes; and reactive silicone oils such as epoxy-modified polysiloxanes, carboxy-modified polysiloxanes, carbinol-modified polysiloxanes, methacryl-modified polysiloxanes, mercapto-modified polysiloxanes and phenolo-modified polysiloxanes. These may previously be added to the curable resin composition for forming the protective layer 7, or a prepared photoreceptor may be dipped therein under reduced pressure or under pressure.

Further, the curable resin composition for forming the protective layer 7 may contain additives such as a plasticizer, a surface properties-improving agent, an antioxidant and a photo-deterioration-preventing agent. Examples of the plasticizer include biphenyl, biphenyl chloride, terphenyl, dibutyl phthalate, diethylene glycol phthalate, dioctyl phthalate, triphenyl phosphate, methylnaphthalene, benzophenone, chlorinated paraffin, polypropylene, polystyrene and various fluorohydrocarbons.

To the curable resin composition for forming the protective layer 7 may be added an antioxidant having a partial structure of hindered phenol, hindered amine, thioether or phosphate. The antioxidant is effective for improving potential stability upon environmental change and improving image quality.

As the antioxidant, there may be illustrated the following compounds. Examples of the hindered phenol-based antioxidant include Sumilizer BTH-R, Sumilizer MDP-S, Sumilizer BBM-S, Sumilizer WX-R, Sumilizer NW, Sumilizer BP-76, Sumilizer BP-101, Sumilizer GA-80, Sumilizer GM, Sumilizer GS (these being products of Sumitomo Chemical Co., Ltd.), IRGANOX1010, IRGANOX1035,IRGANOX1035, IRGANOX1076, IRGANOX1035,IRGANOX1098, IRGANOX1135, IRGANOX1141, IRGANOX1222, IRGANOX1330, IRGANOX1425WL, IRGANOX1520L, IRGANOX245, IRGANOX259, IRGANOX3114, IRGANOX3790, IRGANOX5057, IRGANOX565 (these being products of Ciba Specialty Chemicals), ADK STAB AO-20, ADK STAB AO-30, ADK STAB AO-40, ADK STAB AO-50, ADK STAB AO-60, ADK STAB AO-70 and ADK STAB AO-80 (these being products of Asahi Denka Co., Ltd.), examples of the hindered amine-based antioxidant include Sanol LS2626, Sanol LS765, Sanol LS770, Sanol LS744 (these being products of Sankyo Lifetech Co., Ltd.), Tinuvin 144, Tinuvin 622LD (these being products of Ciba Specialty Chemicals), Mark LA57, Mark LA67, Mark LA62, Mark LA68, Mark LA63 (these being products of Asahi Denka Co., Ltd.) and Sumilizer TPS (product of Sumitomo Chemical Co., Ltd.), examples of the thioether-based antioxidant include Sumilizer TP-D, and examples of the phosphate-based antioxidant include mark 2112, Mark PEP•8, Mark PEP•24G, Mark PEP•36, Mark 329K, Mark HP•10 (these being products of Asahi Denka Co., Ltd.), with hindered phenol-based antioxidants and hindered amine-based antioxidants being particularly preferred. Further, these may be modified with a substituent capable of undergoing cross-linking reaction with a material for forming a cross-linked film, such as an alkoxysilyl group.

Also, a catalyst may be added to, or upon preparation of, the curable resin composition for forming the protective layer 7. As such catalyst, inorganic acids such as hydrochloric acid, acetic acid and sulfuric acid, organic acids such as formic acid, propionic acid, oxalic acid, benzoic acid, phthalic acid and maleic acid, alkali catalysts such as potassium hydroxide, sodium hydroxide, calcium hydroxide, ammonia and triethylamine and, further, solid catalysts insoluble in the system, as shown below, may be used.

Examples of the solid catalyst insoluble in the system include cation-exchange resins such as Amberlite 15, Amberlite 200C, Amberlyst 15E (these being products of Rohm & Haas Co.), Dowex MWC-1-H, Dowex 88, Dowex HCR-W2 (these being products of Dow Chemical Co.), Levatit SPC-108, Levatit SPC-118 (these being products of Bayel), Diaion RCP-150H (product of Mitsubishi Kasei K.K.), Sumikaion KC-470, Duolite C26-C, Duolite C-433, Duolite 464 (these being products of Sumitomo Chemical Co., Ltd.) and Nafion-H (product of E.I. du Pont de Nemours & Co. Inc.); anion-exchange resins such as Amberlite IRA-400, Amberlite IRA-45 (these being products of Rohm & Haas Co.); inorganic solids on which surface is bound a protonic acid group-containing group, such as $Zr(O_3PCH_2CH_2SO_3H)_2$ and $Th(O_3PCH_2CH_2COOH)_2$; polyorganosiloxanes having a protonic acid group, such as sulfonic acid group-containing polyorganosiloxane; heteropoly-acids such as cobalttungsutic acid and phosphomolybdic acid; isopolyacids such as niobic acid, tantalic acid and molybdic acid; monometal oxides such as silica gel, alumina, chromia, zirconia, CaO and MgO; composite metal oxides such as silica-alumina, silica-magnesia, silica-zirconia and zeolites; clay minerals such as acid clay, activated clay, montmorillonite and kaolinite; metal sulfates such as $LiSO_4$ and $MgSO_4$; metal phosphates such as zirconia phosphate and lanthanum phosphate; metal nitrates such as $LiNO_3$, $Mn(NO_3)_2$; inorganic solids to which surface is bound an amino group, such as a solid obtained by reacting aminopropyltriethoxysilane with the surface of silica gel; and amino group-containing polyorganosiloxanes such as amino-modified silicone resin.

Also, use of a solid catalyst insoluble in the photo-functional compound, reaction product, water and solvent upon preparation of the curable resin composition is preferred since it serves to stabilize the coating solution. The solid catalyst insoluble in the system is not particularly limited as long as it is insoluble in the charge transporting substance having the reactive functional group, other additives, water and solvent.

The amount of the solid catalyst insoluble in the system is not particularly limited, but is preferably from 0.1 to 100 parts by weight based on 100 parts by weight of the charge transporting substance having the reactive functional group. Since the solid catalyst is insoluble in the starting compound, reaction product and solvent as described hereinbefore, it can easily be removed in a conventional manner after the reaction.

The reaction temperature and the reaction time are properly selected depending upon kinds and amounts of the starting compounds and the solid catalyst. However, the reaction temperature is usually from 0 to 100° C., preferably from 10 to 70° C., more preferably from 15 to 50° C., and the reaction time is preferably from 10 minutes to 100 hours. In case where the reaction time exceeds the longer limit, gellation tends to arise.

In the case of using the catalyst insoluble in the system upon preparation of the curable resin composition, it is preferred to use in combination a catalyst soluble in the system for the purpose of improving strength and liquid storage stability. As such catalyst, there may be used, in addition to the above-described catalysts, organoaluminum compounds such as aluminum triethylate, aluminum triisopropylate, aluminum tri(sec-butylate), mono(sec-butoxy)aluminum diisopropylate, diisopropoxyaluminum (ethylacetacetate), aluminum tris(ethylacetacetate), aluminum bis(ethylacetacetate) monoacetylacetonate, aluminum tris(acetylacetonate), aluminum diisopropoxy(acetylacetonate), aluminum isopropoxy-bis(acetylacetonate), aluminum tris(trifluoroacetylacetonate) and aluminum tris(hexafluoroacetylacetonate).

Also, organotin compounds such as dibutyltin dilaurylate, dibutyltin dioctiate and dibutyltin diacetate; organotitanium compounds such as titanium tetrakis(acetylacetonate), titanium bis(butoxy)bis(acetylacetonate), titanium bis(isopropoxy)bis(acetylacetonate); and zirconium compounds such as zirconium tetrakis(acetylacetonate), zirconium bis(butoxy)bis(acetylacetonate and zirconium bis(isopropoxy)bis (acetylacetonate) may be used other than the organoaluminum compounds. In view of safety, low cost, and long pot life, use of the organoaluminum compound is preferred, with aluminum chelate compounds being more preferred.

The amount of the catalyst soluble in the system is not particularly limited, but is preferably from 0.1 to 20 parts by weight, particularly preferably from 0.3 to 10 parts by weight, based on 100 parts by weight of the charge transporting substance having the reactive functional group.

Upon forming the protective layer 7 using the organometallic compound as a catalyst, it is preferred to add a polydentate ligand in view of pot life and curing efficiency. Examples of such polydentate ligand include the following ones and the derivatives thereof which, however, are not limitative at all.

Specific examples thereof include bidentate ligands such as β-diketones (e.g., acetylacetone, trifluoroacetylacetone, hexafluoroacetylacetone and dipivaloylmethylacetone), acetoacetates (e.g., methyl acetoacetate and ethyl acetoacetate), bipyridine and the derivatives thereof, glycine and the derivatives thereof, ethylenediamine and the derivatives thereof, 8-hydroxyquinoline and the derivatives thereof, salicylaldehyde and the derivatives thereof, catechol and the derivatives thereof, and 2-hydroxyazo compounds; tridentate ligands such as nitrilotriacetic acid and the derivatives thereof; and hexadentate ligands such as ethylenediaminetetraacetic acid (EDTA) and the derivatives thereof. In addition to the organic ligands as described above, there may be illustrated inorganic ligands such as pyrophosphoric acid and triphosphoric acid. As the polydentate ligand, bidentate ligands are particularly preferred. Specific examples thereof other than the above-described ones include the bidentate ligands shown by the following general formula (XV).

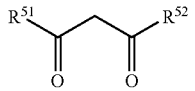

(XV)

In the above formula (XV), $R^{51}$ and $R^{52}$ each independently represents an alkyl group containing from 1 to 10 carbon atoms, a fluoroalkyl group or an alkoxy group containing from 1 to 10 carbon atoms.

As the polydentate ligand, the bidentate ligands represented by the above formula (XV) are preferably used. Of the bidentate ligands, those ligands wherein $R^{51}$ and $R^{52}$ in the formula (XV) are the same are particularly preferred. The coordinating force of the ligand at near room temperature is strengthened when $R^{51}$ and $R^{52}$ are the same, which serves to ensure further stabilization of the curable resin composition.

The amount of the polydentate ligand to be used can arbitrarily be selected, but is preferably 0.01 mol or more, more preferably 0.1 mol or more, particularly preferably 1 mol or more, per mol of the organometallic compound to be used.

The protective layer 7 is formed by using the curable resin composition containing the constituting materials as a coating solution for forming the protective layer.

The curable resin composition containing the above-described constituents can be prepared without using any solvent or using, as needed, a solvent such as an alcohol (e.g., methanol, ethanol, propanol or butanol), a ketone (e.g., acetone or methyl ethyl ketone) or an ether (e.g., tetrahydrofuran, diethyl ether or dioxane). Such solvents may be used independently or in combination of two or more thereof. Solvents having a boiling point of 100° C. or lower than that are preferred. The amount of the solvent to be used can arbitrarily be determined but, in case where the solvent amount is too small, the charge transporting substance having the reactive functional group becomes liable to precipitate. Thus, the solvent is used in an amount of preferably from 0.5 to 30 parts by weight, more preferably from 1 to 20 parts by weight, based on 1 part by weight of the charge transporting substance having the reactive functional group.

The reaction temperature and the reaction time employed upon curing the curable resin composition are not particularly limited but, in view of mechanical strength and chemical stability of the resulting protective layer 7, the reaction temperature is preferably 60° C. or higher, more preferably from 80 to 200° C., and the reaction time is preferably from 10 minutes to 5 hours. Also, it is preferred to maintain the protective layer 7 obtained by curing the curable resin composition in a highly humid state is effective in view of stabilizing characteristic properties of the protective layer 7. Further, the protective layer 7 may be made hydrophobic by surface-treating with hexamethyldisilazane or trimethylchlorosilane depending upon the end use.

In the case of coating the curable resin composition on the charge generating layer 6, a common coating method such as a blade coating method, a wire bar coating method, a spray coating method, a dip coating method, a bead coating method, an air knife coating method or a curtain coating method may be employed as the coating method.

Additionally, in the case where a necessary film thickness cannot be obtained by one coating procedure, coating procedure may be repeated plural times till the necessary film thickness is obtained. In the case of conducting coating procedure plural times, heating treatment may be conducted for each coating procedure or after conducting coating procedure plural times.

The thickness of the protective layer 7 is preferably from 0.5 to 15 μm, more preferably from 1 to 10 μm, still more preferably from 1 to 5 μm.

Additionally, the electrophotographic photoreceptor of the invention is not limited to the above-described embodiment. For example, the subbing layer 4 is not necessarily provided in the electrophotographic photoreceptor of the invention.

Figure 2:
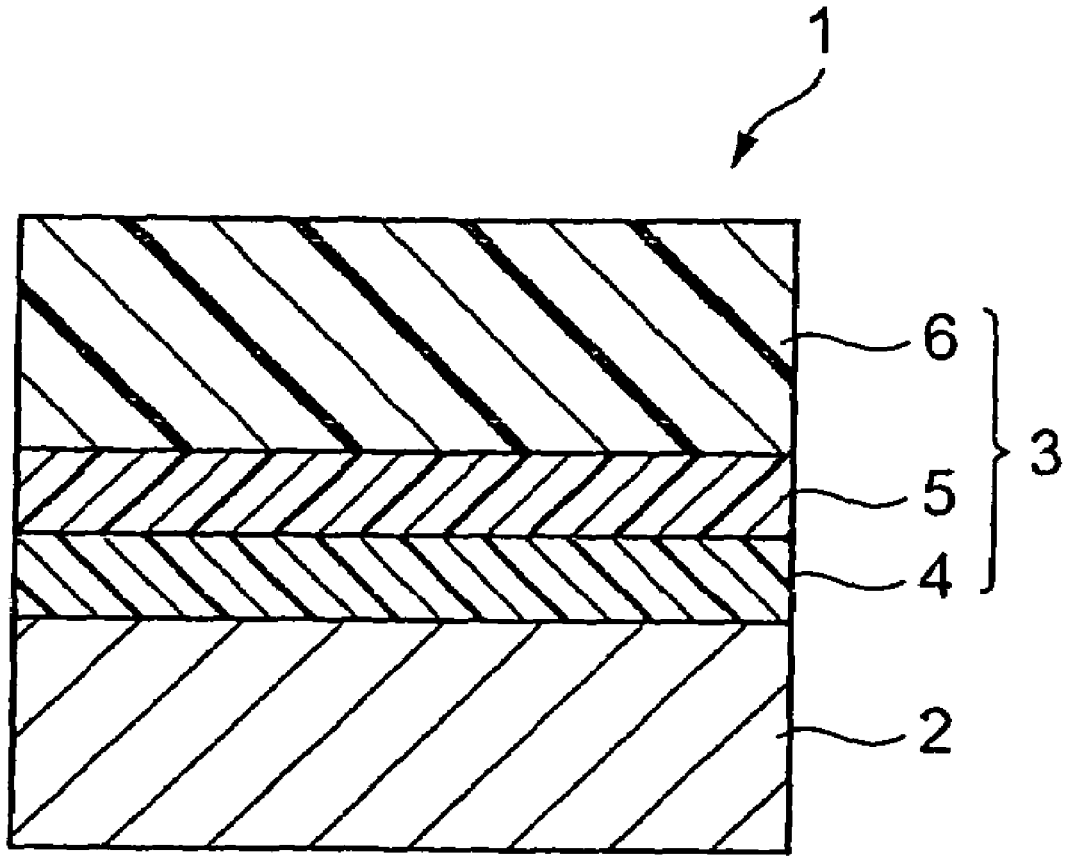
FIG. 2 is a schematic view showing another preferred embodiment of the electrophotographic photoreceptor of the invention.

The electrophotographic photoreceptor shown in FIG. 1 has the protective layer 7 comprising a cured product of a curable resin composition containing an alcohol soluble, curable resin and a polyether-modified silicone oil. In the case where the curable resin composition contains a charge transporting substance having a reactive functional group, the resultant cured product has an enough photo-electric properties as well as excellent mechanical strength, and thus it can be used as a charge transporting layer of a lamination type photoreceptor. An example of such electrophotographic photoreceptor is shown in FIG. 2. The electrophotographic photoreceptor 1 shown in FIG. 2 has a structure wherein a subbing layer 4, a charge generating layer 5 and a charge transporting layer 6 are layered in this order on a conductive support 2. The charge transporting layer 6 is a surface layer constituted by a cured product of the curable resin composition containing the alcohol-soluble, curable resin and the polyether-modified silicone oil. Additionally, the subbing layer 4 and the charge-generating layer 5 on the conductive support 2 are the same as with the electrophotographic photoreceptor shown in FIG. 1 (hereinafter the same).

Figure 3:
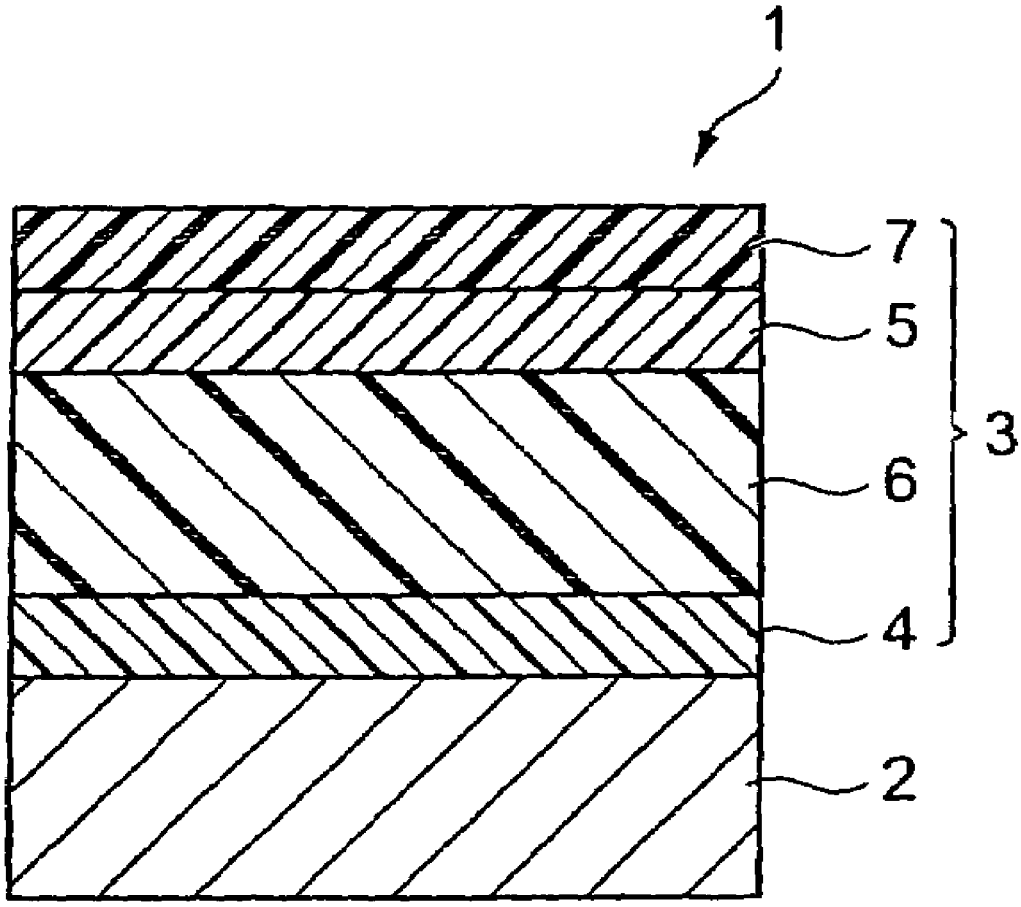
FIG. 3 is a schematic view showing other preferred embodiment of the electrophotographic photoreceptor of the invention.

Also, the laminating order of the charge generating layer 5 and the charge transporting layer 6 may be reverse to the order in the above-described embodiment. One example of such electrophotographic photoreceptor is shown in FIG. 3. The electrophotographic photoreceptor shown in FIG. 3 has a structure wherein a subbing layer 4, a charge transporting layer 6, a charge generating layer 5 and a protective layer 7 are laminated in this order on a conductive support 2. The protective layer 7 is the outermost layer comprising a cured product of the curable resin composition containing the alcohol-soluble, curable resin and the polyether-modified silicone oil.

The electrophotographic photoreceptor shown in FIG. 1 is of a function-separating type, but the electrophotographic photoreceptor of the invention may be of a type which has a layer containing both the charge generating substance and the charge transporting substance (charge generating/charge transporting layer). Examples of an electrophotographic photoreceptor having a mono-layer type photo-sensitive layer are shown in FIGS. 4 and 5.

Figure 4:
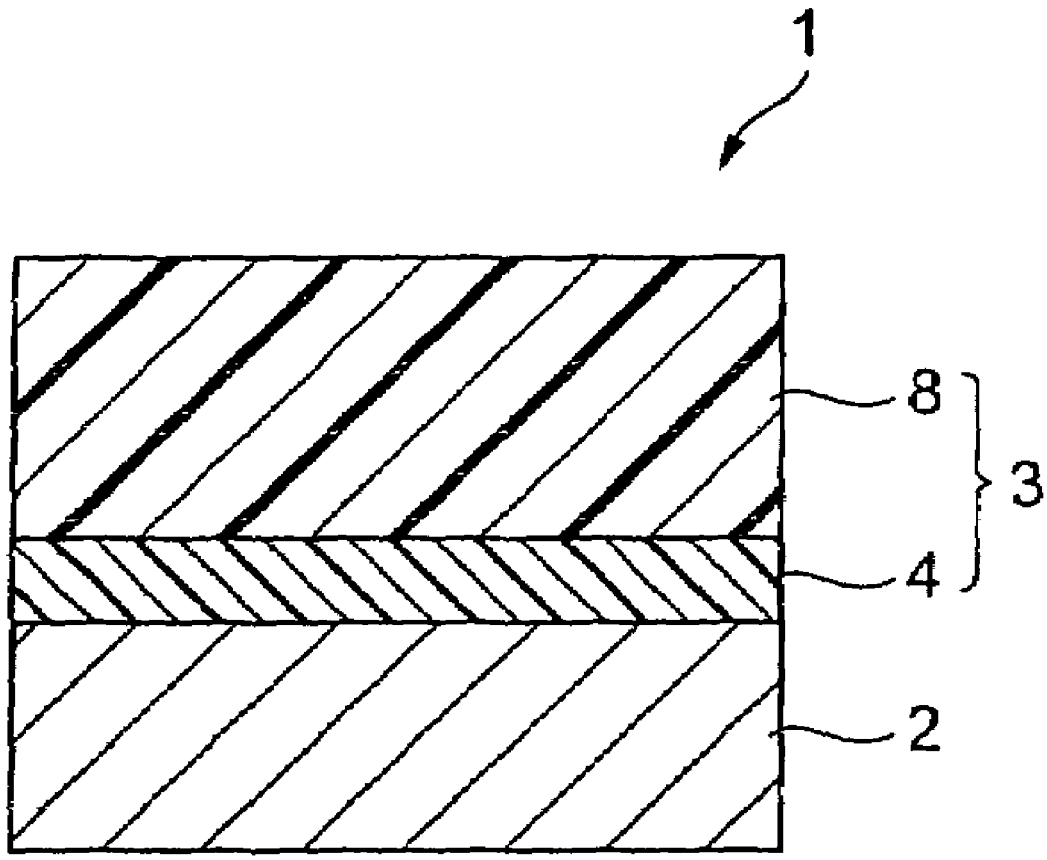
FIG. 4 is a schematic view showing other preferred embodiment of the electrophotographic photoreceptor of the invention.

The electrophotographic photoreceptor 1 shown in FIG. 4 has a structure wherein a subbing layer 4 and a charge generating/charge teransporting layer 8 are laminated in this order on the surface of a conductive support 2, with the charge generating/charge transporting layer 8 being the outermost layer. This charge generating/charge transporting layer 8 can be formed by using a coating solution prepared by compounding a charge generating substance and a charge transporting substance (preferably a compound having a reactive functional group) and, as needed, a binder resin other than the alcohol-soluble, curable resin and other additives in the curable resin composition containing the alcohol-soluble, curable resin and the polyether-modified silicone oil. As the charge generating substance, the same charge generating substances as are-used in the charge generating layer of the function-separating type photo-sensitive layer may be used. As the binder resin other than the alcohol-soluble, curable resin, polyvinyl acetal resins such as a polyvinyl butyral resin, a polyvinyl formal resin and a partially acetallized polyvinyl acetal resin wherein part of butyral is modified with formal or acetacetal (e.g., S-LEC B, K, manufactured by Sekisui Chemical Co., Ltd., etc.), polyamide resins and cellulose resins may be used. The content of the charge generating substance in the charge generating/charge transporting layer 8 is preferably from 10 to 85% by weight, more preferably from 20 to 50% by weight, based on the total weight of the solid components in the charge generating/charge transporting layer 8. To the charge generating/charge transporting layer 8 may be added a charge transporting material or a high-molecular charge transporting material for the purpose of improving photo-electric properties. The addition amount thereof is preferably from 5 to 50% by weight based on the total weight of the solid components in the charge generating/charge transporting layer 8. As a solvent for coating and a coating method, the same ones as those with the above-described layers may be used. The thickness of the charge generating/charge transporting layer 8 is preferably from about 5 to about 50 μm, more preferably from 10 to 40 μm.

Figure 5:
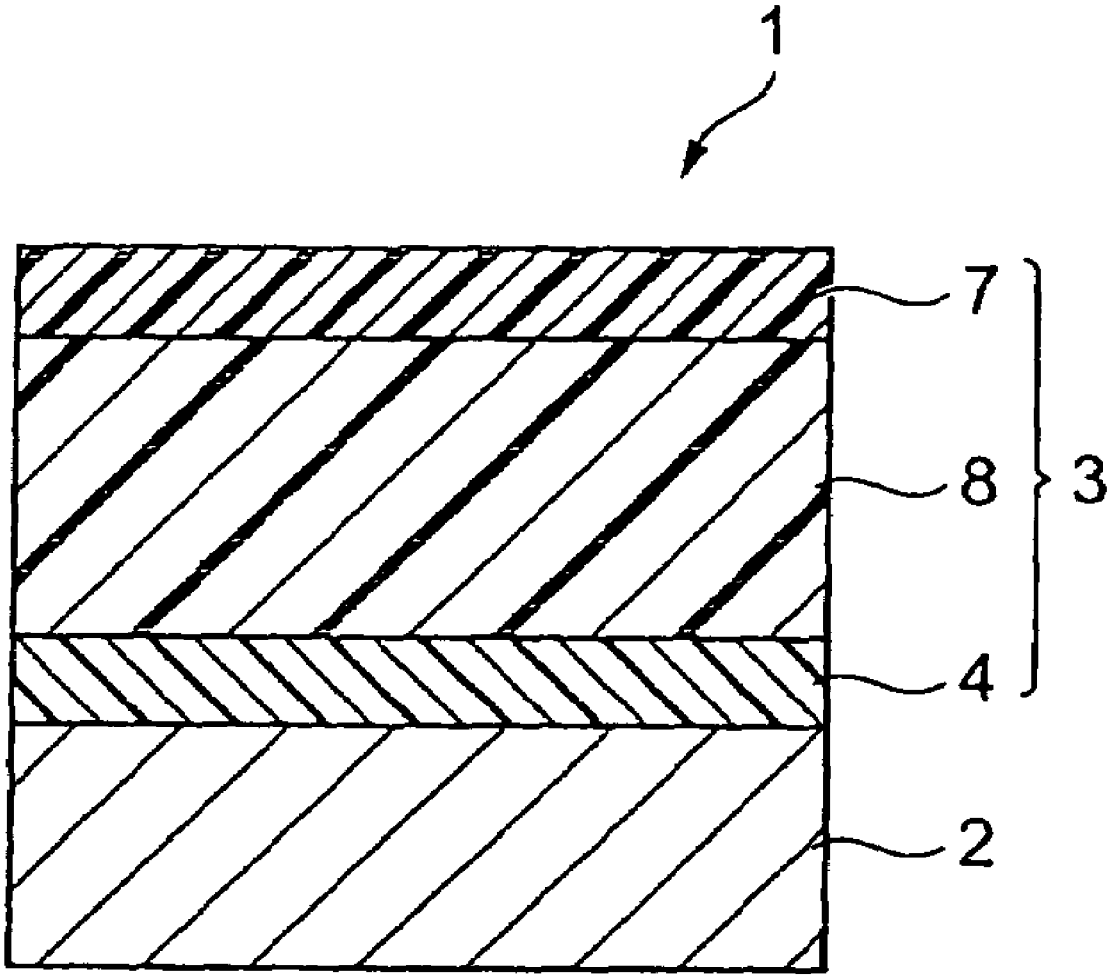
FIG. 5 is a schematic view showing other preferred embodiment of the electrophotographic photoreceptor of the invention.

Also, the electrophotographic photoreceptor 1 shown in FIG. 5 has a structure wherein a subbing layer 4, a charge generating/charge transporting layer 8 and a protective layer 7 are laminated in this order on a conductive support 2, with the protective layer 7 being a surface layer comprising a cured product of a curable resin composition containing an alcohol-soluble, curable resin and a polyether-modified silicone oil.

(Image-Forming Device, Process Cartridge and Image-Forming Method)

Figure 6:
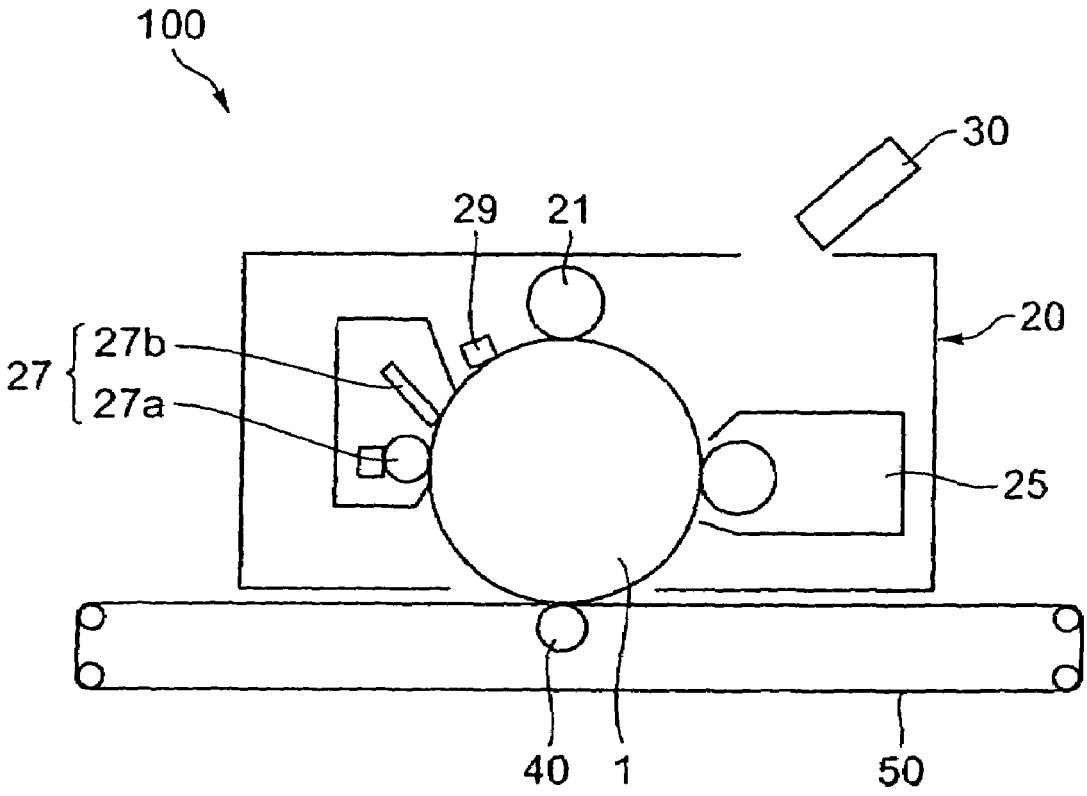
FIG. 6 is a schematic view showing one preferred embodiment of the image-forming device of the invention.

FIG. 6 is a schematic view showing a preferred embodiment of an image-forming device of the invention. The image-forming device 100 shown in FIG.FIG 6 is provided within an image-forming apparatus (not shown) and has a process cartridge 20 equipped with the electrophotographic photoreceptor 1 of the invention, an exposing device 30, a transferring device 40 and an intermediate transfer body 50. Additionally, in the image-forming device 100, the exposing device 30 is disposed at a position where it is possible for the exposing device to expose the electrophotographic photoreceptor through an opening of the process cartridge 20, the transferring device 40 is disposed at a position facing the electrophotographic photoreceptor 1 via the intermediate transfer body 50, and the intermediate transfer body 50 is disposed so that a part thereof can be in contact with the electrophotographic photoreceptor 1.

The process cartridge 20 is formed by assembling the electrophotographic photoreceptor 1, the charging device 21, the developing device 25, the cleaning device 27 and a fibrous member (of toothbrush shape) 29 within a case using fixing rails. Additionally, the case has an opening for exposure.

Here, the charging device 21 is a device for charging the electrophotographic photoreceptor 1 in a contact manner. The developing device 25 is a device for developing a electrostatic latent image on the electrophotographic photoreceptor 1 to form a toner image.

The toner to be used in the developing device 25 is described below. As such toner, a toner of 100 to 150 in average shape coefficient ($ML^2/A$) is preferred, with 100 to 140 being more preferred. Further, the toner has an average particle size of preferably from 2 to 12 μm, more preferably from 3 to 12 μm, still more preferably from 3 to 9 μm. Use of a toner having such average shape coefficient and average particle size can provide an image having high developing properties, transfer properties and high image quality.

The toner is not particularly limited as to the production process thereof as long as it has an average shape coefficient and an average particle size within the above-described ranges. For example, toners to be used are produced by a knead-pulverizing process of kneading a binder resin, a colorant, a parting agent and, as needed, a charge-controlling agent, pulverizing the mixture and classifying the pulverized product; a process of applying a mechanical impact or a heat energy to the particles obtained by the knead-pulverizing process to thereby change the shape thereof; an emulsion polymerization-agglomeration process wherein a polymerizable monomer of a binder resin is emulsion-polymerized, the resultant dispersion is mixed with a dispersion of a colorant, a parting agent and, as needed, a charge-controlling agent, agglomerating and heat-fusing to obtain toner particles; a suspension polymerization process wherein a solution of a polymerizable monomer for obtaining a binder, a colorant, a parting agent and, as needed, a charge-controlling agent is suspended in an aqueous solvent and polymerization is conducted; or a dissolution-suspension process wherein a binder resin and a solution of a colorant, a parting agent and, as needed, a charge-controlling agent are suspended in an aqueous solvent, followed by granulation.

In addition, known processes such as a production process of producing a toner of a core-shell structure by depositing agglomerated particles around the toner particles obtained by the above-described processes, followed by heat-fusing the deposited particles may be employed. Additionally, as the process for producing a toner, the suspension polymerization process, the emulsion polymerization-agglomeration process and the dissolution-suspension process are preferred in view of controlling shape and particle size distribution, with the emulsion polymerization-agglomeration process being particularly preferred.

The toner mother particles comprise a binder resin, a colorant and a parting agent and, as needed, silica or a charge-controlling agent.

Examples of the binder resin to be used for the toner mother particles include homopolymers and copolymers of styrenes such as styrene and chlorostyrene, mono-olefins such as ethylene, propylene, butylenes and isoprene, vinyl esters such as vinyl acetate, vinyl propionate, vinyl benzoate and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone; and polyester resins obtained by copolymerization between a dicarboxylic acid and a diol.

Typical examples of the binder resin include polystyrene, styrene-alkyl acrylate copolymer, styrene-alkyl methacrylate copolymer, styrene-acrylonitrile copolymer, styrene-butadiene copolymer, styrene-maleic acid anhydride copolymer, polyethylene, polypropylene and polyester resin. Further, there may be illustrated polyurethane, epoxy resin, silicone resin, polyamide, modified rosin and paraffin wax.

Typical illustrative examples of the colorant include magnetic powder (e.g., magnetite or ferrite), carbon black, Aniline Blue, Calyl Blue, chrome yellow, ultramarine blue, du Pont Oil Red, Quinoline Yellow, Methylene Blue Chloride, Phthalocyanine Blue, Malachite Green Oxalate, lamp black, Rose Bengale, C.I. Pigment Red 48:1, C.I. Pigment Red 122, C.I. Pigment Red 57:1, C.I. Pigment Yellow 97 C.I. Pigment Yellow 17, C.I. Pigment Blue 15:1, and C.I. Pigment Blue 15:3.

As typical examples of the parting agent, there may be illustrated low-molecular polyethylene, low-molecular polypropylene, Fischer-Tropsch wax, montan wax, carnauba wax, rice wax and candelilla wax.

As the charge-controlling agent, known ones may be used, and azo-based metal complex compounds, metal complex compounds of salicylic acid, resin type charge-controlling agents having a polar group may be used. In the case of producing a toner by a wet production process, materials slightly soluble in water is preferably used in view of controlling ionic strength and reducing pollution of waste liquor. As the toner, either of a magnetic toner containing a magnetic material and a non-magnetic toner not containing a magnetic material may be employed.

The toner to be used in the developing device 25 may be produced by mixing the above-mentioned toner mother particles and the external additive in a Henschel mixer or a V-blender. In the case of producing the toner mother particles by a wet process, the external addition may be conducted in a wet manner.

Lubricating particles may be added to the toner to be used in the developing device 25. As the lubricating particles, there may be used solid lubricants such as grapahite, molybdenum disulfide, talk, fatty acid and metal salt of fatty acid; low molecular weight polyolefins such as polypropylene, polyethylene and polybutene; silicones having a softening point reachable by heating; aliphatic amides such as oleic acid amide, erucic acid amide, ricinoleic acid amide and stearic acid amide; plant waxes such as carnauba wax, rice wax, candelilla wax, Japan wax and jojoba oil; animal waxes such as bees wax, mineral or petroleum waxes such as montan wax, ozocerite, ceresine, paraffin wax, microcrystalline wax and Fischer-Tropsch wax; and modified products thereof. These may be used independently or in combination of two or more thereof. The average particle size thereof is in the range of preferably from 0.1 to 10 μm. The particle size may be made uniform by pulverizing the material of the above-described chemical structure. The addition amount thereof to a toner is in the range of preferably from 0.05 to 2.0% by weight, more preferably from 0.1 to 1.5% by weight.

To the toner to be used in the developing device 25 may be added inorganic fine particles, organic fine particles or composite fine particles obtained by depositing inorganic fine particles on the organic fine particles for the purpose of removing a deposit or a deteriorated material on the surface of the electrophotographic photoreceptor.

As the inorganic fine particles, particles of various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, titanium carbide, silicon carbide, titanium carbide and boron carbide are preferably used.

Also, the inorganic fine particles may be treated with a titanium coupling agent such as tetrabutyl titanate, tetraoctyl titanate, isopropyltriisostearoyl titanate, isopropyltridecylbenzenesulfonyl titanate and bis(dioctylpyrophosphato)oxyacetatotitanate or a silane coupling agent such as γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, oxtyltrimethoxysilane, decyltrimethoxysilane, dodecyltrimethoxysilane, phenyltrimethoxysilane, o-methylphenyltrimethoxysilane or p-methylphenyltrimethoxysilane. Also, those which have been subjected to hydrophobicity-imparting treatment with silicone oil or a metal salt of higher fatty acid such as aluminum stearate, zinc stearate or calcium stearate may preferably be used.

Examples of the organic fine particles include styrene resin particles, styrene-acryl resin particles, olyester particles and urethane resin particles.

The fine particles to be used have an average particle size of preferably from 5 nm to 1,000 nm, more preferably from 5 nm to 800 nm, still more preferably from 5 nm to 700 nm. In case where the average particle size is less than the lower limit, there tends to result an insufficient abrading ability whereas, in case where the average particle size exceeds the upper limit, the surface of the electrophotographic photoreceptor tends to suffer formation of scratches. The sum of the addition amount of the particles and the addition amount of the lubricating particles is preferably 0.6% by weight or more.

As other inorganic oxide particles to be added to the toner, inorganic oxide particles of 40 nm or less in primary particle size are preferably used for improving fluidity of the powder and controlling charge, and inorganic oxide particles having a larger particle size are preferably added for the purpose of reducing adhesion force or controlling charge. As the inorganic oxide particles, known ones may be used but, in order to accurately control charge, combined use of silica and titanium oxide is preferred. The inorganic fine particles with a smaller particle size acquire a higher dispersiblity when surface-treated, which serves to enhance fluidity. Further, addition of a carbonate such as calcium carbonate or magnesium carbonate or an inorganic mineral such as hydrotalcite is preferred to remove a material produced by discharge.

Color toners for electrophotography are used as a mixture with a carrier. As such carrier, iron powder, glass beads, ferrite powder, nickel powder or those which are obtained by coating the surface thereof with a resin may be used. The mixing ratio with the carrier can properly be determined.

The cleaning device 27 has a fibrous member (in a roll shape) 27*a* and a cleaning blade (blade member) 27*b*.

Although the cleaning device 27 has a fibrous member 27*a* and a cleaning blade 27*b*, a cleaning device having either one may also be employed. The fibrous member 27*a* may be in a toothbrush shape as well as in a roll shape. The fibrous member 27*a* may be fixed to the cleaning device body or may be rotatably supported or, further, may be supported in a state of being oscillatable in the axis direction of the photoreceptor. As the fibrous member 27*a*, there may be illustrated a cloth-made member comprising polyester, nylon acryl or extremely fine fibers such as Toraysee (made by Toray Industries Inc.) and a brush-shaped member obtained by filling fibers of resins such as nylon, acryl, polyolefin or polyester into a substrate or in a carpet shape. Also, as the fibrous member 27*a*, those which are obtained by compounding a conductive powder or an ionic conductive agent in the fibers of the above-mentioned members or forming a conductive layer inside or outside each fiber of the members may also be used. In the case of imparting conductivity, the resistance per fiber is preferably from $10^2$ to $10^9$ Ω. The thickness of the fibers constituting the fibrous member 27*a* is preferably 30 d (denier) or less, more preferably 20 d or less, and the density of the fibers is 20,000 fibers/inch$^2$ or more, more preferably 30,000 fibers/inch$^2$ or more.

The cleaning device 27 is required to remove deposits (e.g., products produced by discharge) on the surface of the photoreceptor by means of the cleaning blade and/or the cleaning brush. In order to attain this object over a long period of time and stabilize ability of the cleaning member, it is preferred to supply a lubricating substance (lubricating component) such as a metallic soap, a higher alcohol, a wax or a silicone oil for the cleaning member.

In the case of using, for example, a roll-shaped member as the fibrous member 27*a*, the member is preferably brought into contact with a lubricating substance such as a metallic soap or a wax to thereby supply the lubricating component for the surface of the electrophotographic photoreceptor. As the cleaning blade 27*b*, a common rubber blade is used. In the case of using a rubber blade as the cleaning blade 27*b*, it is particularly effective in view of depressing cut or wear of the blade to supply the surface of the electrophotographic photoreceptor with the lubricating component.

The process cartridge 20 so far described is detachable from the body of the image-forming device, and constitutes the image-forming device together with the body of the image-forming device.

As the exposing device 30, any exposing device that can expose the charged electrophotographic photoreceptor 1 to form an electrostatic latent image may be employed. As a light source in the exposing device 30, a multi-beam system vertical-cavity surface-emitting laser is preferred.

As the transferring device 40, any transferring device that can transfer a toner image on the electrophotographic photoreceptor 1 to a transfer medium (intermediate transfer body 50) may be employed. For example, a commonly used roll-shaped one is used.

As the intermediate transfer body 50, a belt-shaped body (intermediate transfer belt) made of polyimide, polyamidimide, polycarbonate, polyarylate, polyester or rubber, to which semi-conductivity has been imparted, is used. As to the shape of the intermediate transfer body 50, a drum-shaped body may be used as well as the belt-shaped body. Additionally, there is a direct-transfer system image-forming device not having the intermediate transfer body. The electrophotographic photoreceptor of the invention is also suited for such image-forming device Because, in the direct-transfer system image-forming device, paper powder or talc is generated from the printing paper and is liable to deposit onto the electrophotographic photoreceptor, thus image defects due to the deposits being liable to result. In the electrophotographic photoreceptor of the invention, however, it is easy to remove paper powder or talc therefrom owing to the excellent cleaning properties of the photoreceptor. Thus, even when employed for the direct-transfer system image-forming device the photoreceptor can provide a stable image.

Additionally, the transfer medium to be employed in the invention is not particularly limited as long as it can transfer thereon the toner image formed on the electrophotographic photoreceptor 1. For example, in the case of transferring a toner image directly onto paper from the electrophotographic photoreceptor 1, paper is the transfer medium and, in the case of using the intermediate transfer body 50, the intermediate transfer body becomes the transfer medium.

Figure 7:
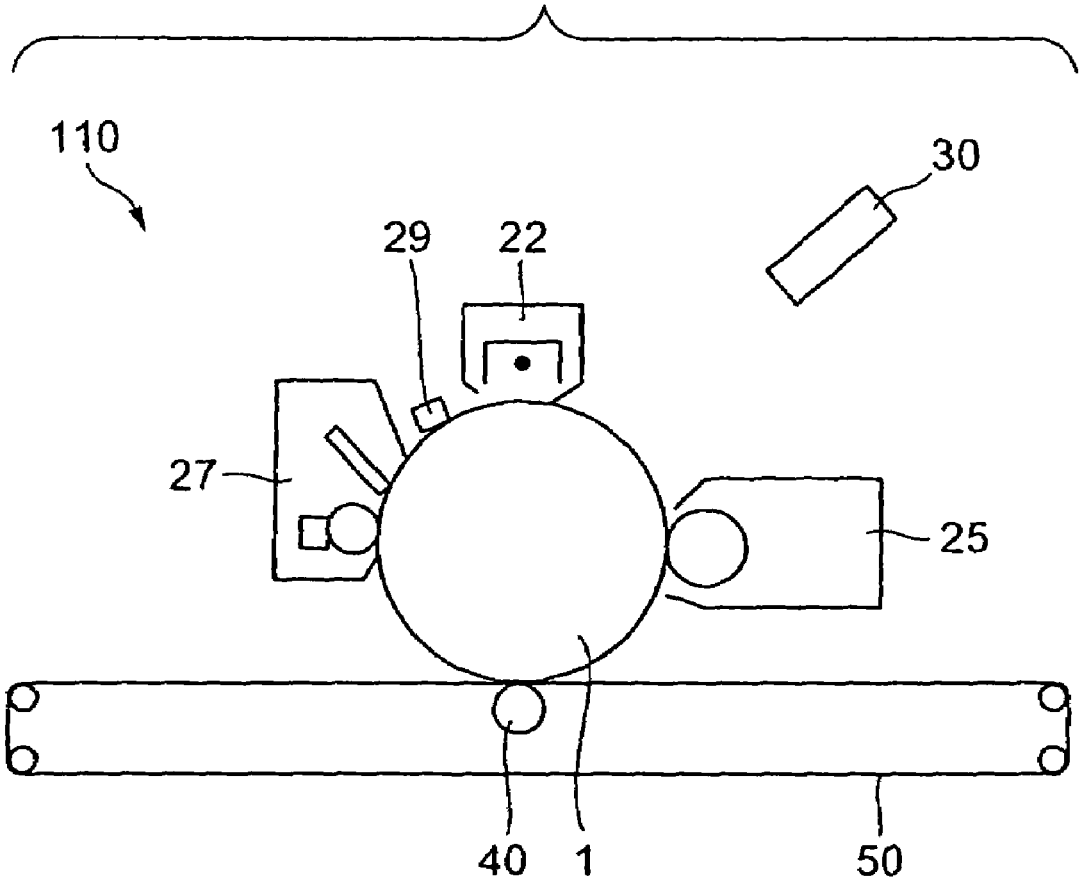
FIG. 7 is a schematic view showing other preferred embodiment of the image-forming device of the invention.

FIG. 7 is a schematic view showing another embodiment of the image-forming device of the invention. In the image-forming device 110 shown in FIG. 7, the electrophotographic photoreceptor 1 is fixed to the body of the image-forming device, and each of the charging device 22, the developing device 25 and the cleaning device 27 is in a cartridge form, thus they being independently provided as a charging cartridge, a developing cartridge and a cleaning cartridge, respectively. Additionally, the charging device 22 has a charging device of corona discharge system.

In the image-forming device 110, the electrophotographic photoreceptor 1 is separated from other devices, and the charging device 22, developing device 25 and cleaning device 27 are not fixed to the body of the image-forming device by machine screws, caulking, adhesion or welding but are detachably fixed so that they can be detached by drawing or mounted by pushing.

Since the electrophotographic photoreceptor of the invention has an excellent wear resistance, it is not in some cases necessary to constitute it as a cartridge. Therefore, cost required for the members per print can be reduced by employing the structure wherein the charging device 22, developing device 25 and cleaning device 27 are not fixed to the body of the image-forming device by machine screws, caulking, adhesion or welding but are detachably fixed so that they can be detached by drawing or mounted by pushing. It is also possible to integrate two or more of the devices into one cartridge which is made detachable, thus costs on the members per print being able to be more reduced.

Additionally, the image-forming device 110 has the same constitution as that of the image-forming device 100 except that the charging device 22, the developing device 25 and the cleaning device 27 are respectively in a cartridge form.

Figure 8:
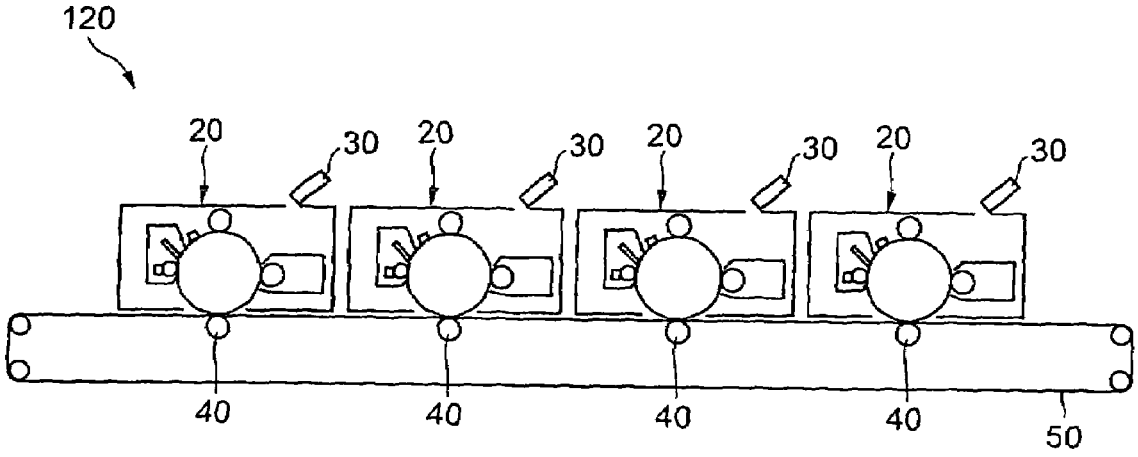
FIG. 8 is a schematic view showing other preferred embodiment of the image-forming device of the invention.

FIG. 8 is a schematic view showing other embodiment of the image-forming device of the invention. The image-forming device 120 is a tandem system full-color image-forming device having 4 process cartridges 20. The image-forming device 120 has a structure wherein 4 process cartridges are juxtaposed on the intermediate transfer body 50, with one electrophotographic photoreceptor being used for one color. Additionally, the image-forming device 120 has the same constitution as with the image-forming device 100 except for the tandem system.

In the tandem system image-forming device 120, the electrophotographic photoreceptors become different from each other in the abrasion amount depending upon the amounts of respective color toners used, which tends to result in different electric properties of respective electrophotographic photoreceptors. Thus, developing properties of the toners tend to undergo gradual change from the initial properties and cause change in tint of printed images, leading to forming unstable images. In particular, since a small-diameter electrophotographic photoreceptor tends to be employed for reducing the size of the image-forming device, the above-mentioned tendency becomes serious when a small-diameter electrophotographic photoreceptor of 30 mmΦ or less is used. However, when the electrophotographic photoreceptor of the invention is employed as the electrophotographic photoreceptor, abrasion of the surface thereof can sufficiently be depressed even if the diameter is 30 mmΦ or less. Accordingly, the electrophotographic photoreceptor of the invention is particularly effective in the tandem system image-forming device.

Figure 9:
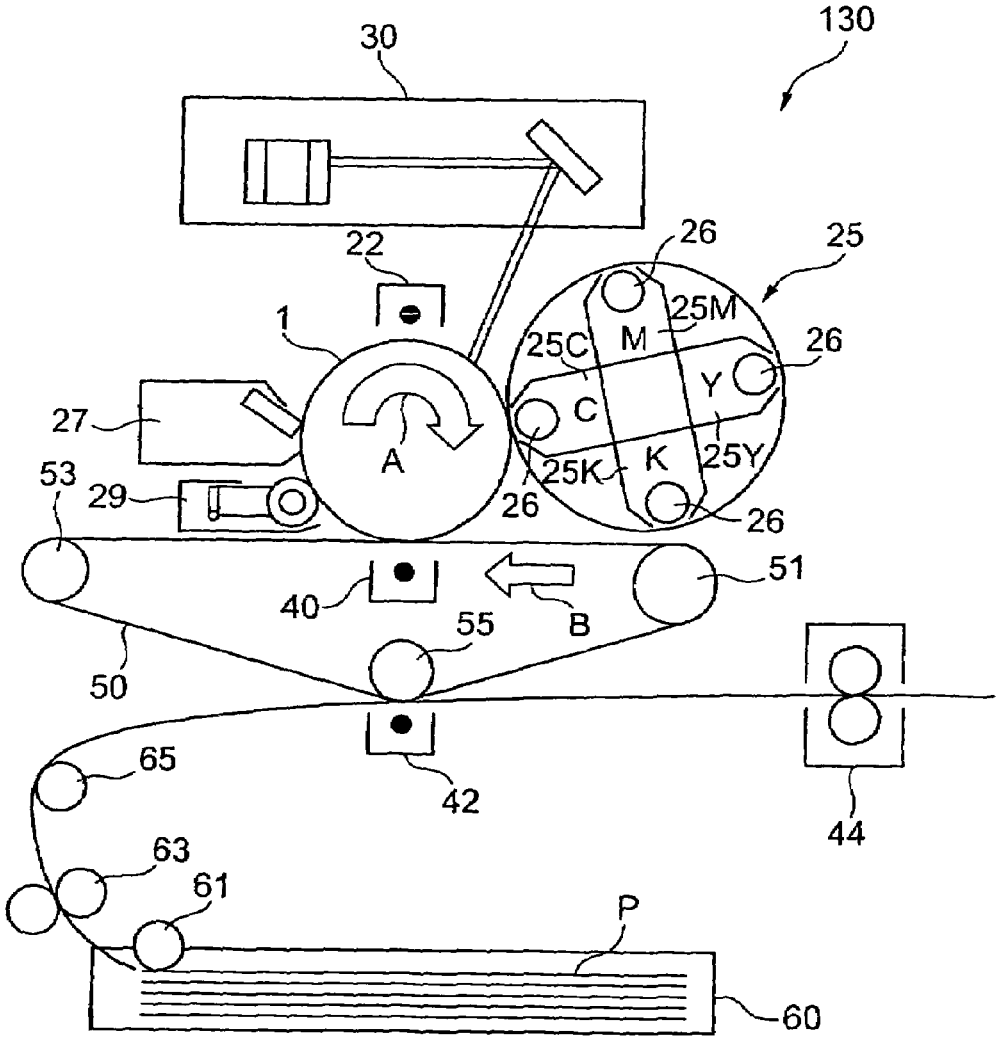
FIG. 9 is a schematic view showing other preferred embodiment of the image-forming device of the invention.

FIG. 9 is a schematic view showing other embodiment of the image-forming device of the invention. The image-forming device 130 shown by FIG. 9 is a so-called 4-cycle system image-forming device wherein plural colors of toner images are formed by one electrophotographic photoreceptor. The image-forming device 130 is equipped with a photoreceptor drum 1 to be rotated at a predetermined rotation speed by means of a driving device (not shown) in the direction shown by arrow A, with a charging device 22 for charging the peripheral surface of the photoreceptor drum 1 over the photoreceptor drum 1.

Also, an exposing device 30 having a vertical-cavity surface-emitting laser array as an exposing light source is provided over the charging device 22. The exposing device 30 scans the peripheral surface of the photoreceptor drum 1 with a plurality of laser beams modulated according to an image to be formed, polarized in the main scanning direction and emitted from the light source in a direction parallel to the axis of the photoreceptor drum 1. Thus, an electrostatic latent image is formed on the peripheral surface of the charged photoreceptor drum 1.

A developing apparatus 25 is disposed on one side of the photoreceptor drum 1. The developing apparatus 25 has a rotatably disposed roller-shaped container. Four containing sections are formed within the container, with each containing section having a developing device 25Y, 25M, 25C or 25K. Each of the developing devices 25Y, 25M, 25C and 25K has a developing roller 26, and contains a toner of a color of Y, M, C or K.

Formation of a full-color image in the image-forming device 130 proceeds while the photoreceptor drum 1 rotates 4 times. That is, while the photoreceptor drum 1 rotates 4 times, the charging device 22 repeats the procedure of charging the peripheral surface of the photoreceptor drum 1, and the exposing device 30 repeats the procedure of scanning the peripheral surface of the photoreceptor drum 1 with a laser beam modulated according to an image data of one of Y, M C and K on a color image to be formed and changing the image data to be used for modulating the laser beam every time the photoreceptor drum rotates one time. The developing apparatus 25 repeats the procedure of operating the developing device facing the peripheral surface among the developing devices 25Y, 25M, 25C and 25K, with the developing roller 26 of the particular developing device facing the peripheral surface of the photoreceptor drum 1, to thereby develop the electrostatic latent image formed on the peripheral surface of the photoreceptor drum 1 with a specific color and form a specific color toner image on the photoreceptor drum 1 every time the photoreceptor drum 1 rotates one time while rotating the container at the end of each developing procedure so that the developing device to be used for development of the electrostatic latent image is switched. Thus, toner images of Y, M, C and K are formed in order, one over the other, on the peripheral surface of the photoreceptor drum 1 each time the photoreceptor drum 1 rotates and, at the point when the photoreceptor drum 1 rotates 4 times, a full-color toner image is formed on the peripheral surface of the photoreceptor drum 1.

Also, an endless intermediate transfer belt 50 is disposed about just under the photoreceptor drum 1. The intermediate transfer belt 50 is placed around rollers 51, 53 and 55 so that the outer surface is in contact with the peripheral surface of the photoreceptor drum 1. The rollers 51, 53 and 55 are driven to rotate by a driving force of a motor not shown so that they rotate the intermediate transfer belt 50 in the direction shown by arrow B in FIG. 9.

On the opposite side of the photoreceptor drum 1 with respect to the intermediate transfer belt 50 is disposed a transfer device 40. The toner images formed on the peripheral surface of the photoreceptor drum 1 are transferred to the image-forming surface of the intermediate transfer belt 50 by means of a transferring device 40.

On the opposite side of the developing device 25 with respect to the photoreceptor drum 1 are disposed a lubricant-supplying device 29 and a cleaning device 27 facing the peripheral surface of the photoreceptor drum 1. When the toner images formed on the peripheral surface of the photoreceptor drum 1 are transferred to the intermediate transfer belt 50, a lubricant is supplied for the peripheral surface of the photoreceptor drum 1 by means of the lubricant-supplying device 28, and regions of the peripheral surface which have carried the transferred toner images is cleaned by means of the cleaning device 27.

A tray 60 is disposed under the intermediate transfer belt 50, and many sheets of paper P as a recording material are retained in a stacked state. A take-up roller 61 is disposed at a position left and obliquely above the tray 60, and a pair of rollers 63 and a roller 65 are disposed in order on the downstream side in the direction of taking up paper P by the take-up roller 61. A recording paper positioned at the uppermost position in the stacked state is taken up from the tray 60 by rotation of the take-up roller 61, then conveyed by means of a pair of the rollers 63 and the roller 65.

On the opposite side of the roller 55 with respect to the intermediate transfer belt 50 is disposed a transfer device 42. The paper P conveyed by means of a pair of rollers 63 and the roller 65 is sent between the intermediate transfer belt 50 and the transferring device 42, and the toner images formed on the image-forming side of the intermediate transfer belt 50 are transferred by means of the transferring device 42. A fixing device 44 having a pair of fixing rollers is disposed on the downstream side of the transfer device 42 in the direction of conveying paper P. The paper P onto which the toner images have been transferred is discharged out of the housing of the image-forming device 130 after the transferred toner images are melt-fixed by means of the fixing device 44, then placed on a tray for discharged paper (not shown).

Figure 10:
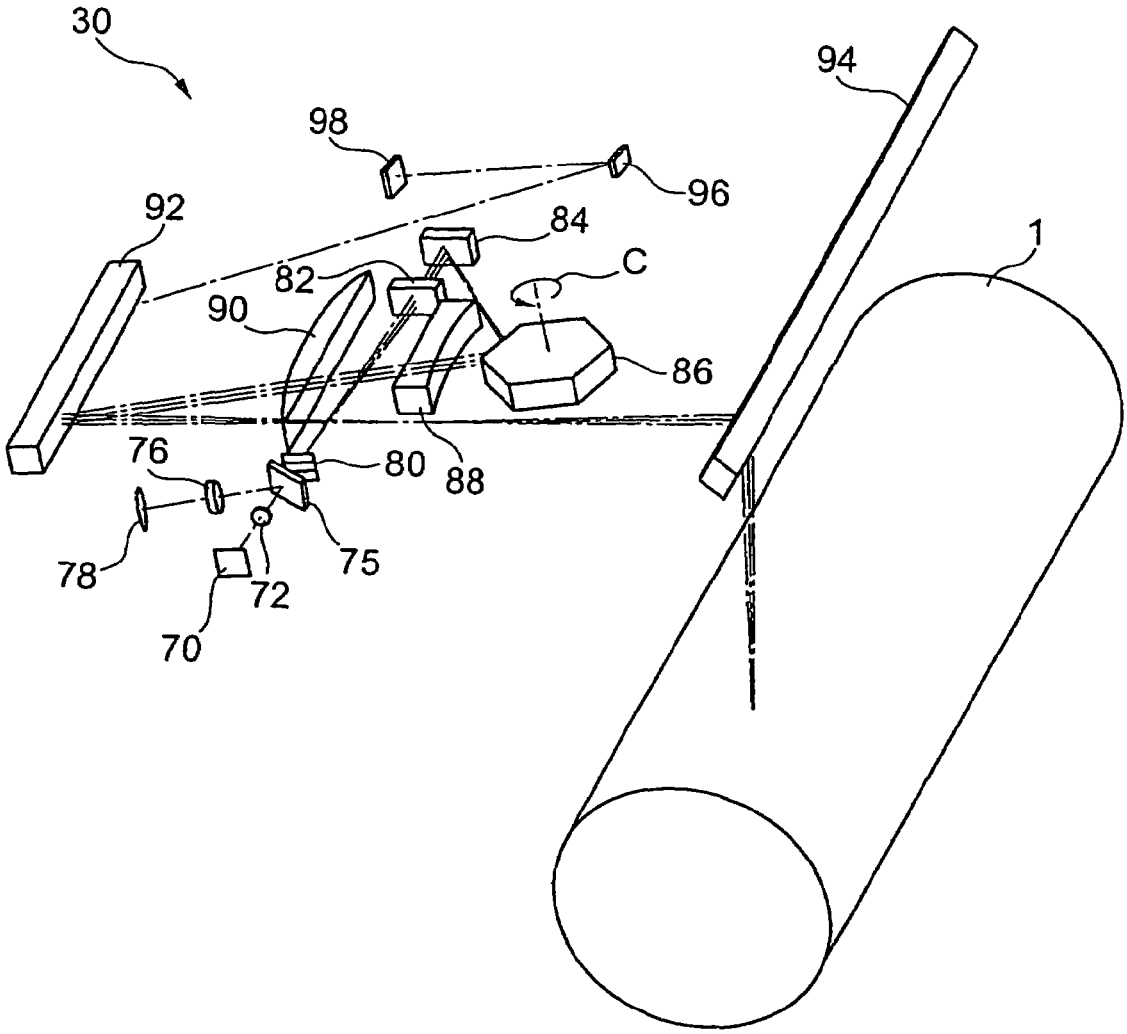
FIG. 10 is a schematic view showing one example of the exposing device 8 (light-scanning device) having a vertical-cavity surface-emitting laser array as an exposing light source.

Next, a preferred example of the exposing device 30 having a vertical-cavity surface-emitting laser array as an exposing light source is described in detail by reference to FIG. 10. The exposing device has a vertical-cavity surface-emitting laser array 70 capable of emitting m (m being at least 3) laser beams. Additionally, in FIG. 10, only 3 laser beams are shown for simplification, but the vertical-cavity surface-emitting laser array 70 formed by arraying vertical-cavity surface-emitting lasers can be constituted so that several ten laser beams are emitted and, as to the arrangement of the vertical-cavity surface-emitting layers (arrangement of laser beams emitted from the vertical-cavity surface-emitting laser array 70), they can be arranged in one row or can be arranged 2-dimensionally (e.g., in a matrix form).

On the laser beam-emitting side of the vertical-cavity surface-emitting laser array 70 are disposed, in order, a collimate lens 72 and a half mirror 75. The laser beams emitted from the vertical-cavity surface-emitting laser array 70 are made an almost parallel bunch of light beams, introduced into the half mirror 75, and part of the beams are separated and reflected. On the laser beam-reflected side of the half mirror 75 are disposed, in order, a lens 76 and a light amount sensor 78, and part of the laser beams separated from the main laser beams (laser beams for exposure) and reflected are introduced into the light amount sensor 78 via the lens 76, the light amount being detected by means of the light amount sensor 78.

Additionally, since no laser beams are emitted from the opposite side of the vertical-cavity surface-emitting laser to the side from which laser beams for exposure are emitted, part of the laser beams used for exposure are required to be separated to detect the light amount for the purpose of detecting and controlling the light amount of the laser beams.

On the main laser beams-emitting side of the half mirror 75 are disposed, in order, an aperture 80, a cylinder lens 82 having a power only in the auxiliary scanning direction and a return mirror 84. The main laser beams emitted from the half mirror 75 are arranged by the aperture 80, then refracted by means of the cylinder lens 82 so that they can form an image in a long line form in the main scanning direction in the vicinity of the reflecting surface of the rotating polygon mirror 86 and reflected to the rotating polygon mirror 86 by means of the return mirror 84. Additionally, the aperture 80 is desirably disposed in the vicinity of the focus of the collimate lens in order to uniformly arrange the plural laser beams.

The rotating polygon mirror 86 is rotated in the direction shown by arrow C through the driving force of a motor not shown, and functions to polarize and reflect the laser beams reflected thereto from the return mirror 84. On the laser beam-emitting side of the rotating polygon mirror are disposed Fθ lenses 88 and 90 having a power only in the main scanning direction, and the laser beams polarized and reflected by the rotating polygon mirror 86 are refracted by the Fθ lenses 88 and 90 so that they migrate at almost equal speeds on the peripheral surface of the electrophotographic photoreceptor 1 and that the imaging position in the main scanning direction coincides with the peripheral surface of the electrophotographic photoreceptor 1.

On the laser beam-emitting side of the Fθ lenses 88 and 90 are disposed, in order, cylinder mirrors 92 and 94 having a power only in the auxiliary scanning direction. The laser beams transmitted through the Fθ lenses 88 and 90 are reflected to irradiate the peripheral surface of the photoreceptor drum 1 by means of the cylinder mirrors 92 and 94 so that the imaging position in the auxiliary scanning direction coincides with the peripheral surface of the electrophotographic photoreceptor 1. Additionally, the cylinder mirrors 92 and 94 also have the function of tilting error correction so as to conjugate the rotating polygon mirror 86 and the peripheral surface of the electrophotographic photoreceptor 1 in the auxiliary scanning direction.

Also, on the laser beam-emitting side of the cylinder mirror 92 is disposed a pick-up mirror 96 at a position corresponding to the end portion on the scanning-initiating side (SOS; Start Of Scan) within the scanning range of the laser beams, with a beam position-detecting sensor 98 being disposed on the laser beams-emitting side of the pick-up mirror 96. The laser beams emitted from the vertical-cavity surface-emitting laser array 70 are reflected by the pick-up mirror 96 and introduced into the beam position-detecting sensor 98 when the laser beams-reflecting surface of the reflecting surfaces of the rotating polygon mirror 86 reaches the position where it reflects the incident beams in the direction coinciding with the SOS direction (also see the imaginary lines in FIG. 10).

The signal outputted from the beam position-detecting sensor 98 is used for synchronizing the modulation-initiating timing in each main scanning upon formation of an electrostatic latent image by modulating the laser beams to be scanned on the peripheral surface of the electrophotographic photoreceptor 1 with rotation of the rotating polygon mirror 86.

In the exposing device 30, the collimate lens 72 and the cylinder lens 82, two cylinder mirrors 92 and 94 are disposed so that they are afocal in the auxiliary scanning direction. This disposition serves to depress difference of scanning line bow (BOW) of the plural laser beams and fluctuation of scanning line space by the plural laser beams.

Figure 11:
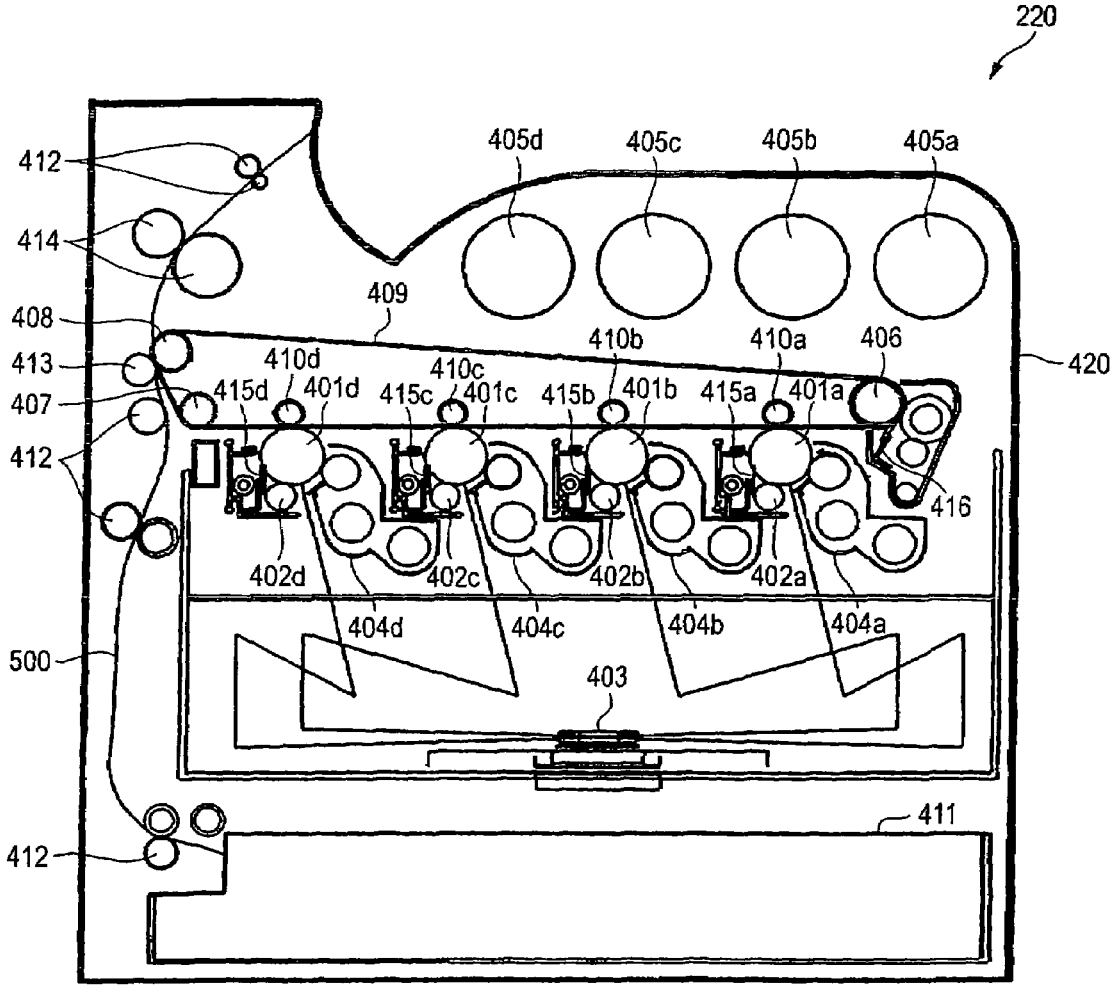
FIG. 11 is a schematic view showing still other preferred embodiment of the image-forming device of the invention.

FIG. 11 is a schematic view showing a fundamental structure of other embodiment of the electrophotographic device of the invention. The electrophotographic device 220 shown in FIG. 11 is an electrophotographic device of an intermediate transfer system. Four electrophotographic photoreceptors 401*a* to 401*d* (for example, electrophotographic photoreceptor 401*a* can form a yellow color image, electrophotographic photoreceptor 401*b* can form a magenta color image, electrophotographic photoreceptor 401*c* can form a cyan color image and electrophotographic photoreceptor 401*d* can form a black color image) are juxtaposed with each other along the intermediate transfer belt 409 within a housing 400.

Here, electrophotographic photoreceptors 401*a* to 401*d* mounted in the electrophotographic device 220 are respectively the electrophotographic photoreceptors of the invention (for example, the electrophotographic photoreceptor 1).

Each of the electrophotographic photoreceptors 401*a* to 401*d* is rotatable in a predetermined direction (counterclockwise in FIG. 11), and each of charging rolls 402*a* to 402*d*, each of developing devices 404*a* to 404*d*, each of primary transfer rolls 410*a* to 410*d*, and each of cleaning blades 415*a* to 415*d* are disposed along the rotation direction. Each of the developing devices 404*a* to 404*d* can be supplied with a black, yellow, magenta or cyan color retained in each of the toner cartridges 405*a* to 405*d*, and each of the primary transfer rolls 410*a* to 410*d* is in contact with each of the electrophotographic photoreceptors 401*a* to 401*d* via the intermediate transfer belt 409.

Further, a laser light source (exposing device) 403 is disposed at a predetermined position within the housing 400 so that the laser light emitted from the laser light source 403 can irradiate the surface of each of the charged electrophotographic photoreceptors 401*a* to 401*d*. Thus, during the rotation of the electrophotographic photoreceptors 401*a* to 401*d*, the steps of charging, exposure, development, primary transfer and cleaning are successively conducted, and toner images of respective colors are transferred one over the other onto the intermediate transfer belt 409.

The intermediate transfer belt 409 is supported with a predetermined tension by driving roll 406, back-up roll 408 and tension roll 407, and can be rotated without slack by rotation of these rolls. Also, a second transfer roll 413 is disposed in contact with a back-up roll 408 via the intermediate transfer belt 409. The intermediate transfer belt 409 having traveled between the back-up roll 408 and the secondary transfer roll 413 is cleaned in its surface by means of, for example, the cleaning blade 416 disposed in the vicinity of the driving roll 406, then repeatedly subjected to the next image-forming process.

Further, a tray 411 (tray for retaining transfer media) is provided at a predetermined position within the housing 400, and a transfer medium 417 such as paper within the tray 411 is successively conveyed between the intermediate transfer belt 409 and the secondary transfer roll 413 and between two fixing rolls 414 provided in contact with each other by means of conveying rolls 412, then discharged out of the housing 400.

The invention is described in more detail by reference to Examples and Comparative Examples. However, the invention is not limited at all by the following Examples.

EXAMPLE 1

A cylindrical aluminum substrate is abraded by means of a centerless abrasion machine to a ten-point height of irregularities of Rz=0.6 μm. In order to wash the thus centerless abrasion-treated aluminum substrate, it is subjected to degreasing treatment, etching treatment with 2% by weight sodium hydroxide solution for 1 minute, neutralizing treatment and washing with pure water in this water. Subsequently, an anodized film is formed (electric current density: 1.0 A/dm$^2$) on the aluminum substrate in a 10% by weight sulfuric acid solution. After washing with water, the substrate is dipped in a 80° C., 1% by weight nickel acetate solution for 20 minutes to conduct pore-sealing treatment. Further, it is subjected to washing with pure water and drying treatment. Thus, a conductive support having formed on the surface thereof an anodized film of 7 μm in thickness is obtained.

Next, 1 part by weight of chlorogallium phthalocyanine showing strong diffraction peaks at 7.4°, 16.6°, 25.5° and 28.3° in Bragg angle (2θ±0.2°) in X-ray diffraction spectrum, 1 part by weight of polyvinyl butyral (S-LEC BM-S, manufactured by Sekisui Chemical Co., Ltd.) and 100 parts by weight of n-butyl acetate are mixed and treated in a paint shaker together with glass beads for 1 hour to disperse, thus a coating solution for forming a charge generating layer being obtained. This coating solution is dip-coated on the peripheral surface of the conductive support, followed by heat-drying at 100° C. for 10 minutes to form a charge generating layer of about 0.15 μm in thickness.

Next, 2 parts by weight of a benzidine compound represented by the following formula (XVI) and 2.5 parts by weight of a high molecular compound (viscosity-average molecular weight: 30,000) having a structural unit represented by the following formula (XVII) are dissolved in 20 parts by weight of chlorobenzene to obtain a coating solution for forming a charge transporting layer.

(XVI)

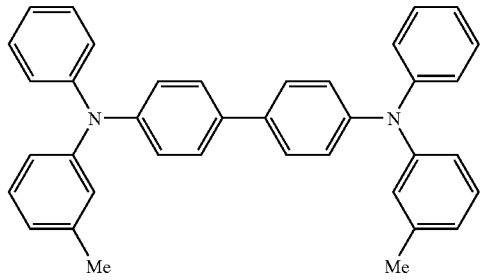

(XVII)

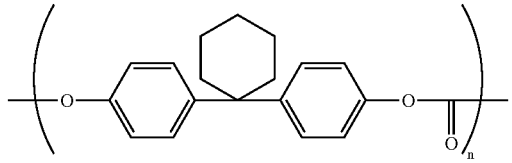

The thus-obtained coating solution is coated on the charge generating layer according to a dip coating method, then heat-dried at 120° C. for 40 minutes to form a 20-μm thick charge transporting layer.

Next, 3 parts by weight of compound (II-16) in Table 18, 0.5 part by weight of methyltrimethoxysilane, 0.2 part by weight of colloidal silica, 0.5 part by weight of $CH_3(CH_3O)_2$—Si—$(CH_2)_4$—Si—$CH_3(OCH_3)_2$, 5 parts by weight of methyl alcohol and 0.5 part by weight of an ion-exchange resin (Amberlyst 15E: manufactured by Rohm & Haas Co., Ltd.) are mixed and stirred for 3 hours to conduct protective group-exchanging reaction. Subsequently, 10 parts by weight of n-butanol and 0.3 part of distilled water are added to the reaction solution to conduct hydrolysis for 15 minutes. After the hydrolysis, the ion-exchange resin is filtered off from the reaction solution, and 0.1 part by weight of aluminum tris-acetylacetonate ($Al(aqaq)_3$), 0.1 part by weight of acetylacetone, 0.4 part by weight of 3,5-di-t-butyl-4-hydroxytoluene (BHT), 3 parts by weight of a phenol resin (PL-4852; manufactured by Gunei Chemical Industry Co., Ltd.) and 0.12 part by weight of a polyether-modified silicone oil (KF353(A); manufactured by Shin-Etsu Chemical Co., Ltd.) are added to the filtrate to obtain a coating solution for forming a protective layer.

The thus-obtained coating solution for forming a protective layer is coated on the charge transporting layer according to the ring type dip-coating method, air-dried at room temperature for 30 minutes, then heat-treated at 130° C. for 1 hour to cure. Thus, a protective layer of about 3 μm in thickness is formed to obtain an intended electrophotographic photoreceptor (hereinafter referred to as "photoreceptor 1").

The same procedure is repeated 5 times, and resulting 5 photoreceptors 1 are visually observed to check the surface state of the protective layer. The ratio of coating failure (number of photoreceptors showing coating deficiency; hereinafter the same) is shown in Table 57. In Table 57, "0/5" means that no coating deficiency is observed with all of the 5 photoreceptors 1 (hereinafter the same).

EXAMPLE 2

First, as a conductive support, a cylindrical aluminum substrate having been subjected to honing treatment is prepared. Then, 100 parts by weight of a zirconium compound (Orgatics ZC540; Matsumoto Seiyaku K.K.), 10 parts by weight of a silane compound (A1100; manufactured by Nippon Unicar Co., Ltd.), 3 parts by weight of polyvinyl butyral (S-LEC BM-S; manufactured by Sekisui Chemical Co., Ltd.), 380 parts by weight of isopropanol and 200 parts by weight of n-butanol are mixed to obtain a coating solution for forming a subbing layer. This coating solution is dip-coated on the peripheral surface of the aluminum substrate, heat-dried at 150° C. for 10 minutes to form a subbing layer of about 0.17 μm in film thickness.

Next, 1 part by weight of hydroxygallium phthalocyanine showing strong diffraction peaks at 7.5°, 9.9°, 12.5°, 16.3°, 18.6°, 25.1° and 28.3° in Bragg angle (2θ±0.2°) in X-ray diffraction spectrum, 1 part by weight of polyvinyl butyral (S-LEC BM-S, manufactured by Sekisui Chemical Co., Ltd.) and 100 parts by weight of n-butyl acetate are mixed and treated in a paint shaker together with glass beads for 2 hours to disperse, thus a coating solution for forming a charge generating layer being obtained. This coating solution is dip-coated on the subbing layer, followed by heat-drying at 100° C. for 10 minutes to form a charge generating layer of about 0.15 μm in thickness.

Next, 2 parts by weight of a compound represented by the following formula (XVIII) and 3 parts by weight of a high molecular compound (viscosity-average molecular weight: 50,000) having a structural unit represented by the following formula (XIX) are dissolved in 20 parts by weight of chlorobenzene to obtain a coating solution for forming a charge transporting layer.

(XVIII)

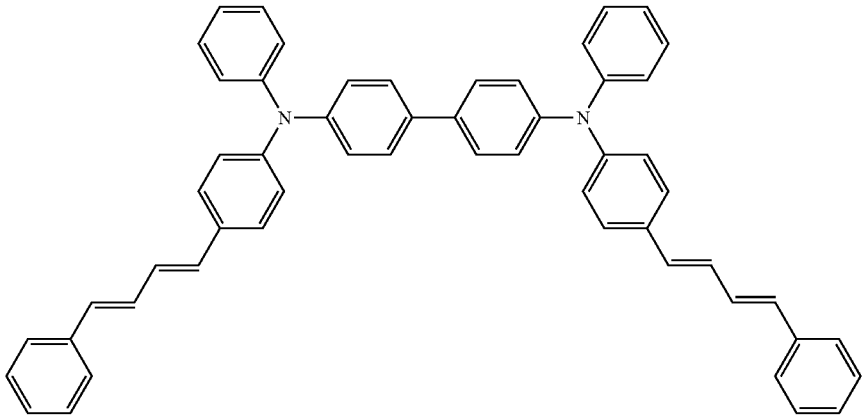

(XIX)

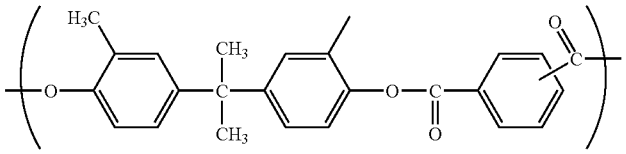

The thus-obtained coating solution is coated on the charge generating layer according to a dip coating method, then heat-dried at 120° C. for 45 minutes to form a 20-μm thick charge transporting layer.

Next, 3 parts by weight of compound (II-3) in Table 14, 0.5 part by weight of $CH_3(CH_3O)_2$—Si—$(CH_2)_4$—Si—$CH_3(OCH_3)_2$, 0.3 part by weight of hexamethylcyclotrisiloxane, 5 parts by weight of butyl alcohol and 0.3 part by weight of an ion-exchange resin (Amberlyst 15E: manufactured by Rohm & Haas Co., Ltd.) are mixed and stirred for 5 hours to conduct protective group-exchanging reaction. Subsequently, the ion-exchange resin is filtered off from the reaction solution, and 0.1 part by weight of aluminum tris-acetylacetonate (Al(aqaq)$_3$), 0.1 part by weight of acetylacetone, 0.4 part by weight of 3,5-di-t-butyl-4-hydroxytoluene (BHT), 3 parts by weight of a phenol resin (PR-51206; manufactured by Sumitomo Bakelite K.K.) and 0.1 part by weight of a polyether-modified silicone oil (KF355(A); manufactured by Shin-Etsu Chemical Co., Ltd.) are added to the filtrate to obtain a coating solution for forming a protective layer.

The thus-obtained coating solution for forming a protective layer is coated on the charge transporting layer according to the ring type dip-coating method, air-dried at room temperature for 30 minutes, then heat-treated at 130° C. for 1 hour to cure. Thus, a protective layer of about 3 μm in thickness is formed to obtain an intended electrophotographic photoreceptor (hereinafter referred to as "photoreceptor 2").

The same procedure is repeated 5 times, and resulting 5 photoreceptors 2 are visually observed to check the surface state of the protective layer. The ratio of coating failure is shown in Table 57.

EXAMPLE 3

First, a subbing layer is formed in the same manner as with the photoreceptor 2.

Next, 1 part by weight of titanyl phthalocyanine showing strong diffraction peaks at 27.2° in Bragg angle (2θ±0.2°) in X-ray diffraction spectrum is mixed with 1 part by weight of polyvinyl butyral (S-LEC BM-S, manufactured by Sekisui Chemical Co., Ltd.) and 100 parts by weight of n-butyl acetate, and the resulting mixture is treated in a paint shaker together with glass beads for 1 hour to disperse, thus a coating solution for forming a charge generating layer being obtained. This coating solution is dip-coated on the subbing layer, followed by heat-drying at 100° C. for 10 minutes to form a charge generating layer of about 0.15 μm in thickness.

Next, 2 parts by weight of a benzidine compound represented by the foregoing formula (XVI) and 2.5 parts by weight of a high molecular compound (viscosity-average molecular weight: 79,000) having a structural unit represented by the foregoing formula (XVII) are dissolved in 25 parts by weight of chlorobenzene to obtain a coating solution for forming a charge transporting layer. This coating solution is coated on the charge generating layer according to a dip coating method, then heated at 110° C. for 40 minutes to form a 20-μm thick charge transporting layer.

Next, 3 parts by weight of compound (I-1) in Table 5, 3 parts by weight of a phenol resin (PL-2215; manufactured by Gunei Chemical Industry Co., Ltd.), 0.1 part by weight of a polyether-modified silicone oil (KF615(A); manufactured by Shin-Etsu Chemical Co., Ltd.) are mixed to obtain a coating solution for forming a protective layer.

This coating solution is coated on the charge transporting layer according to the ring type dip-coating method, air-dried at room temperature for 30 minutes, then heat-treated at 130° C. for 1 hour to cure. Thus, a protective layer of about 3 μm in thickness is formed to obtain an intended electrophotographic photoreceptor (hereinafter referred to as "photoreceptor 3").

The same procedure is repeated 5 times, and resulting 5 photoreceptors 3 are visually observed to check the surface state of the protective layer. The ratio of coating failure is shown in Table 57.

EXAMPLE 4

First, a cylindrical aluminum substrate is prepared as a conductive support.

Next, 100 parts by weight of zinc oxide (SMZ-017N; manufactured by Tayca Corporation) is mixed and stirred with 500 parts by weight of toluene, and 2 parts by weight of a silane coupling agent (A1100; manufactured by Nippon Unicar Co., Ltd.) is added thereto, followed by stirring the mixture for 5 hours. Subsequently, toluene is distilled off under reduced pressure, and baking is conducted at 120° C. for 2 hours. X-ray fluorometry of the thus-obtained surface-treated zinc oxide revealed that the ratio of Si element intensity to Zn element intensity is $1.8\times10^{-4}$.

35 parts by weight of the surface-treated zinc oxide is mixed with 15 parts by weight of a curing agent (blocked isocyanate, Sumidur 3175; manufactured by Sumitomo Bayer Urethane K.K.), 6 parts by weight of a butyral resin (BM-1; manufactured by Sekisui Chemical Co., Ltd.) and 44 parts by weight of methyl ethyl ketone, and the resulting mixture is subjected to a dispersing treatment for 2 hours in a sand mill using a 1-mmϕ glass beads to obtain a dispersion. To the resultant dispersion are added 0.005 part by weight of dioctyltin dilaurate as a catalyst, and 17 parts by weight of silicone fine particles (Tospearl 130; manufactured by GE Toshiba Silicone K.K.) to obtain a coating solution for forming a subbing layer. This coating solution is coated on the aluminum substrate according to a dip coating method, then dried at 160° C. for 100 minutes to cure. Thus, there is obtained a subbing layer of 20 μm in thickness. The surface roughness of the subbing layer is measured by using a measuring device for measuring surface roughness and surface shape, Surfcom 570A, made by Tokyo Seimitsu K.K. with a measuring distance of 2.5 mm and scanning speed of 0.3 mm/sec, and is found to be 0.24 in Rz value.

Next, 1 part by weight of hydroxygallium phthalocyanine showing strong diffraction peaks at 7.5°, 9.9°, 12.5°, 16.3°, 18.6°, 25.1° and 28.3° in Bragg angle (2θ±0.2°) in X-ray diffraction spectrum is mixed with 1 part by weight of polyvinyl butyral (S-LEC BM-S, manufactured by Sekisui Chemical Co., Ltd.) and 100 parts by weight of n-butyl acetate and treated in a paint shaker together with glass beads for 1 hour to disperse, thus a coating solution for forming a charge generating layer being obtained. This coating solution is dip-coated on the subbing layer, followed by heat-drying at 100° C for 10 minutes to form a charge generating layer of about 0.15 μm in thickness.

Next, 2 parts by weight of a compound represented by the foregoing formula (XVI) and 2.5 parts by weight of a high molecular compound (viscosity-average molecular weight: 79,000) having a structural unit represented by the foregoing formula (XVII) are dissolved in 25 parts by weight of chlorobenzene to obtain a coating solution for forming a charge transporting layer. This coating solution is coated on the charge generating layer according to a dip coating method, then heat-dried at 110° C. for 40 minutes to form a 20-μm thick charge transporting layer.

Next, 3 parts by weight of compound (I-19) in Table 9, 3 parts by weight of a phenol resin (PL-2211; manufactured by Gunei Chemical Industry Co., Ltd) and 0.1 part by weight of a polyether-modified silicone oil (KF353(A); manufactured by Shin-Etsu Chemical Co., Ltd.) are mixed to obtain a coating solution for forming a protective layer. This coating solution is coated on the charge transporting layer according to the ring type dip-coating method, air-dried at room temperature for 30 minutes, then heat-treated at 130° C. for 1 hour to cure. Thus, a protective layer of about 3 μm in thickness is formed to obtain an intended electrophotographic photoreceptor (hereinafter referred to as "photoreceptor 4").

The same procedure is repeated 5 times, and resulting 5 photoreceptors 4 are visually observed to check the surface state of the protective layer. The ratio of coating failure is shown in Table 57.

EXAMPLE 5

First, the same procedures as with the photoreceptor 4 are conducted up to formation of a charge transporting layer.

Next, 3 parts by weight of compound (I-1) in Table 5, 3 parts by weight of a phenol resin (PR-50404; manufactured by Sumitomo Bakelite K.K.) and 0.1 part by weight of a polyether-modified silicone oil (KF355(A); manufactured by Shin-Etsu Chemical Co., Ltd.) are mixed to obtain a coating solution for forming a protective layer. This coating solution is coated on the charge transporting layer according to the ring type dip-coating method, air-dried at room temperature for 30 minutes, then heat-treated at 130° C. for 1 hour to cure. Thus, a protective layer of about 3 μm in thickness is formed to obtain an intended electrophotographic photoreceptor (hereinafter referred to as "photoreceptor 5").

The same procedure is repeated 5 times, and resulting 5 photoreceptors 5 are visually observed to check the surface state of the protective layer. The ratio of coating failure is shown in Table 57.

EXAMPLE 6

First, the same procedures as with the photoreceptor 3 are conducted up to formation of a charge transporting layer.

Next, 3 parts by weight of compound (II-15) in Table 18, 3 parts by weight of a phenol resin (BLS-3122; manufactured by Showa Highpolymer K.K.), 0.1 part by weight of triethylphosphine and 0.1 part by weight of a polyether-modified silicone oil (KF353(A); manufactured by Shin-Etsu Chemical Co., Ltd.) are mixed to obtain a coating solution for forming a protective layer. This coating solution is coated on the charge transporting layer according to the ring type dip-coating method, air-dried at room temperature for 30 minutes, then heat-treated at 160° C. for 1 hour to cure. Thus, a protective layer of about 3 μm in thickness is formed to obtain an intended electrophotographic photoreceptor (hereinafter referred to as "photoreceptor 6").

The same procedure is repeated 5 times, and resulting 5 photoreceptors 6 are visually observed to check the surface state of the protective layer. The ratio of coating failure is shown in Table 57.

EXAMPLE 7

First, the same procedures as with the photoreceptor 4 are conducted up to formation of a charge transporting layer.

Next, 3 parts by weight of compound (IV-6) in Table 37, 3 parts by weight of a phenol resin (CKM-2400; manufactured by Showa Highpolymer Co., Ltd.) and 0.1 part by weight of a polyether-modified silicone oil (KF355(A); manufactured by Shin-Etsu Chemical Co., Ltd.) are mixed to obtain a coating solution for forming a protective layer. This coating solution is coated on the charge transporting layer according to the ring type dip-coating method, air-dried at room temperature for 30 minutes, then heat-treated at 160° C. for 1 hour to cure. Thus, a protective layer of about 3 μm in thickness is formed to obtain an intended electrophotographic photoreceptor (hereinafter referred to as "photoreceptor 7").

The same procedure is repeated 5 times, and resulting 5 photoreceptors 7 are visually observed to check the surface state of the protective layer. The ratio of coating failure is shown in Table 57.

EXAMPLE 8

First, the same procedures as with the photoreceptor 5 are conducted up to formation of a charge transporting layer.

Next, 3 parts by weight of compound (V-47) in Table 54, 3 parts by weight of a phenol resin (PL-4852; manufactured by Gunei Chemical Industry Co., Ltd.) and 0.1 part by weight of a polyether-modified silicone oil (KF355(A); manufactured by Shin-Etsu Chemical Co., Ltd.) are mixed to obtain a coating solution for forming a protective layer. This coating solution is coated on the charge transporting layer according to the ring type dip-coating method, air-dried at room temperature for 30 minutes, then heat-treated at 160° C. for 1 hour to cure. Thus, a protective layer of about 3 μm in thickness is formed to obtain an intended electrophotographic photoreceptor (hereinafter referred to as "photoreceptor 8").

The same procedure is repeated 5 times, and resulting 5 photoreceptors 8 are visually observed to check the surface state of the protective layer. The ratio of coating failure is shown in Table 57.

EXAMPLE 9

First, the same procedures as with the photoreceptor 5 are conducted up to formation of a charge transporting layer.

Next, 100 parts by weight of conductive fine particles of tin oxide particles (S-1; manufactured by Mitsubishi Material K.K.) is stirred in a ball mill together with 20 parts by weight of heptadecafluorodecyltrimethoxysilane (TSL8233; manufactured by Toshiba Silicone K.K.) and 300 parts by weight of methanol. The thus-stirred mixture is filtered, and tin oxide on the filter is ished with methanol, then dried at 150° C. for 2 hours to thereby conduct surface treatment of the tin oxide particles. 11 parts by weight of the surface-treated tin oxide particles and 10 parts by weight of a phenol resin (PL-4852; manufactured by Gunei Chemical Industry Co., Ltd.) are added to a solution of 5 parts by weight of a polyvinyl butyral resin (S-LEC BH-S; manufactured by Sekisui Chemical Co., Ltd.) and 0.2 part by weight of a polyether-modified silicone oil (KF355(A); manufactured by Shin-Etsu Chemical Co., Ltd.) in 150 parts by weight of n-butyl alcohol, and the resulting mixture is dispersed in a sand mill for 1 hour to obtain a coating solution for forming a protective layer. The thus-obtained coating solution is coated on the charge transporting layer according to the dip-coating method, and dried at 170° C. for 1 hour to cure. Thus, a protective layer of 4 μm in thickness is formed to obtain an intended electrophotographic photoreceptor (hereinafter referred to as "photoreceptor 9").

The same procedure is repeated 5 times, and resulting 5 photoreceptors 9 are visually observed to check the surface state of the protective layer. The ratio of coating failure is shown in Table 57.

EXAMPLE 10

First, the same procedures as with the photoreceptor 5 are conducted up to formation of a charge transporting layer.

Next, 8 parts by weight of compound (II-15) in Table 18, 60 parts by weight of cyclohexanone, 10 parts by weight of a blocked polyisocyanate (Sumidur BL3175; manufactured by Sumitomo Bayer Urethane K.K.) and 0.1 part by weight of dibutiltin dilaurate are mixed to obtain a coating solution for forming a protective layer. This coating solution is coated on the charge transporting layer according to the ring type dip-coating method, air-dried at room temperature for 30 minutes, then heat-treated at 160° C. for 1 hour to cure. Thus, a protective layer of about 3 μm in thickness is formed to obtain an intended electrophotographic photoreceptor (hereinafter referred to as "photoreceptor 10").

The same procedure is repeated 5 times, and resulting 5 photoreceptors 10 are visually observed to check the surface state of the protective layer. The ratio of coating failure is shown in Table 57.

COMPARATIVE EXAMPLE 1

An electrophotographic photoreceptor (hereinafter referred to as "photoreceptor 11") is prepared in the same manner as with the photoreceptor 1 except for not using the polyether-modified silicone oil (KF353(A); manufactured by Shin-Etsu Chemical Co., Ltd.) upon forming the protective layer.

The same procedure is repeated 5 times, and resulting 5 photoreceptors 11 are visually observed to check the surface state of the protective layer. The ratio of coating failure is shown in Table 57. In Table 57, "2/5" represents that two of the five photoreceptors 11 showed coating defects (hereinafter the same).

COMPARATIVE EXAMPLE 2

An electrophotographic photoreceptor (hereinafter referred to as "photoreceptor 12") is prepared in the same manner as with the photoreceptor 5 except for not using the polyether-modified silicone oil (KF355(A); manufactured by Shin-Etsu Chemical Co., Ltd.) upon forming the protective layer.

The same procedure is repeated 5 times, and resulting 5 photoreceptors 12 are visually observed to check the surface state of the protective layer. The ratio of coating failure is shown in Table 57.

COMPARATIVE EXAMPLE 3

An electrophotographic photoreceptor (hereinafter referred to as "photoreceptor 13") is prepared in the same manner as with the photoreceptor 5 except for using a non-modified silicone oil (KP354; manufactured by Shin-Etsu Chemical Co., Ltd.) in place of the polyether-modified silicone oil (KF615(A); manufactured by Shin-Etsu Chemical Co., Ltd.) upon forming the protective layer.

The same procedure is repeated 5 times, and resulting 5 photoreceptors 13 are visually observed to check the surface state of the protective layer. The ratio of coating failure is shown in Table 57.

TABLE 57

| | Photoreceptor No. | Ratio of Coating Failure |
|---|---|---|
| Example 1 | Photoreceptor 1 | 0/5 |
| Example 2 | Photoreceptor 2 | 0/5 |
| Example 3 | Photoreceptor 3 | 0/5 |
| Example 4 | Photoreceptor 4 | 0/5 |
| Example 5 | Photoreceptor 5 | 0/5 |
| Example 6 | Photoreceptor 6 | 0/5 |
| Example 7 | Photoreceptor 7 | 0/5 |
| Example 8 | Photoreceptor 8 | 0/5 |
| Example 9 | Photoreceptor 9 | 0/5 |
| Example 10 | Photoreceptor 10 | 0/5 |
| Comparative Example 1 | Photoreceptor 11 | 2/5 |
| Comparative Example 2 | Photoreceptor 12 | 4/5 |
| Comparative Example 3 | Photoreceptor 13 | 2/5 |

EXAMPLES 11 TO 29 AND COMPARATIVE EXAMPLES 4 TO 9

In each of Examples 11 to 29 and Comparative Examples 4 to 9, electrophotographic photoreceptors and developing agents are combined to use as shown in Table 58 or 59 to prepare an image-forming device having a constitution shown in FIG. 11. Additionally, in Tables 58 and 59, "developer 1" means a developing agent for Docu Centre Color 500, and "developer 2" means a developing agent for Docu Centre Color 400CP. Also, in Table 59, "photoreceptor 11-1", "photoreceptor 12-1" and "photoreceptor 13-1" mean those of photoreceptors 11 to 13 obtained in Comparative Examples 1 to 3, respectively, which showed coating defects. In Table 59, "photoreceptor 11-2", "photoreceptor 12-2" and "photoreceptor 13-2" mean those of photoreceptors 11 to 13 obtained in Comparative Examples 1 to 3, respectively, which showed no coating defects. Other elements than the electrophotographic photoreceptor and the developing agent are the same as those used in a printer, Docu Color 400CP, manufactured by Fuji Xerox Co., Ltd.

Next, image-forming test for 5,000 sheets is conducted (image density: about 5%) with each image-forming device in a no-paper mode under an environment of high temperature and high humidity (28° C., 80% RH), subsequently image-forming test for 5,000 sheets is conducted (image density: about 5%) with each image-forming device under an environment of low temperature and low humidity (10° C., 20% RH). After the tests, presence or absence of scratches and deposits on the surface of the photoreceptor (surface of the protective layer) is evaluated. Also, toner-cleaning properties (staining of the charging device or image deterioration due to cleaning failure) and image quality (reproducibility of 1 dot and 45°-inclined fine line) are evaluated. The results thus obtained are shown in Tables 58 and 59.

Presence or absence of scratches on the photoreceptors is visually examined and evaluated according to the following evaluation standard:

A: No scratches are formed.

B: Scratches are partially formed (no problems with image quality).

C: Scratches are formed (problems being involved with image quality).

Also, presence or absence of deposits is visually judged and evaluated according to the following standard:

A: no deposits;

B: Deposits partially existed (no problems with image quality).

C: Deposits existed (problems being involved with image quality).

Also, the cleaning properties are visually judged and evaluated according to the following standard:

A: Good.

B: Image defects such as streaks are partially found (no problems with image quality).

C: Image defects are found in a wide area (problems with image quality being involved).

Also, image quality is judged using a magnifying glass and is evaluated according to the following standard:

A: Good.

B: Defects partially exist (practically no problems).

C: Defects exist (fine lines not being reproduced).

TABLE 58

| | | | High Temperature & High Humidity | | | Low Temperature & Low Humidity | | | | |
|---|---|---|---|---|---|---|---|---|---|---|
| | | | Image Quality | | | Image Quality | | | | |
| | Photoreceptor No. | Develop-ing Agent No. | Initial | After 5000 Sheets | Cleaning Properties | Initial | After 5000 Sheets | Cleaning Properties | Scratches on Photoreceptor | Deposits on Photoreceptor |
| Example 11 | Photoreceptor 1 | Developing Agent 1 | A | A | A | A | A | A | A | A |
| Example 12 | Photoreceptor 2 | Developing Agent 1 | A | A | A | A | A | A | A | A |
| Example 13 | Photoreceptor 3 | Developing Agent 1 | A | A | A | A | A | A | A | A |
| Example 14 | Photoreceptor 4 | Developing Agent 1 | A | A | A | A | A | A | A | A |
| Example 15 | Photoreceptor 5 | Developing Agent 1 | A | A | A | A | A | A | A | A |
| Example 16 | Photoreceptor 6 | Developing Agent 1 | A | A | A | A | A | A | A | A |
| Example 17 | Photoreceptor 7 | Developing Agent 1 | A | A | A | A | A | A | A | A |
| Example 18 | Photoreceptor 8 | Developing Agent 1 | A | A | A | A | A | A | A | A |
| Example 19 | Photoreceptor 9 | Developing Agent 1 | A | A | A | A | A | B | A | A |
| Example 20 | Photoreceptor 10 | Developing Agent 1 | A | A | B | A | A | B | A | A |

TABLE 59

| | | | High Temperature & High Humidity | | | Low Temperature & Low Humidity | | | | |
|---|---|---|---|---|---|---|---|---|---|---|
| | | | Image Quality | | | Image Quality | | | | |
| | Photoreceptor No. | Develop-ing Agent No. | Initial | After 5000 Sheets | Cleaning Properties | Initial | After 5000 Sheets | Cleaning Properties | Scratches on Photoreceptor | Deposits on Photoreceptor |
| Example 21 | Photoreceptor 1 | Developing Agent 2 | A | A | A | A | A | A | A | A |
| Example 22 | Photoreceptor 2 | Developing Agent 2 | A | A | A | A | A | A | A | A |
| Example 23 | Photoreceptor 3 | Developing Agent 2 | A | A | A | A | A | B | A | A |
| Example 24 | Photoreceptor 4 | Developing Agent 2 | A | A | A | A | A | A | A | A |
| Example 25 | Photoreceptor 5 | Developing Agent 2 | A | A | A | A | A | A | A | A |
| Example 26 | Photoreceptor 6 | Developing Agent 2 | A | A | A | A | A | A | A | A |
| Example 27 | Photoreceptor 7 | Developing Agent 2 | A | A | A | A | A | A | A | A |
| Example 28 | Photoreceptor 8 | Developing Agent 2 | A | A | A | A | A | A | A | A |
| Example 29 | Photoreceptor 9 | Developing Agent 2 | A | A | A | A | A | B | A | A |
| Comparative Example 4 | Photoreceptor 11-1 | Developing Agent 1 | A | C | C | A | C | C | C | C |
| Comparative Example 5 | Photoreceptor 11-2 | Developing Agent 1 | A | B | C | A | B | C | C | C |
| Comparative Example 6 | Photoreceptor 12-1 | Developing Agent 2 | A | C | C | A | C | C | C | C |
| Comparative Example 7 | Photoreceptor 12-2 | Developing Agent 2 | A | B | C | A | B | C | C | C |
| Comparative Example 8 | Photoreceptor 13-1 | Developing Agent 2 | A | C | C | A | C | C | C | C |
| Comparative Example 9 | Photoreceptor 13-2 | Developing Agent 2 | A | B | C | A | B | B | C | C |

The invention provides an electrophotographic photoreceptor which has sufficiently improved film-forming properties of the functional layer constituted by an alcohol-soluble curable resin and which can stably provide a good image quality over a long period of time, and an image-forming device, a process cartridge and an image-forming method using the electrophotographic photoreceptor.

The entire disclosure of Japanese Patent Application No. 2005-185161 filed on Jun. 24, 2005 including specification, claims, drawings and abstract is incorporated herein by reference in its entirely.

What is claimed is:

1. An electrophotographic photoreceptor comprising:

a conductive support; and a photo-sensitive layer on the conductive support, wherein the photo-sensitive layer comprises a functional layer comprising a cured product of a curable resin composition, the curable resin composition comprising an alcohol-soluble, curable resin and a polyether-modified silicone oil.

2. The electrophotographic photoreceptor as described in claim 1, wherein the curable resin is a phenol resin.

3. The electrophotographic photoreceptor as described in claim 1, wherein the functional layer further comprises at least one of conductive fine particles and a charge transporting material.

4. The electrophotographic photoreceptor as described in claim 3, wherein the charge transporting material is at least one compound selected from compounds represented by general formulae (I), (II), (III), (IV) and (V):

$$F—[(X^1)_{n1}R^1\text{-}Z^1H]_{m1} \quad (I)$$

wherein F represents an organic group derived from a compound having a positive hole-transporting ability, $R^1$ represents an alkylene group, $Z^1$ represents an oxygen atom, a sulfur atom, NH or COO, $X^1$ represents an oxygen atom or a sulfur atom, m1 represents an integer of from 1 to 4, and n1 represents 0 or 1;

$$F—[(X^2)_{n2}—(R^2)_{n3}\text{-}(Z^2)_{n4}G]_{n5} \quad (II)$$

wherein F represents an organic group derived from a compound having a positive hole-transporting ability, $X^2$ represents an oxygen atom or a sulfur atom, $R^2$ represents an alkylene group, $Z^2$ represents an oxygen atom, a sulfur atom, NH or COO, G represents an epoxy group, n2, n3 and n4 each independently represents 0 or 1, and n5 represents an integer of from 1 to 4;

$$F[\text{-}D\text{-}Si(R^3)_{(3-a)}Q_a]_b \quad (III)$$

wherein, F represents a b-valent organic group derived from a compound having a positive hole-transporting ability, D represents a flexible 2-valent group, $R^3$ represents a hydrogen atom, a substituted or unsubstituted alkyl group or a substituted or unsubstituted aryl group, Q represents a hydrolysable group, a represents an integer of from 1 to 3, and b represents an integer of from 1 to 4;

(IV)

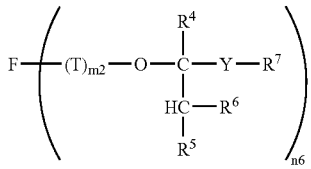

wherein, F represents an organic group derived from a compound having a positive hole-transporting ability, T represents a 2-valent group, Y represents an oxygen atom or a sulfur atom, $R^4$, $R^5$ and $R^6$ each independently represents a hydrogen atom or a monovalent organic group, $R^7$ represents a monovalent organic group, m2 represents 0 or 1, and n6 represents an integer of from 1 to 4, provided that $R^6$ and $R^7$ may be connected to each other to form a hetero ring wherein Y is a hetero atom;

(V)

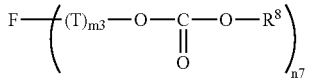

wherein F represents an organic group derived from a compound having a positive hole-transporting ability, T represents a 2-valent group, $R^8$ represents a monovalent organic group, m3 represents 0 or 1, and n7 represents an integer of from 1 to 4.

5. The electrophotographic photoreceptor as described in claim 4, wherein the group F is a group represented by general formula (VI):

(VI)

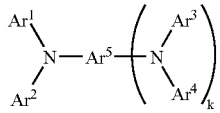

wherein $Ar^1$, $Ar^2$, $Ar^3$ and $Ar^4$ each independently represents a substituted or unsubstituted aryl group, $Ar^5$ represents a substituted or unsubstituted aryl group or arylene group, with 1 to 4 of $Ar^1$ to $Ar^5$ having a connecting bond to a moiety represented by general formula (VII) in the compound represented by the general formula (I), a moiety represented by general formula (VIII) in the compound represented by the general formula (II), a moiety represented by general formula (IX) in the compound represented by the general formula (III), a moiety represented by the general formula (X) in the compound represented by the general formula (IV) or a moiety represented by the general formula (XI) in the compound represented by the general formula (V):

$$—(X^1)_{n1}R^1—Z^1H \quad (VII)$$

$$—(X^2)_{n2}—(R^2)_{n3}—(Z^2)_{n4}G \quad (VIII)$$

$$—D—Si(R^3)_{(3-a)}Q_a \quad (IX)$$

-continued (X)

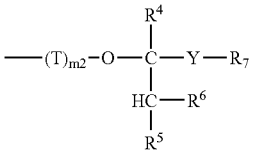

(XI)

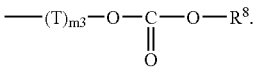

6. An image-forming device comprising:

an electrophotographic photoreceptor comprising a conductive support and a photo-sensitive layer on the conductive support, wherein the photo-sensitive layer comprises a functional layer comprising a cured product of a curable resin composition, the curable resin composition comprising an alcohol-soluble, curable resin and a polyether-modified silicone oil;

a charging unit that charges the electrophotographic photoreceptor;

an exposing unit that exposes the charged electrophotographic photoreceptor to form an electrostatic latent image;

a developing unit that develops the electrostatic latent image with a toner to form a toner image; and a transferring unit that transfers the toner image to a transfer medium.

7. The image-forming device as described in claim 6, wherein the curable resin is a phenol resin.

8. The image-forming device as described in claim 6, wherein the functional layer further comprises at least one of conductive fine particles and a charge transporting material.

9. The image-forming device as described in claim 8, wherein the charge transporting material is at least one compound selected from compounds represented by general formulae (I), (II), (III), (IV) and (V):

$$F—[(X^1)_{n1}R^1\text{-}Z^1H]_{m1} \quad (I)$$

wherein F represents an organic group derived from a compound having a positive hole-transporting ability, $R^1$ represents an alkylene group, $Z^1$ represents an oxygen atom, a sulfur atom, NH or COO, $X^1$ represents an oxygen atom or a sulfur atom, m1 represents an integer of from 1 to 4, and n1 represents 0 or 1;

$$F—[(X^2)_{n2}—(R^2)_{n3}\text{-}(Z^2)_{n4}G]_{n5} \quad (II)$$

wherein F represents an organic group derived from a compound having a positive hole-transporting ability, $X^2$ represents an oxygen atom or a sulfur atom, $R^2$ represents an alkylene group, $Z^2$ represents an oxygen atom, a sulfur atom, NH or COO, G represents an epoxy group, n2, n3 and n4 each independently represents 0 or 1, and n5 represents an integer of from 1 to 4;

$$F[\text{-}D\text{-}Si(R^3)_{(3-a)}Q_a]_b \quad (III)$$

wherein, F represents a b-valent organic group derived from a compound having a positive hole-transporting ability, D represents a flexible 2-valent group, $R^3$ represents a hydrogen atom, a substituted or unsubstituted alkyl group or a substituted or unsubstituted aryl group, Q represents a hydrolysable group, a represents an integer of from 1 to 3, and b represents an integer of from 1 to 4;

(IV)

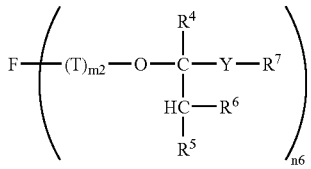

wherein, F represents an organic group derived from a compound having a positive hole-transporting ability, T represents a 2-valent group, Y represents an oxygen atom or a sulfur atom, $R^4$, $R^5$ and $R^6$ each independently represents a hydrogen atom or a monovalent organic group, $R^7$ represents a monovalent organic group, m2 represents 0 or 1, and n6 represents an integer of from 1 to 4, provided that $R^6$ and $R^7$ may be connected to each other to form a hetero ring wherein Y is a hetero atom;

(V)

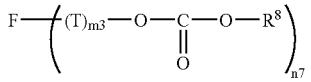

wherein F represents an organic group derived from a compound having a positive hole-transporting ability, T represents a 2-valent group, $R^8$ represents a monovalent organic group, m3 represents 0 or 1, and n7 represents an integer of from 1 to 4.

10. The image-forming device as described in claim 9, wherein the group F is a group represented by general formula (VI):

(VI)

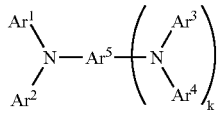

wherein $Ar^1$, $Ar^2$, $Ar^3$ and $Ar^4$ each independently represents a substituted or unsubstituted aryl group, $Ar^5$ represents a substituted or unsubstituted aryl group or arylene group, with 1 to 4 of $Ar^1$ to $Ar^5$ having a connecting bond to a moiety represented by general formula (VII) in the compound represented by the general formula (I), a moiety represented by general formula (VIII) in the compound represented by the general formula (II), a moiety represented by general formula (IX) in the compound represented by the general formula (III), a moiety represented by the general formula (X) in the compound represented by the general formula (IV) or a moiety represented by the general formula (XI) in the compound represented by the general formula (V):

$$—(X^1)_{n1}R^1—Z^1H \quad (VII)$$

$$—(X^2)_{n2}—(R^2)_{n3}—(Z^2)_{n4}G \quad (VIII)$$

$$—D—Si(R^3)_{(3-a)}Q_a \quad (IX)$$

-continued (X)

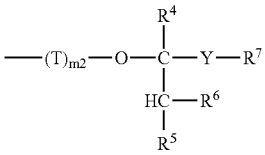

(XI)

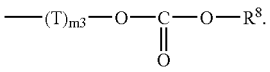

11. A process cartridge comprising:

an electrophotographic photoreceptor comprising a conductive support and a photo-sensitive layer on the conductive support, wherein the photo-sensitive layer comprises a functional layer comprising a cured product of a curable resin composition, the curable resin composition comprising an alcohol-soluble, curable resin and a polyether-modified silicone oil; and at least one unit selected from the group consisting of a charging unit that charges the electrophotographic photoreceptor, a developing unit that develops an electrostatic latent image formed on the electrophotographic photoreceptor to form a toner image, and a cleaning unit that removes toner particles remaining on a surface of the electrophotographic photoreceptor.

12. The process cartridge as described in claim 11, wherein the curable resin is a phenol resin.

13. The process cartridge as described in claim 11, wherein the functional layer further comprises at least one of conductive fine particles and a charge transporting material.

14. The process cartridge as described in claim 13, wherein the charge transporting material is at least one compound selected from compounds represented by general formulae (I), (II), (III), (IV) and (V):

$$F—[(X^1)_{n1}R^1\text{-}Z^1H]_{m1} \quad (I)$$

wherein F represents an organic group derived from a compound having a positive hole-transporting ability, $R^1$ represents an alkylene group, $Z^1$ represents an oxygen atom, a sulfur atom, NH or COO, $X^1$ represents an oxygen atom or a sulfur atom, m1 represents an integer of from 1 to 4, and n1 represents 0 or 1;

$$F—[(X^2)_{n2}—(R^2)_{n3}\text{-}(Z^2)_{n4}G]_{n5} \quad (II)$$

wherein F represents an organic group derived from a compound having a positive hole-transporting ability, $X^2$ represents an oxygen atom or a sulfur atom, $R^2$ represents an alkylene group, $Z^2$ represents an oxygen atom, a sulfur atom, NH or COO, G represents an epoxy group, n2, n3 and n4 each independently represents 0 or 1, and n5 represents an integer of from 1 to 4;

$$F[\text{-}D\text{-}Si(R^3)_{(3-a)}Q_a]_b \quad (III)$$

wherein, F represents a b-valent organic group derived from a compound having a positive hole-transporting ability, D represents a flexible 2-valent group, $R^3$ represents a hydrogen atom, a substituted or unsubstituted alkyl group or a substituted or unsubstituted aryl group, Q represents a hydrolysable group, a represents an integer of from 1 to 3, and b represents an integer of from 1 to 4;

(IV)

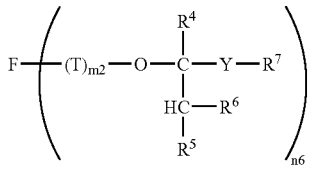

wherein, F represents an organic group derived from a compound having a positive hole-transporting ability, T represents a 2-valent group, Y represents an oxygen atom or a sulfur atom, $R^4$, $R^5$ and $R^6$ each independently represents a hydrogen atom or a monovalent organic group, $R^7$ represents a monovalent organic group, m2 represents 0 or 1, and n6 represents an integer of from 1 to 4, provided that $R^6$ and $R^7$ may be connected to each other to form a hetero ring wherein Y is a hetero atom;

(V)

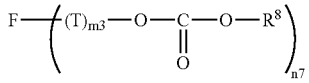

wherein F represents an organic group derived from a compound having a positive hole-transporting ability, T represents a 2-valent group, $R^8$ represents a monovalent organic group, m3 represents 0 or 1, and n7 represents an integer of from 1 to 4.

15. The process cartridge as described in claim 14, wherein the group F is a group represented by general formula (VI):

(VI)

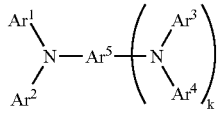

wherein $Ar^1$, $Ar^2$, $Ar^3$ and $Ar^4$ each independently represents a substituted or unsubstituted aryl group, $Ar^5$ represents a substituted or unsubstituted aryl group or arylene group, with 1 to 4 of $Ar^1$ to $Ar^5$ having a connecting bond to a moiety represented by general formula (VII) in the compound represented by the general formula (I), a moiety represented by general formula (VIII) in the compound represented by the general formula (II), a moiety represented by general formula (IX) in the compound represented by the general formula (III), a moiety represented by the general formula (X) in the compound represented by the general formula (IV) or a moiety represented by the general formula (XI) in the compound represented by the general formula (V):

(VII)

$$—(X^1)_{n1}R^1—Z^1H$$

(VIII)

$$—(X^2)_{n2}—(R^2)_{n3}—(Z^2)_{n4}G$$

-continued $$-D-Si(R^3)_{(3-a)}Q_a \quad (IX)$$

$$-(T)_{m2}-O-\underset{\underset{R^5}{|}}{\overset{\overset{R^4}{|}}{C}}-Y-\underset{\underset{R^5}{|}}{\overset{\overset{R^4}{|}}{C}}H-R^6 \quad (X)$$

$$-(T)_{m3}-O-\underset{\underset{O}{\|}}{C}-O-R^8. \quad (XI)$$

16. An image-forming method comprising:

charging the electrophotographic photoreceptor described in claim 1;

exposing the charged electrophotographic photoreceptor to form an electrostatic latent image;

developing the electrostatic latent image with a toner; and transferring the toner image to a transfer medium.

17. The image-forming method as described in claim 16, wherein the curable resin is a phenol resin.

18. The image-forming method as described in claim 16, wherein the functional layer further comprises at least one of conductive fine particles and a charge transporting material.

19. The image-forming method as described in claim 18, wherein the charge transporting material is at least one compound selected from compounds represented by general formulae (I), (II), (III), (IV) and (V):

$$F-[(X^1)_{n1}R^1\text{-}Z^1H]_{m1} \quad (I)$$

wherein F represents an organic group derived from a compound having a positive hole-transporting ability, $R^1$ represents an alkylene group, $Z^1$ represents an oxygen atom, a sulfur atom, NH or COO, $X^1$ represents an oxygen atom or a sulfur atom, m1 represents an integer of from 1 to 4, and n1 represents 0 or 1;

$$F-[(X^2)_{n2}-(R^2)_{n3}\text{-}(Z^2)_{n4}G]_{n5} \quad (II)$$

wherein F represents an organic group derived from a compound having a positive hole-transporting ability, $X^2$ represents an oxygen atom or a sulfur atom, $R^2$ represents an alkylene group, $Z^2$ represents an oxygen atom, a sulfur atom, NH or COO, G represents an epoxy group, n2, n3 and n4 each independently represents 0 or 1, and n5 represents an integer of from 1 to 4;

$$F[\text{-}D\text{-}Si(R^3)_{(3-a)}Q_a]_b \quad (III)$$

wherein, F represents a b-valent organic group derived from a compound having a positive hole-transporting ability, D represents a flexible 2-valent group, $R^3$ represents a hydrogen atom, a substituted or unsubstituted alkyl group or a substituted or unsubstituted aryl group, Q represents a hydrolysable group, a represents an integer of from 1 to 3, and b represents an integer of from 1 to 4;

$$F\left(-(T)_{m2}-O-\underset{\underset{R^5}{|}}{\overset{\overset{R^4}{|}}{C}}-Y-\underset{\underset{R^5}{|}}{\overset{\overset{R^4}{|}}{C}}H-R^6\right)_{n6} \quad (IV)$$

wherein, F represents an organic group derived from a compound having a positive hole-transporting ability, T represents a 2-valent group, Y represents an oxygen atom or a sulfur atom, $R^4$, $R^5$ and $R^6$ each independently represents a hydrogen atom or a monovalent organic group, $R^7$ represents a monovalent organic group, m2 represents 0 or 1, and n6 represents an integer of from 1 to 4, provided that $R^6$ and $R^7$ may be connected to each other to form a hetero ring wherein Y is a hetero atom;

$$F\left(-(T)_{m3}-O-\underset{\underset{O}{\|}}{C}-O-R^8\right)_{n7} \quad (V)$$

wherein F represents an organic group derived from a compound having a positive hole-transporting ability, T represents a 2-valent group, $R^8$ represents a monovalent organic group, m3 represents 0 or 1, and n7 represents an integer of from 1 to 4.

20. The image-forming method as described in claim 19, wherein the group F is a group represented by general formula (VI):

$$(Ar^1)(Ar^2)N-Ar^5-\left(C(Ar^3)(Ar^4)\right)_k \quad (VI)$$

wherein $Ar^1$, $Ar^2$, $Ar^3$ and $Ar^4$ each independently represents a substituted or unsubstituted aryl group, $Ar^5$ represents a substituted or unsubstituted aryl group or arylene group, with 1 to 4 of $Ar^1$ to $Ar^5$ having a connecting bond to a moiety represented by general formula (VII) in the compound represented by the general formula (I), a moiety represented by general formula (VIII) in the compound represented by the general formula (II), a moiety represented by general formula (IX) in the compound represented by the general formula (III), a moiety represented by the general formula (X) in the compound represented by the general formula (IV) or a moiety represented by the general formula (XI) in the compound represented by the general formula (V):

$$-(X^1)_{n1}R^1-Z^1H \quad (VII)$$

$$-(X^2)_{n2}-(R^2)_{n3}-(Z^2)_{n4}G \quad (VIII)$$

$$-D-Si(R^3)_{(3-a)}Q_a \quad (IX)$$

-continued
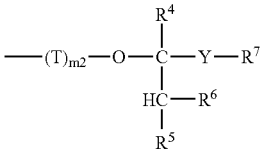
(X)
-continued
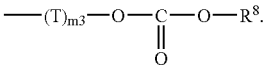
(XI)
* * * * *